United States Patent [19]

Carlin et al.

[11] Patent Number: 4,583,170

[45] Date of Patent: Apr. 15, 1986

[54] PORTABLE OILFIELD FLUID MANAGEMENT SYSTEM AND METHOD

[75] Inventors: John A. Carlin; William G. Mesch, both of Denver; Joseph R. Skovrinski, Englewood; J. Bart Henthorn, Aurora; David G. Feldman, Englewood; Steven A. Beard, Aurora, all of Colo.

[73] Assignee: Cypher Systems, Inc., Denver, Colo.

[21] Appl. No.: 558,841

[22] Filed: Dec. 6, 1983

Related U.S. Application Data

[63] Continuation-in-part of Ser. No. 554,440, Nov. 22, 1983, abandoned.

[51] Int. Cl.[4] ..... G06F 15/20; G06F 3/05

[52] U.S. Cl. ..... 364/420; 364/509; 340/825.36; 340/870.16

[58] Field of Search ..... 364/400, 420, 422, 505–506, 364/509–510; 340/606, 609, 618, 623, 825.36, 870.16; 166/250, 261, 280, 351, 373

[56] References Cited

U.S. PATENT DOCUMENTS

| | | | |
|---|---|---|---|
| 3,760,362 | 9/1973 | Copland et al. | 364/420 X |
| 3,980,136 | 9/1976 | Plummer et al. | 166/280 |
| 4,126,181 | 11/1978 | Black | 166/280 |
| 4,349,882 | 9/1982 | Asmundsson et al. | 364/509 |
| 4,355,363 | 10/1982 | Colby et al. | 364/509 |
| 4,387,434 | 6/1983 | Moncrief, Jr. et al. | 364/509 |
| 4,418,340 | 11/1983 | Maeshiba | 340/618 |
| 4,459,584 | 7/1984 | Clarkson | 340/618 X |
| 4,487,065 | 12/1984 | Carlin et al. | 364/509 X |
| 4,487,066 | 12/1984 | Pardi et al. | 364/509 X |

OTHER PUBLICATIONS

Pai et al., "Tight Sands Require Detailed Planning", *Oil and Gas Journal,* Jul. 25, 1983, pp. 135–139.

Pai et al., "Formation Needs Are Key to Fluid and Proppant Selection", *Oil and Gas Journal,* Aug. 8, 1983, pp. 126–128.

Pai et al., "Logistical Planning Excludes Human Error and Mechanical Failure", *Oil and Gas Journal,* Aug. 22, 1983, pp. 144–146.

Pai et al., "Operational Planning Requires Good Equipment and Experienced Personnel", *Oil and Gas Journal,* Sep. 5, 1983, pp. 140–142.

*Model* 1780*A InfoTouch Display Instruction Manual,* John Fluke Mfg. Co., Inc., P/N 630798, Jul. 1982.

*Primary Examiner*—Gary V. Harkcom

*Attorney, Agent, or Firm*—Robert C. Dorr

[57] ABSTRACT

A portable oilfield fluid management system and method provides display information concerning fluid status and includes a plurality of local sensing units which can be selectively attached in any order to a plurality of different storage tanks having different sizes, shapes and capacities located in different oilfields. A plurality of cable segments each of equal predetermined length are used to interconnect the attached local sensing units to each other in a serial connection and a central touch activated monitor located away from the local sensing units is interconnected to the first attached local sensing unit by means of an elongated cable. Because the local storage units which function to measure the level of fluid in the storage tanks can be attached to the storage tanks in any order, the central touch-activated monitor autoconfigures the local sensing units by assigning binary addresses to each attached local sensing unit. The first attached local sensing unit when it receives its binary address from the central touch activated monitor, stores that binary address in its random access memory and interconnects an upstream data transmission path to enable the central monitor to assign the next binary address to the next attached local sensing unit. This process is repeated for each attached and interconnected local sensing unit until all local sensing units have a binary address. The system autoconfigures the local sensing units for each different oilfield location.

26 Claims, 24 Drawing Figures

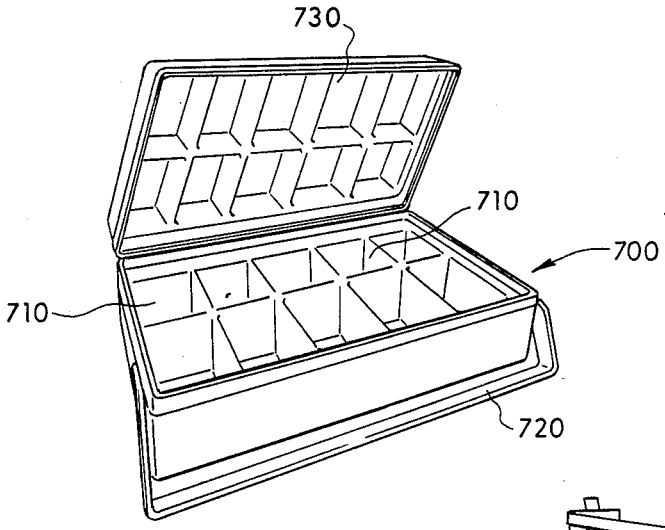
Fig. 7
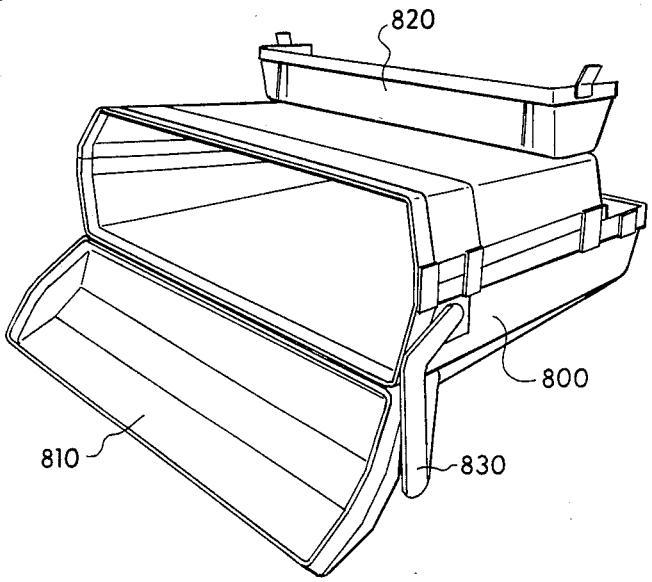
Fig. 8
Fig. 9
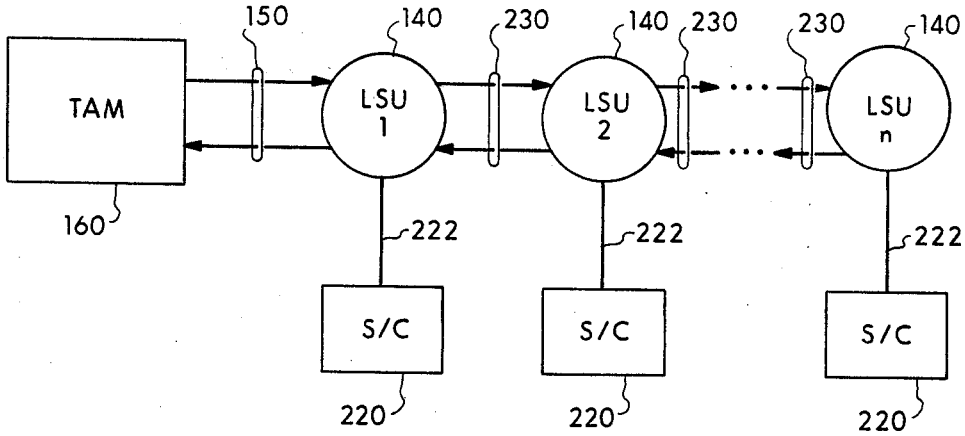

START TOUCH

WAIT FOR KEYPRESS
USER
PASS KEY NUMBER TO DISPLAY
START SETUP
START SETUP

SETUP ?
YES
SETUP DISPLAY
END
NO
KEY PRESS ?
YES
DECODE & PERFORM FUNCTION
END
NO
LSU INFO ?
YES
UPDATE & DISPLAY DATA
END
NO
END
START LSU

READ NEXT LSU
CONVERT READING
PASS READING
RESTART TIMER
START SETUP
END

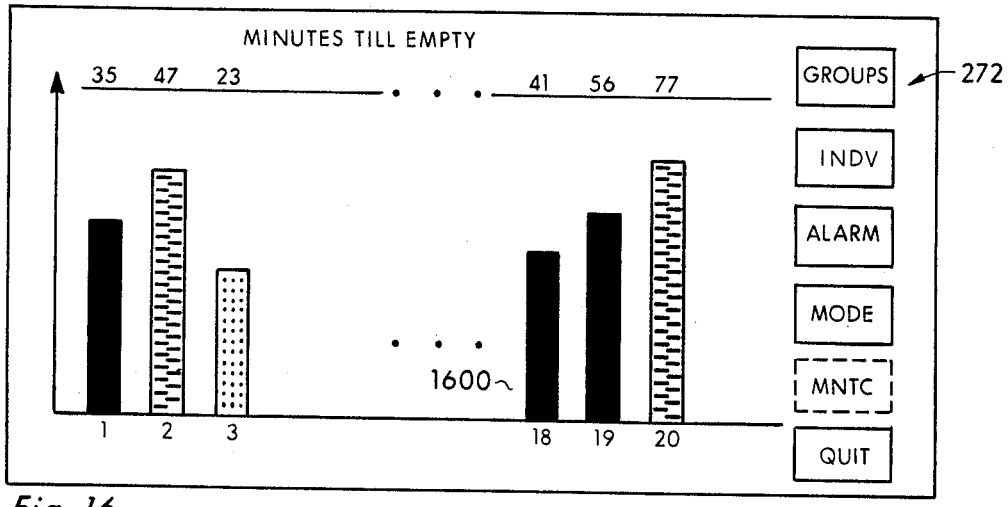
Fig. 16
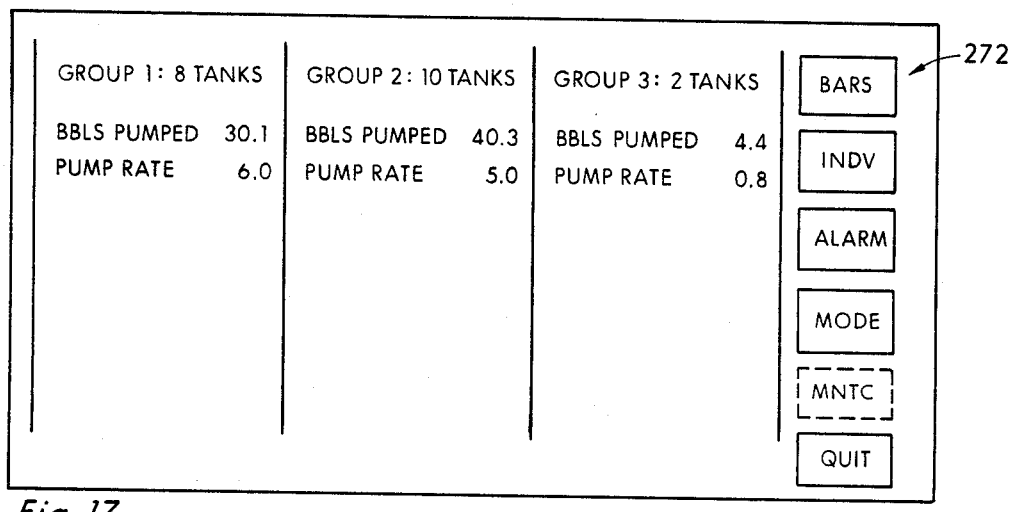
Fig. 17
Fig. 18
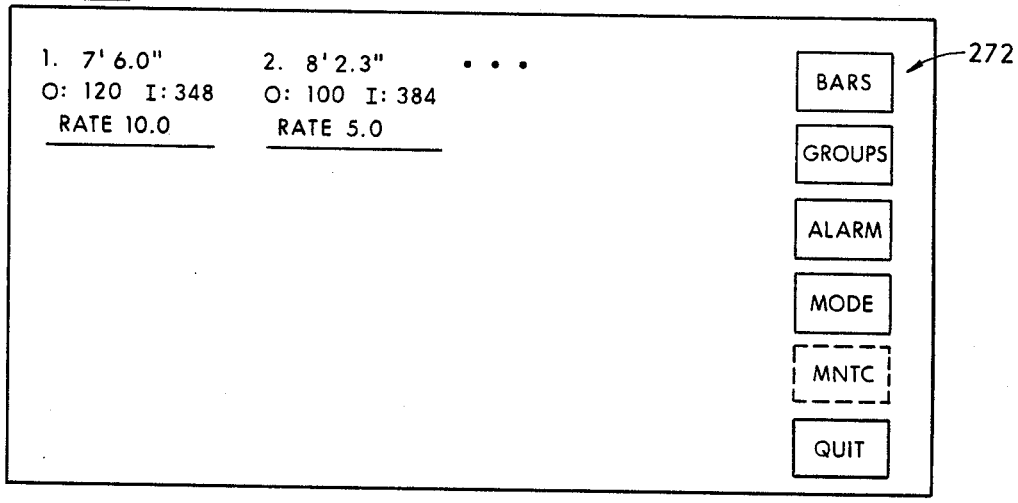

PORTABLE OILFIELD FLUID MANAGEMENT SYSTEM AND METHOD

BACKGROUND OF THE INVENTION

Related Application

This application is a continuation-in-part of U.S. patent application Ser. No. 554,440, filed Nov. 22, 1983 now abandoned.

Field of the Invention

The present invention relates to an improved oilfield fluid management system and method for monitoring the levels of different fluids in varying sized and shaped storage tanks and, in particular, to a highly portable system that can autoconfigure itself to different numbers and sizes of fluid tanks wherein the tanks contain the different fluids necessary for treating oil and gas bearing formations.

Description of the Prior Art

One technique to enhance recovery in an oil and gas bearing formation through fluid treatment is to "fracture" the formation through the injection of fluids under known hydraulic techniques.

In a series of articles by Viphal Pai and Sam Garbis appearing in four issues of the *Oil & Gas Journal* (July 25, 1983; Aug. 8, 1983; Aug. 22, 1983; and Sept. 5, 1983) and entitled "MHF Treatment Design", the current design techniques for implementing massive hydraulic fracturing (MHF) is set forth for the stimulation of low permeability hydrocarbon reservoirs.

In designing an MHF system for a particular oilfield, great care must be taken in not only designing the overall injection procedure but also in operating the system to anticipate and avoid problems that can be encountered. For example, and as set forth in Table 5 of the Pai and Garbis articles, the following suggested pumping schedule, in part, is set forth for the injection of frac fluids into a wellhead:

a. Pump 100,000 gal gelled 2% K+Cl water prepad; at the rate allowed.
b. Pump 80,000 gal 50 lb X-linked 2% K+Cl water at 20 bbl/min.
c. Pump 80,000 gal 50 lb X-linked 2% K+Cl water with 0.5 ppg 20–40 sand.
d. Pump 80,000 gal 40 lb X-linked 2% K+Cl water with 1 ppg 20–40 sand.
e. Pump 40,000 gal 30 lbs X-linked 2% K+Cl water with 2 ppg 20–40 sand.
f. Pump 20,000 gal 30 lb X-linked 2% K+Cl water with 3 ppg 20–40 sand.
g. Pump 20,000 gal 30 lb X-linked 2% K+Cl water with 4 ppg 20–40 sand.
h. Pump 40,000 gal 30 lb X-linked 2% K+Cl water with 6 ppg 20–40 sand.

Such a formulation requires large quantities of frac fluid and proppant such as sand. In a typical operation up to three different fluids such as crude oil condensate from the formation, gelled water, and acid are stored in large storage tanks. As witnessed in the above table, these fluids are combined in different proportions at different stages of the frac operation. Furthermore, the frac design for each different oilfield location can involve different numbers of tanks, different sizes of tanks, and different configurations of tanks as well as totally different quantities, types and proportions of fluids.

Typically large fluid and proppant volumes are pumped over a three to forty-eight hour time interval into the wellhead and it is of paramount importance, as recognized in the Pai and Garbis articles, to monitor fluid rates at all times. Small variations in fluid rates can become significant when such rates are not monitored over extended periods of time. The aforesaid authors recommend that three methods be used simultaneously to monitor fluid rates. The first is to use conventionally available turbine-type flow meters, the second is to count pump strokes which when correllated with the pump displacement capacity and efficiency of the pump provides information as to flow rate, and the third approach, one emphasized by the authors, is to physically measure the change in the level of the fluid in the various frac tanks over a given length of time.

To accomplish the latter test, persons (termed gaugers) are assigned to measure the level of fluids in the tanks and this is essentially a full-time responsibility. The tanks are spaced relatively close to each other and the gaugers jump from the top of one tank to the top of an adjacent tank, open the hatch on each tank and with a measuring stick determine the level of the fluid present in the tank. The gaugers then ratio the measured levels to a control truck and, after conversion of the measured level (based upon a chart) to barrels, the operators (termed treaters) in the control truck have up-to-the-minute readings for each tank. The treaters ascertain, in part, whether the flow from the tanks is uniform or whether one tank is flowing faster than the others.

It is important that the level of the fluid in any one of the tanks does not drop below a predetermined low value in order to prevent the introduction of "air" into the system which can result in an extremely dangerous condition. When air is introduced into the pumping system from the tanks, the conventionally used pumps can be thrown out of balance thereby causing possible severe damage to the pumps sometimes with such force as to cause the pump truck to bounce off the ground. In that event, any personnel in the vicinity could be hurt. Another problem caused by the introduction of air is the creation of an air hammer effect in the plumbing which may result in severe vibration in the lines. Such air hammers have been known to cause lines to blow, thereby ending the frac operation and risking the destruction of the well itself.

The present invention provides a highly portable system and method for monitoring the level of fluid in the frac tanks, and, in doing so, improves upon the teachings set forth in "Oilfield Lease Management and Security System and Method Therefor" Ser. No. 472,651 filed on Mar. 7, 1983, now U.S. Pat. No. 4,551,719 and in "Storage Tank Level Monitoring Apparatus and Method Therefor", U.S. Pat. No. 4,487,065 issued on Dec. 11, 1984 to Carlin et al. which are commonly assigned with this application. In the aforesaid applications, a novel oilfield lease management and security system and method therefore was set forth which utilized a plurality of transducers connected to oilfield storage tanks, a communication access panel for allowing authorized users to interface with the system, and a monitoring system for monitoring the levels of the fluid in each of the oilfield storage tanks as fluid is added to and taken from the tanks. In the event of unauthorized taking of fluid from the oilfield storage tanks, an alarm is sounded. The oilfield lease management and security system has been improved upon and modified, as hereinafter set forth, to provide a system for continuously monitoring the levels of fluid stored in the various "frac" tanks, to provide a system that is adaptable to any configuration or any size of frac tanks, to provide a system which is highly portable and one which can be moved from oilfield location to oilfield location and be quickly assembled and disassembled. Because of this portability, the system has the capability to autoconfigure itself to the specific structural arrangement of each different location.

SUMMARY OF THE INVENTION

The present invention sets forth an improved oilfield fluid management system which is highly portable and which can be moved from one oilfield location to another. The oilfield fluid management system, in the preferred environment, can be assembled and disassembled in a matter of hours and is capable of measuring the levels of a plurality of different fluids stored in a plurality of different storage tanks located at each different oilfield. The fluid management system of the present invention is adaptable to storage tanks having the same or different sizes, shapes and capacities.

The present invention includes a plurality of local sensing units which can be selectively attached in any order to an exterior surface on the storage tanks. Attached to each local sensing unit is a level sensing device which can be unwrapped and inserted through a hatch on the tank and selectively attached to the interior of the tank for measuring the level of the fluid. In the preferred embodiment, an ultrasonic sensor is used to measure the levels. Each local sensing unit is highly portable and can be quickly attached and detached from the tank. The sensor is designed to wrap around the underlying pedestals of the handle of the local sensing unit.

A plurality of cable segments each of equal predetermined length are used to interconnect the attached local sensing units to each other in a serial connection. The cable segments are unreeled from a reel carriage for installation and each cable segment is attached to each other on the reel by means of opposing male and female connectors. When the system is disassembled, the cable segments are reattached to each other and reeled back onto the reel carriage.

A central touch-activated monitor is located away from the local sensing units and is interconnected by means of a cable connected therewith which cable is also reeled and unreeled from the carriage reel. When the system is installed and interconnected, the central monitor is capable of autoconfiguration wherein the central monitor assigns a binary address to each attached local sensing unit. This autoconfiguration process eliminates the necessity of having internal identity codes permanently assigned in each local sensing unit and the necessity of placing these local sensing units in a particular order on the tanks. Hence, once the central monitor autoconfigures the system, the central monitor knows which local sensing unit is connected to which tank.

The autoconfiguration process includes a double handshake process wherein the first interconnected local sensing unit receives the first binary address from the central monitor. The first local sensing unit stores that binary address in its random access memory and retransmits the first binary address back to the central monitor with an acknowledgement signal. The central monitor receives the retransmitted first binary address and compares it to the address sent and if proper, resends the first binary address back to the first local sensing unit. The local sensing unit receives the redelivered first binary address, compares it to the address stored in its random access mamory, and if correct, connects a path to the next interconnected local sensing unit by enabling an upstream transmitter so that the central monitor can now communicate with the next serially interconnected local sensing unit. This process is repeated for each interconnected local sensing unit.

DESCRIPTION OF THE DRAWING

FIG. 7 is a perspective view of the carrying case for the local sensing units (LSUs) of the present invention;

FIG. 8 is the carrying case for the touch activated monitor (TAM) of the present invention;

FIG. 9 is a block diagram of the monitoring system of the present invention;

FIG. 16 is a graphical illustration of the bar display of the present invention;

FIG. 17 is a graphical illustration of the groups display of the present invention;

FIG. 18 is a graphical illustration of the individual display of the present invention;

DESCRIPTION OF THE PREFERRED EMBODIMENT

1. Prior Art

Figure 1:
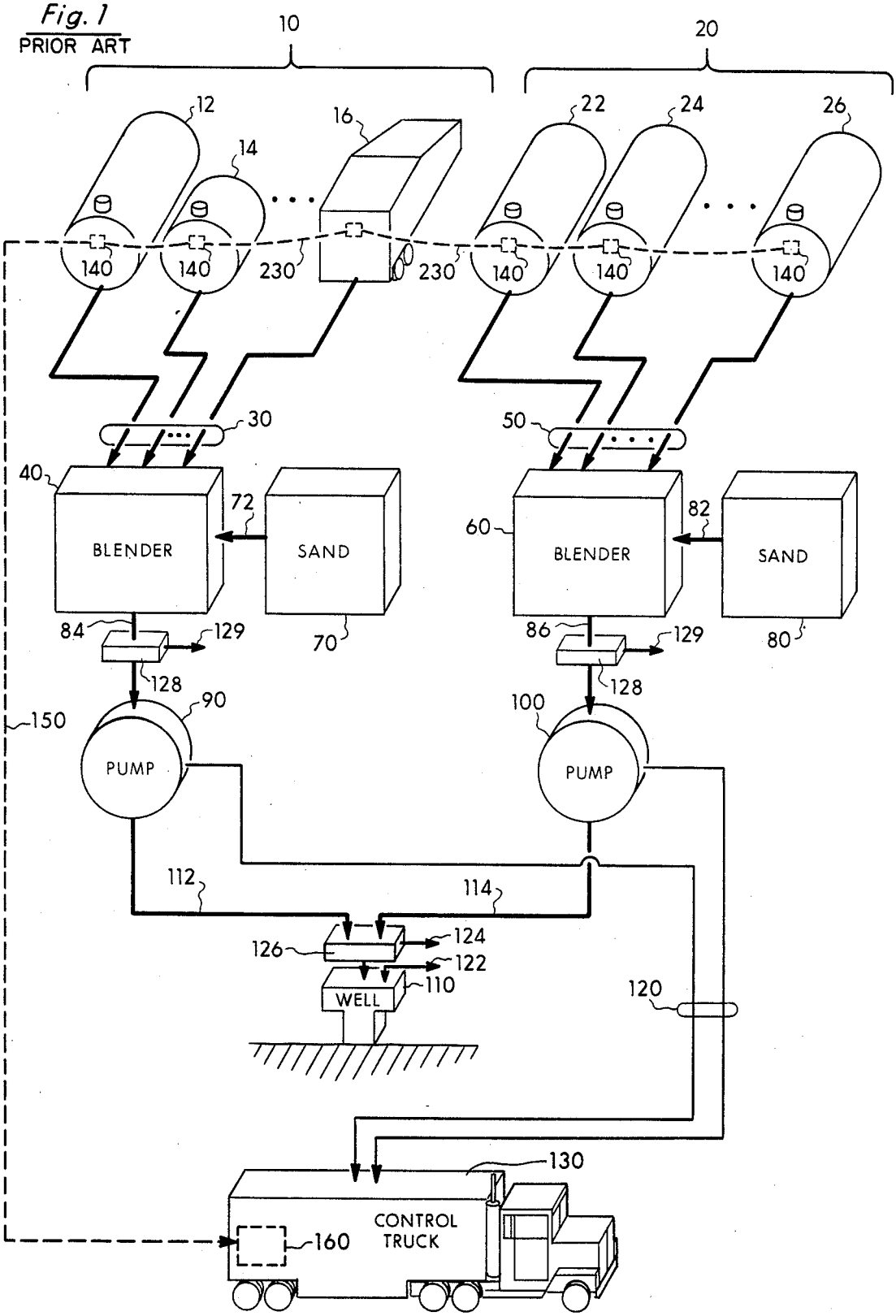
Fig. 1 PRIOR ART
FIG. 1 shows a prior art illustration, in partial perspective, of an MHF oilfield frac system.

In FIG. 1, is shown in simplified illustration and based upon FIG. 9 in the aforesaid Pai and Garbis articles a prior art MHF operation located in an oilfield.

The frac system comprises a plurality of frac tanks 12, 14 and 16 in a first bank 10 of tanks and a second plurality of frac tanks 22, 24, and 26 oriented in a second bank 20 of tanks. In a typical installation, a total of ten to twenty frac tanks are utilized which contain the fluid necessary to treat the oil and gas bearing formation. These tanks can range fron eight feet to twelve feet in height and are of varying lengths, configurations and capacities. For purposes of illustration, each of the tanks 12, 14, and 16 in bank 10 of tanks are different sizes and configurations. And, hence, each are of different capacities. The tanks 22, 24 and 26 in back 20 of tanks, also for purposes of illustration, are of uniform shape and size.

The tanks 10 are interconnected over plumbing 30 to a first blender 40 and tanks 20 are interconnected over plumbing 50 to a second blender 60. Blender 40 receives sand proppant from silo 70 over plumbing 72 and blender 60 receives sand proppant from silo 80 over plumbing 82. The sand proppant could be silica jell or beads or, in high pressure formations, bauxite. The blenders 40 and 60 function to mix the fluids from the tanks 10 and 20, respectively, in proper proportion and to blend in a predetermined amount of sand from the sand silos 70 and 80. The combined slurry from the blenders 40 and 60 are then delivered over plumbing 84 and 86, respectively, to pumps 90 and 100. The pumps 90 and 100 inject the slurry into the well head 110 over plumbing 112 and 114.

Conventionally, signals such as signals on lines 120 interconnected with the pumps 90 and 100 are delivered into a control truck 130 so that treater personnel located in the control truck, typically parked on the opposite side of the well head 110, can view the equipment and monitor the operation of the equipment. It is to be expressly understood that the signals appearing on lines 120 which, for example, deliver signals as to the pump stroke count is representative of but one of many signals from other monitors that are delivered into the control truck 130 from the equipment shown in FIG. 1. Other typical signals which may be delivered into the control truck 130 are the well head, casing, and line pressures 122 at the well head, readings 129 from nuclear densiometers 128 in the flow lines, and signals 124 from flow meter 126. The structural arrangement discussed above is known to those skilled in the art. All of the equipment shown is portable and can be moved from oilfield location to oilfield location.

The present invention, in part, pertains to the added equipment shown in dotted lines in FIG. 1. This equipment includes a plurality of local sensing units (LSUs) 140 connected in series by means of cable segments 230 of predetermined equal lengths which are further interconnected over cable 150 to a central touch activated monitor (TAM) 160 located in the control truck 130. The system of the present invention through its auto-configuring capability is retrofitable to any number of any sized tanks 10 or 20 and can be quickly disassembled into a highly portable carrying system for secure transportation to the next well head location.

For example, the treatment for a typical well head operation may be finished in several days time after which all of the portable equipment in FIG. 1 is disassembled and moved to another oilfield location or is split up and moved to other locations. The equipment of the present invention, therefore, must be highly portable, easy to install and disassemble, highly reliable and only take a short time such as an hour or less to install and disassemble. Under the teachings of the present invention, the attachment of the LSUs 140 to the tanks 10 and 20 can be in any order since the TAM 60 will automatically configure the mounted LSUs to any tank setup. This is important since the system of the present invention can be used in a large number of different oilfield environments.

The system of the present invention also eliminates the necessity of having manual readings taken by the gaugers as to the physical level of the fluid in each of the storage tanks. It further improves the quality control during a job by eliminating the possible human error whenever the levels in a tank are physically measured. Clearly the provision of continuous monitoring of the level in each tank permits immediate detection of any dangerously low fluid levels and, hence, the risk of introducing air. The elimination of manpower for this function is significant in view of recent cutbacks in the oil and gas industry. For example, when ten tanks are used two to three gaugers may be necessary and three to four gaugers may be required to read twenty tanks. In addition, the method and system of the present invention is safer than that present when personnel move from the top of one tank to another to take physical readings during the job. Hence, lower insurance premium rates may be possible through implementation of the present invention.

2. Monitoring System of the Present Invention

Figure 2:
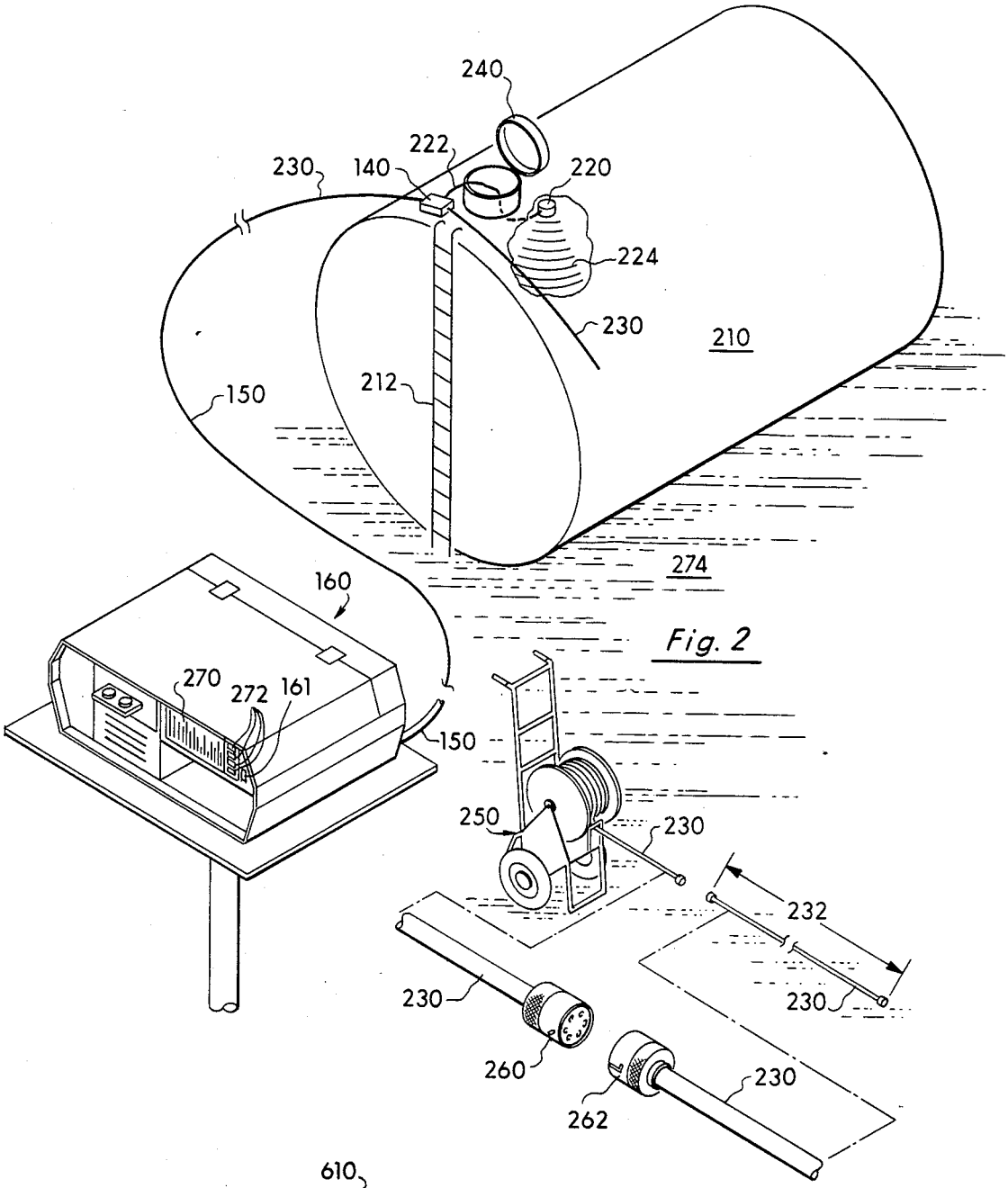
FIG. 2 is an illustration of the present invention being installed, in a modular fashion, to the MHF oilfield system of FIG. 1.

In FIG. 2, the monitoring system of the present invention is set forth to include one of a plurality of local sensing units (LSUs) 140 removably attachable to a fluid tank 210, an ultrasonic sensor 220 mounted to the interior of tank 210 and connected to the LSU 140 by means of a sensor cable 222, a plurality of interconnecting cable segments 230 of equal predetermined length 232, a main interconnecting elongated cable 150, and a touch activated central monitor (TAM) 160 which is located in the control truck 130.

In operation, the frac tanks 10 and 20 as shown in FIG. 1 and with one as specifically represented in FIG. 2 as tank 210 are transported to the oilfield site and are typically laid side-by-side. Under the teachings of the present invention, each LSU 140 is self-contained in a shock resistant plastic case and is magnetically mounted to the outside of tank 210 as shown in FIG. 2. Connected to each LSU 140 is an ultrasonic detector 220 and a cable 222. The ultrasonic detector 220 is inserted through the hatch 240 of the tank and is positioned on the upper inside surface of the tank 210 so that ultrasonic waves 224 are directed downwardly to the surface of the fluid contained within tank 210. Cable segments 230 of equal predetermined length 232 (such as twenty feet) are unreeled from a moveable reel carrier 250 which is pushed along the ground 274 and in front of the tanks 10 and 20. One or more segments 230 may be necessary to connect adjacent LSUs 140. As will be discussed, the LSUs 140 are serially electrically connected. Each cable segment 230 has a conventional male connector 260 on one end and a conventional female connector 262 on the other end which can be quickly engaged to form cable lengths in multiples of the predetermined length of 232 or which can be reeled back onto the reel carrier 250 when disassembled for transportation to the next oilfield location.

Hence, as can be observed in FIGS. 1 and 2, the number of tanks 10 and 20 in a given location can vary and the present invention being portable and modular can quickly adapt to any configuration in a given oilfield location as set forth above.

In a typical installation, the installer climbs ladder 212 which is located on the front of tank 210 and places a single LSU 140 on the top of tank 210. The installer then opens the hatch 240 and inserts the ultrasonic detector 220 which is magnetically mounted to the upper surface on the inside of the tank 210. The installer then removes cable segments 230 from the reel 250 and attaches a segment on either side of the LSU 140 to the corresponding male and female connectors as shown in FIG. 2. The installer continues for each adjacent tank until all of the tanks 10 and 20 are serially interconnected as shown in FIG. 1. The first LSU 140 is connected to one end of cable 150 and cable 150 is typically 100 to 200 feet in length which is connected to the TAM 160. TAM 160 provides monitoring output information as well as receives operator input information such as the strapping table information for each tank and the current level of fluid in the tank. Hence, the installer or user of the system will input information concerning the capacity and configuration of each tank 210 (strapping information) and the current level of the fluid. The nature and format of this input information will be discussed later. Once inputted, however, TAM 160 will autoconfigure each of the LSUs 140 independent of the order of being installed in a manner also to be subsequently explained. In the preferred embodiment up to twenty LSUs can be interconnected to the TAM 160 in this fashion. It is to be understood that the teachings of the present invention can be utilized in situations having more than twenty LSUs.

3. Local Sensing Unit (LSU) of the Present Invention

Figure 3:
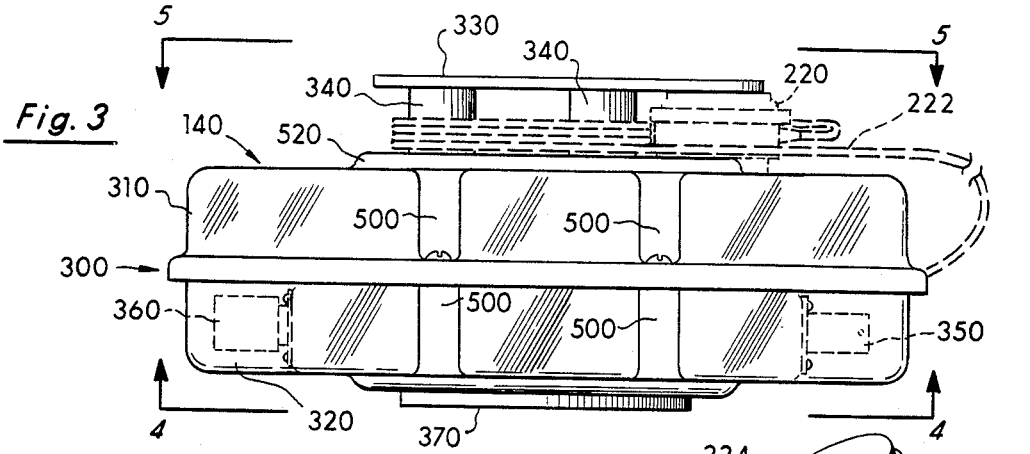
FIG. 3 is a side and partial perspective view of the local sensing unit (LSU) of the present invention.
Figure 4:
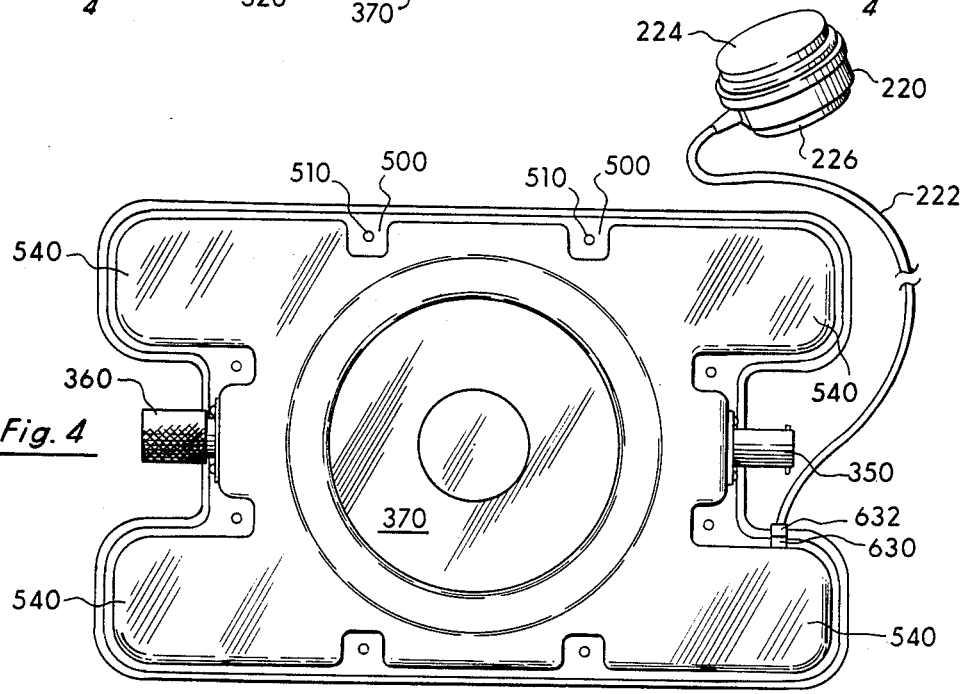
FIG. 4 is the bottom view of the lower cover of the local sensing unit (LSU) of FIG. 3.
Figure 5:
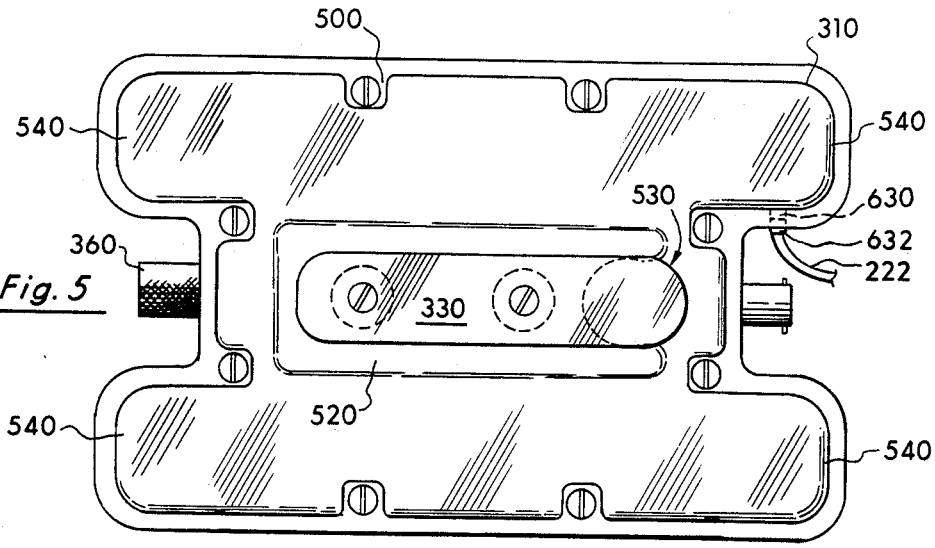
FIG. 5 is the top planar view of the upper cover of the local sensing unit (LSU) of FIG. 3.

In FIGS. 3–5, the container for the local sensing unit (LSU) 140 is set forth. Each LSU is protected by a rectangular modular container 300 which is comprised of an upper cover 310 and a lower cover 320 all of which is made of molded plastic or the like. The engagement of the upper cover 310 with the lower cover 320 is watertight. Disposed on the upper cover 310 is a handle 330 mounted on two attached supports or pedestals 340. The handle 330 is preferably a flat elongated metal plate coated with protective plastic or paint.

Disposed on the lower cover 320 are two opposing electrical connectors 350 and 360. Connector 360 is a male connector and connector 350 is a female connector. Each connector 350 and 360 is receptive of the appropriate mating end of cable segment 230. On the underside of the lower cover 320 is affixed a flat circular magnet 370 for holding the container to the tank. Finally, attached to the side of the bottom cover 320 by means of cable 222 is an ultrasonic detector 220 having a magnet 224 affixed on the upper surface and an ultrasonic detector 226 affixed on the lower opposing surface.

In operation, the installer grasps the handle 330 and places the container 300 on the top of tank 210 by means of magnet 370 which holds it firmly in place. The installer then unwraps cable 222 from around pedestals 340 and places the ultrasonic detector 220 on the underside of the upper surface of tank 210 as previously discussed. When the LSUs 140 are not in use or in transit, the installer removes the container 300 from the side of the tank 210, wraps cord 222 around the pedestals 340 between said handle 330 and said cover top 310 and affixes the ultrasonic detector 220 to the underside of the handle 330 by means of magnet 224 as shown by the dotted lines in FIG. 3. The pedestals are of sufficient height to permit the detector 220 to slide under the handle 330 and above the upper cover 310. In this fashion, each LSU 140 can be transported and stored with the sensor 220 and the cord 222 also neatly stored or tucked under the handle or whenever the level is not attached to the tank.

The details of the bottom cover 320 are shown in FIG. 4 whereas the details of the upper cover 310 are shown in FIG. 5. As shown in FIGS. 3–5, slots 500 are formed around the periphery of the top and bottom covers 310 and 320 and centered in each slot of the bottom cover 320 is a formed hole 510 which is receptive of cap screws or the like to firmly engage the upper cover 310 to the lower cover 320 in a conventional fashion.

In addition, a raised ledge 520 is formed on the top cover 310 directly underneath the handle 330. The raised ledge 520 has a formed slot opening 530 which is slightly larger than the diameter of the transducer 220 and which is receptive of the transducer 220 when the transducer 220 is stored underneath the handle as shown by the dotted lines in FIG. 3.

In the preferred embodiment, cable 222 is four to six feet long, and the container is approximately six and one-half inches wide by eight inches long by four inches deep. Finally, on the top and bottom covers 310 and 320 are formed protruding lips 540 which extend longitudinally outwardly from the container 300 a sufficient distance to protect the male and female connectors 350 and 360 from damage when being transported, stored or dropped.

On the interior of each container 140 is held the LSU package of electronics mounted in a shock absorbing environment. The electronics used in the LSUs 140 and in the TAM 160 are similar to those utilized in the aforesaid mentioned Oilfield Lease Management and Security Systems and Method Therefore, Ser. No. 472,651, filed Mar. 7, 1983 now U.S. Pat. No. 4,551,719 (hereinafter specifically referred to as "Oilfield Lease reference"). The one important modification is found in the removal of the permanent identity code found in each LSU. Under the teachings of the present invention, the LSUs do not contain a permanent identity code since the system, because of its high portability and adaptability to different frac operations in different oilfields autoconfigures itself to the LSUs independent of which LSU is installed on which tank. It is to be further noted that for measuring the level of "frac" fluids, the temperature of the environment within the tank need not be measured but can optionally be performed.

Figure 6:
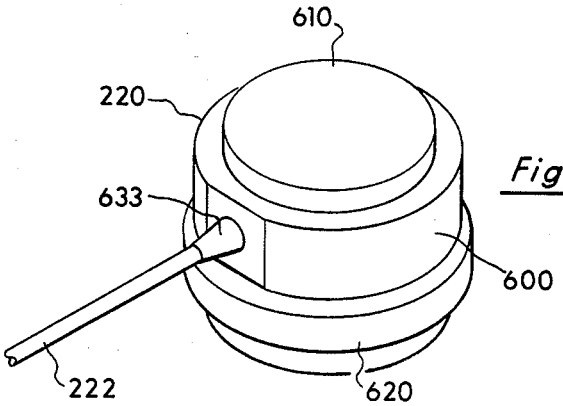
FIG. 6 is a perspective view of the sensor of the present invention.

FIG. 6 shows the details of the ultrasonic detector 220 to include a main housing portion 600, a circular magnet 610 epoxied onto the top of the housing 600 and a cover 620 for retaining the ultrasonic detector, not shown, on the interior of the housing 600. One end of cable 222 is attached to the transducer through a weatherproof grommet 633. An electrical connector 632 is further provided on the end of cable 222 so that the ultrasonic transducer 220 can quickly connect and be disconnected from the LSU 140 by means of a mating electrical coupler 630 located in the upper cover of the housing as shown in FIGS. 3 through 5. The sensor, as shown in FIG. 6, is fixed to the magnet, however, it is to be expressly understood that the mounting between the magnet 610 and the housing 600 could swivel as disclosed in the aforesaid Oilfield Lease reference.

In FIGS. 7 and 8 are set forth the shipping containers which are used to transport and store the LSUs 140 and the TAM 160. The shipping container 700 shown in FIG. 7 has divider-like compartments 710 made from plastic, foam or the like for holding up to ten LSU's in a cushioned and shock absorbing environment. In a typical installation, two cases 700 would be utilized to contain up to twenty LSU's 140. The containers 700 are of conventional construction having high impact resistance plastic exteriors, partitions 710 and an elongated handle 720. A similar type of container 800 is shown in FIG. 8 for carrying the TAM 160 in a shock absorbing environment. Container 800 has a front cover 810 for closing over the front of TAM 160 and a rear cover 820 for closing over the rear of TAM 160. A handle 830 is further provided for carrying the container 800 as well as supporting the TAM 160 as shown in FIG. 8.

For transportation to a new oilfield, the LSUs 140 can be quickly removed from each tank, the sensor cable 222 wrapped around pedestals 340, and the detector 220 stored under the handle 330. The LSUs 140 are then placed in individual compartments 710 in container 700 and the lid 730 closed. Likewise, the TAM 160 can be disconnected from power and cable 150 and lids 820 and 810 closed and the TAM 160 is ready for transportation. Cable segments 230 are connected to each other and are reeled onto the reel carriages 250 (more than one may be required) as well as the elongated cable 150. It can be observed that the system of the present invention is highly portable and can be quickly installed and disassembled at a given oilfield location. Furthermore, because of the modular arrangement of the present invention, the system through its numerous components can adapt to different treatment configurations.

4. System Autoconfiguration

Figure 10:
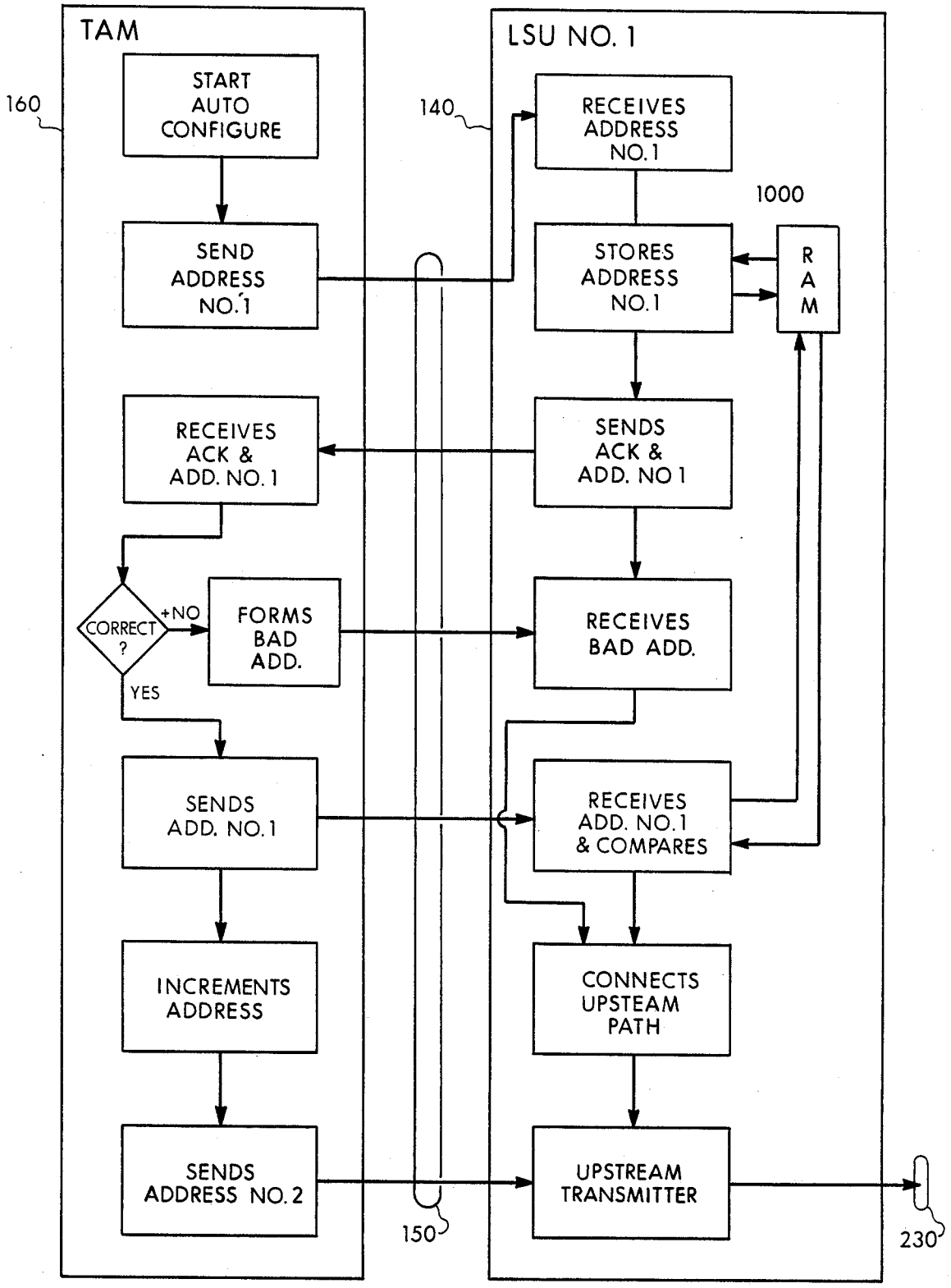
FIG. 10 is a block diagram of the autoconfigure process of the present invention.

In FIGS. 9 and 10, the autoconfiguration process of the present invention is set forth. As discussed, the modular LSUs 140 which are stored in the shipping container at 700 of FIG. 7 can be taken out by the installer and installed in any order on the tanks 10 and 20. It is important, therefore, that no permanently assigned identity code be resident in each LSU 140.

Under the method and process of the present invention, once the LSUs 140 are installed and interconnected to the TAM 160, the TAM 160 enters the autoconfigure mode of operation as shown in FIGS. 9 and 10. TAM 160 sends the first binary address over cable 150 to the first interconnected LSU 140. This LSU becomes power activated (awakened) according to the teachings of the Oilfield Lease reference and receives the first binary address. The first interconnected LSU thereupon stores the first binary address in its random access memory (RAM) 1000 and then transmits an acknowledgement signal (ACK) plus the first binary address back to the TAM 160 over cable 150. TAM 160 receives back the transmitted acknowledgement signal from the first interconnected LSU as well as the first binary address. TAM 160 then compares the received first binary address with the first binary address originally delivered and, if the same, redelivers the first binary address back to the first interconnected LSU which in turn again receives it and if it compares to the address stored in the RAM 1000, the LSU connects a hardware upstream transmission path to the path interconnected LSU. This hardware upstream path will be discussed subsequently but involves the enabling of an upstream transmitter as shown in FIG. 10. In the event of an address mismatch at the TAM, the TAM will form a bad address and deliver it to the first interconnected LSU who will receive it, store it in RAM 1000, mark itself as bad, and then connect the upstream data transmission path as before. TAM 160 then increments the address to the second binary address and sends the second binary address through the connected upstream path of the first interconnected LSU to the next interconnected LSU and repeats the process discussed above for adjacent and interconnected LSU.

The above represents a "double hand shake arrangement" in that the binary address to a given LSU is delivered to the LSU in its resident RAM, stored by the LSU, retransmitted back to the TAM, received and checked by the TAM and again redelivered to the LSU, the LSU receives the redelivered binary address and checks it with the address stored. It is to be expressly understood that this is a preferred approach and that variations of the above could be made.

In this fashion and independent of the order that the LSUs 140 are placed on tanks 10 and 20 by the installer, TAM 160 will always autoconfigure the first interconnected LSU 140 to a first binary address, the second interconnected LSU 140 to the second binary address and so forth until all LSUs receive an identity code in numerical sequence. After autoconfiguration has taken place, TAM 160 can then directly address each LSU based upon its unique identity address stored in its resident RAM 1000.

Therefore, it can be observed that the monitoring system of the present invention can rapidly autoconfigure itself to a predetermined address sequence independent of the order of the installation of the LSUs.

Under the autoconfiguration process of the present invention, and as witnessed in FIGS. 9 and 10, the present invention can be adapted to an environment wherein the transducers 220 can either be any conventional sensor or controller S/C for measuring controlling parameters on oilfield equipment or other types of equipment. For example, and with reference back to FIGS. 1 and 2, the modular LSUs 140 can be attached to other sensing or controlling equipment 220 in the oilfield such as for example to the flow meter 126, the nuclear densiometers 128, and wellhead, casing, and line pressure sensors 122.

5. System Operation

Figure 11:
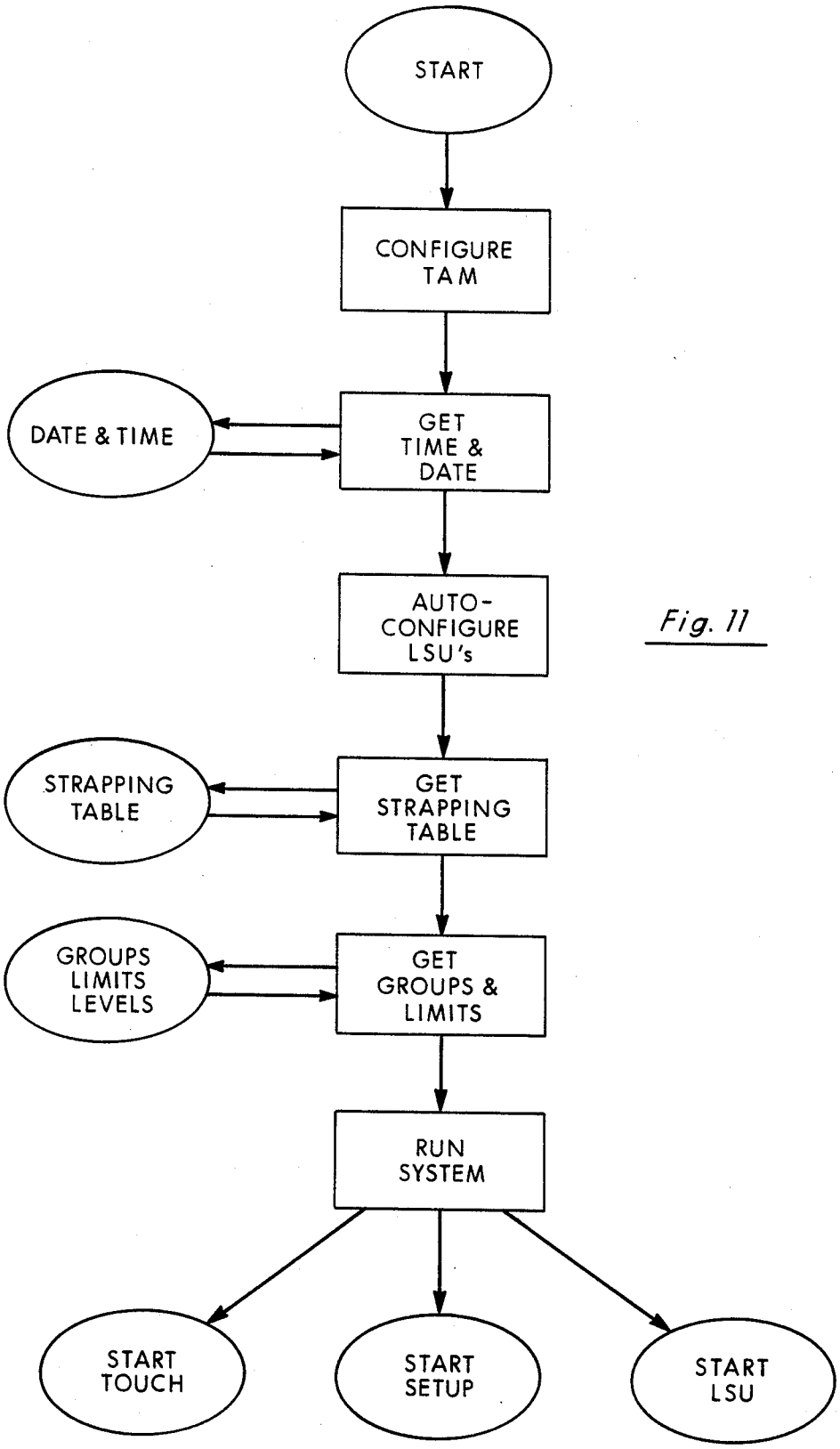
FIG. 11 sets forth the start processing sequence of the present invention.

In FIGS. 11–14, the operational process of the present invention is set forth. In FIG. 2, the TAM 160 is started by activation of switch 161 and as shown in FIG. 11 enters into a first operational step wherein the TAM 160 becomes powered and is configured to be operational. The TAM is initialized by software termed STFRAC (start frac) which is disclosed later.

Once configured, the TAM 160 receives its input and output data through its touch screen 270 as shown in FIG. 2 which has a plurality of defined regions 272 capable of receiving input data by means of the user's touch on the screen. The touch screen and the associated circuitry is conventionally available as Model 1780A from:

John Fluke Manufacturing Co., Inc., P.O. Box C9090, Everett, Wash. 98206

When the system is up, series of communications occurs between the user and the TAM, the more important ones of which are set forth in the following. In order to receive the time and data, TAM 160 prompts the user as follows:

Enter the Current Time & Date

The touch screen 270 then displays a numeric keyboard and the user enters the time and date into the system. The system then inquires:

Have all LSUs been installed and connected to the TAM?

Figure 12:
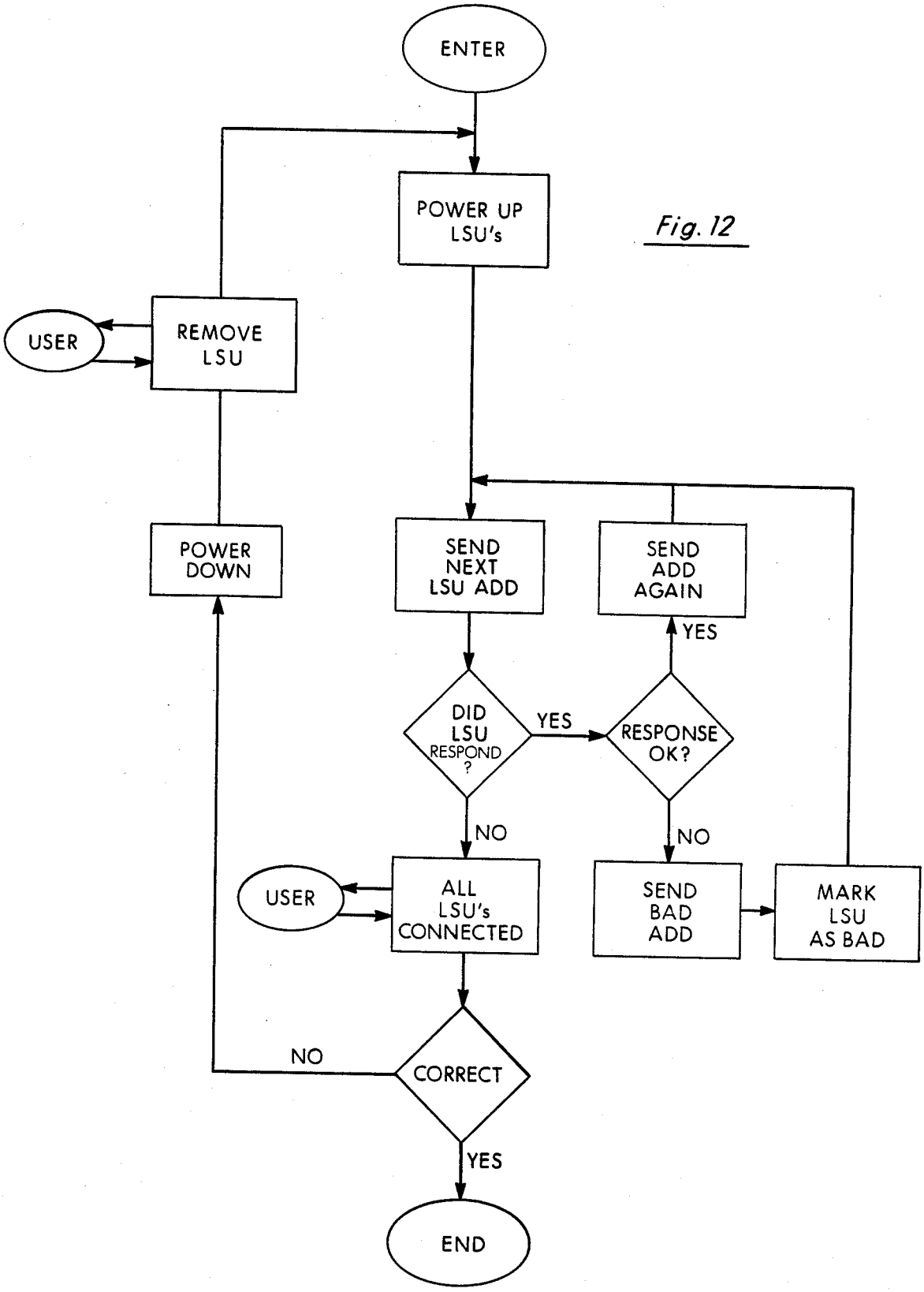
FIG. 12 sets forth the autoconfigure sequence of the present invention.

If so, the system then enters the autoconfigure mode as shown in FIG. 12 and is termed the CONTNK (configure tank) software routine set forth later. The first step, and as previously discussed in the Oilfield Lease Reference is to deliver power to each LSU 140 and each LSU becomes "awakened." With all interconnected LSUs functional, the system is now ready to autoconfigure as priorly discussed in FIGS. 9 and 10. The first binary address, in hexidecimal, which is sent is 01 and this is sent to the first interconnected LSU 140. If the first interconnected LSU 140 responds back to the TAM 160, the TAM sends hexidecimal address 01 once again. The TAM then increments the address to the next address 02 for delivery to the next interconnected LSU.

In the event that the response back from the LSU is bad, the TAM 160 marks that LSU address as inoperative or bad and proceeds to send the incremented address to the next interconnected LSU. When all LSUs 140 are interconnected TAM 160 by means of the touch screen 270 displays the number of LSUs that it has autoconfigured and asks the user the following question:

These are the tanks found during Auto-configure. (displays tanks) Are these correct?

If the answer is correct, the operator presses "yes" and the autoconfiguration sequence ends. If the answer is not correct, the operator presses "no", something is wrong and the TAM powers down the LSUs and puts them in a "sleep" mode and prompts the user to replace the last interconnected LSU. In other words, if only seven LSUs were autoconfigured out of ten that have been physically installed, then LSU 8 is inoperative, the system will interconnect the first seven LSUs and think it is done. However, the user knows that the eighth LSU is inoperative and with the system powered down, can go out in the field and replace the eighth LSU. In addition, if the user presses one of the tank keys on the touch screen 270 corresponding to the identity of the tank, the system will remove that LSU by storing in its memory to ignore the address for that LSU.

In this fashion, and as discussed in FIGS. 9 and 10, the system autoconfigures itself and recognizes inoperative LSUs, LSUs sending back bad addresses, and provides for the option of ignoring interconnected LSUs at the users option. Of course, the identity of each LSU corresponds to the identity of the storage tank.

Returning now to FIG. 11, the TAM 160 will now ascertain the present level of fluid in each tank by asking:

Enter High Gauge (Present Tank Level)

And the user will input this information based on a manually measured reading. The TAM will now, as for example, inquire:

Is the tank about 9 feet?

The TAM takes the present tank level reading and adds it to the height of the tank above the fluid (which it has just measured) and makes this inquiry as a double check and to which the user responds with an affirmative.

TAM 160 now prompts the user for the strapping table information and the user by means of the displayed keyboard inputs the strapping table for each tank. The software responsible for this is TKUTIL (tank utility) and TABLES as will be presented later. The prompt, for example, would be:

Enter the Barrels at 0 Feet, 6 Inches

And the response would be:

bbls 20.8

This interchange would occur at, preferably, one to six inch intervals for the height of the tank. For example, if a particular tank 210 has an LSU 140 having address 02, then that tank's strapping table, at six inch intervals, having been entered would be displayed by the TAM as follows:

| Tank 2: Strapping Table - Is it Correct? | | | |
|---|---|---|---|
| 6 In. | 20.8 | 84 | 316.0 |
| 12 In. | 41.7 | 90 | 340.3 |
| 18 In. | 62.5 | 96 | 364.5 |
| 24 In. | 83.4 | 102 | 388.8 |
| 30 In. | 104.2 | 108 | 412.2 |
| 36 In. | 125.1 | 114 | 432.7 |
| 42 In. | 146.7 | 120 | 450.4 |
| 48 In. | 170.3 | 126 | 465.3 |
| 54 In. | 194.5 | 132 | 477.3 |
| 60 In. | 218.8 | 138 | 486.5 |
| 66 In. | 243.4 | 150 | 499.3 |
| 78 In. | 291.7 | | |

If corrections are required, the TAM 160 will direct the user to:

Make the ARROW point to the Number to Correct

And then corrections can be reentered.

In the event that other tanks have a strapping table identical to the tank just entered (as in the case of tanks 20 in FIG. 1), TAM 160 will inquire:

Select tanks with IDENTICAL Strapping Tables

This simply serves time and the possibility of error when tanks are of identical size and shape.

It is to be noted that each tank in the bank of tanks 10 and 20 of FIG. 1 normally has the strapping table affixed to the side of the tank in one inch increments. In the example, barrels at six inch increments are entered in as shown above although it is to be expressly understood that data based upon the one inch intervals or any other convenient interval could also be entered into TAM 160 under the teachings of the present invention.

After the entry of the strapping table information for all tanks, the TAM 160 prompts the user for the type of fluid and the low limit trip point for each tank. The software for handling this is termed BLDPG (build page) and is presented later. In the preferred embodiment, each tank can be assigned to one of three different types of fluids. The TAM will first inquire:

Enter Alarm Trip Level for ALL Tanks

And the user will respond with the low limit drop point which, for example, in a nine foot tank could be three feet. TAM 160 will then inquire:

Each Tank can belong to one of three GROUPS. Each GROUP is shown with a different type of BAR. The BARS look like: (Examples shown)

Touch when You are ready to Select the Tank Groups

The TAM 160 will then display:

Select the Tanks in Group #1.

The user then selects the tanks in Group 1 and TAM 160 will then sequence through the remaining two groups. After receiving all of the user information pertaining to the time, date, strapping table, groups, and predetermined limits, the system enters the run system mode.

Figures 13, 14, 19:
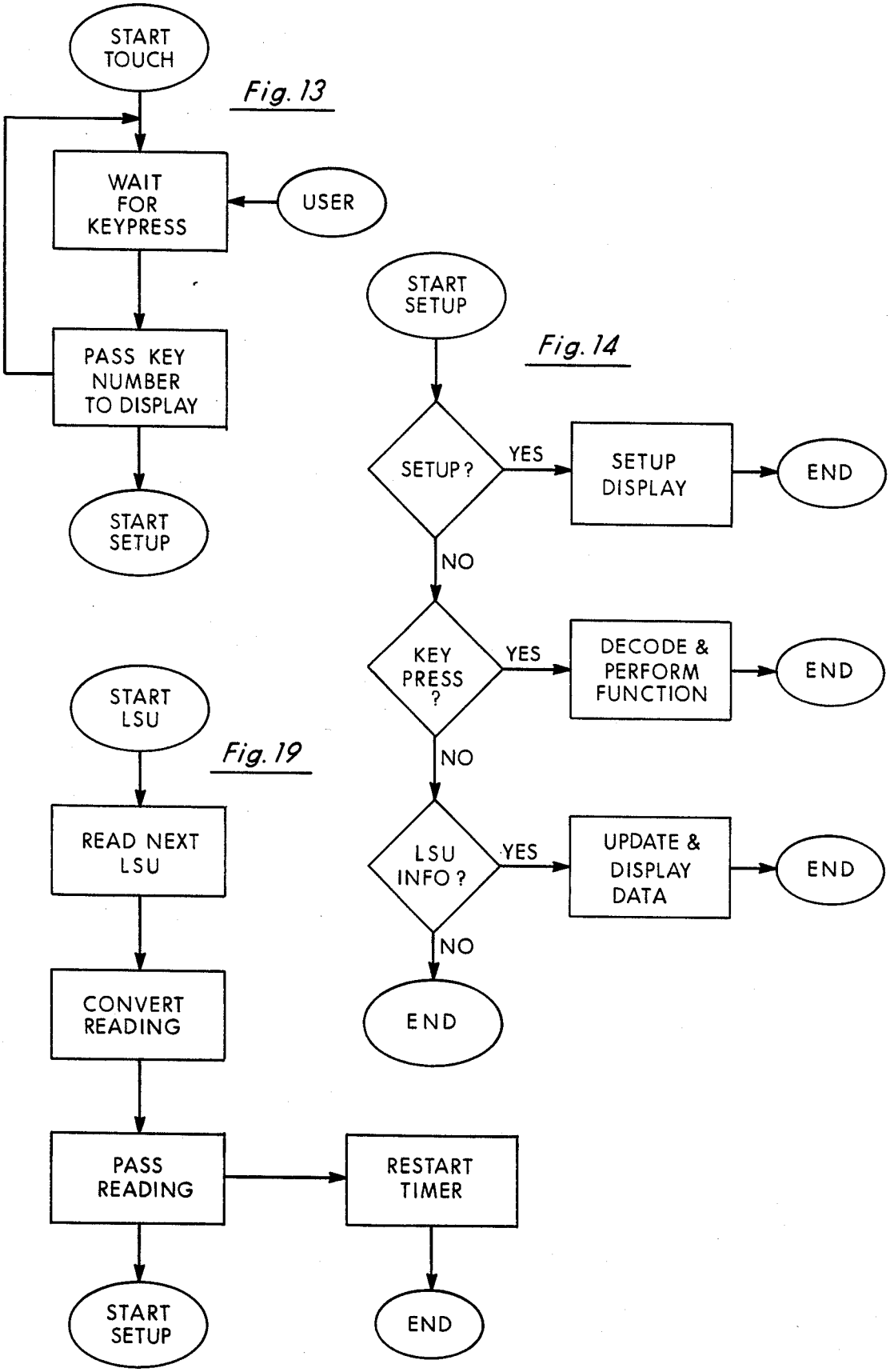
FIG. 13 sets forth the start touch sequence of the present invention.
FIG. 14 sets forth the start setup sequence of the present invention.
FIG. 19 sets forth the start LSU sequence of the present invention.

In FIG. 13, in the "start touch" operational process, which is the higher priority task of the system, the system continues to loop until the user presses any active key on the screen 270. The software for this routine is identified as STTUCH (Start Touch) and is presented later. In the event that a key is pressed on the screen, the system passes the number to a display driver and enters the "start setup" operational process.

In FIG. 14, the operational process for the start setup step which is the lowest priority task of the system is shown wherein TAM 160 ascertains if a setup of the touch screen 270 is required and if so sets it up and ends the routine. If not, it ascertains whether or not a key has been pressed and if so, decodes which key has been pressed and performs the function corresponding to that key. These keys and funtions are set forth in FIG. 15. If no key has been pressed, the system inquires as to whether or not there is new LSU information and if so updates this LSU information and displays the data. The software for the start setup is termed STFLUK and is presented later.

Figure 15:
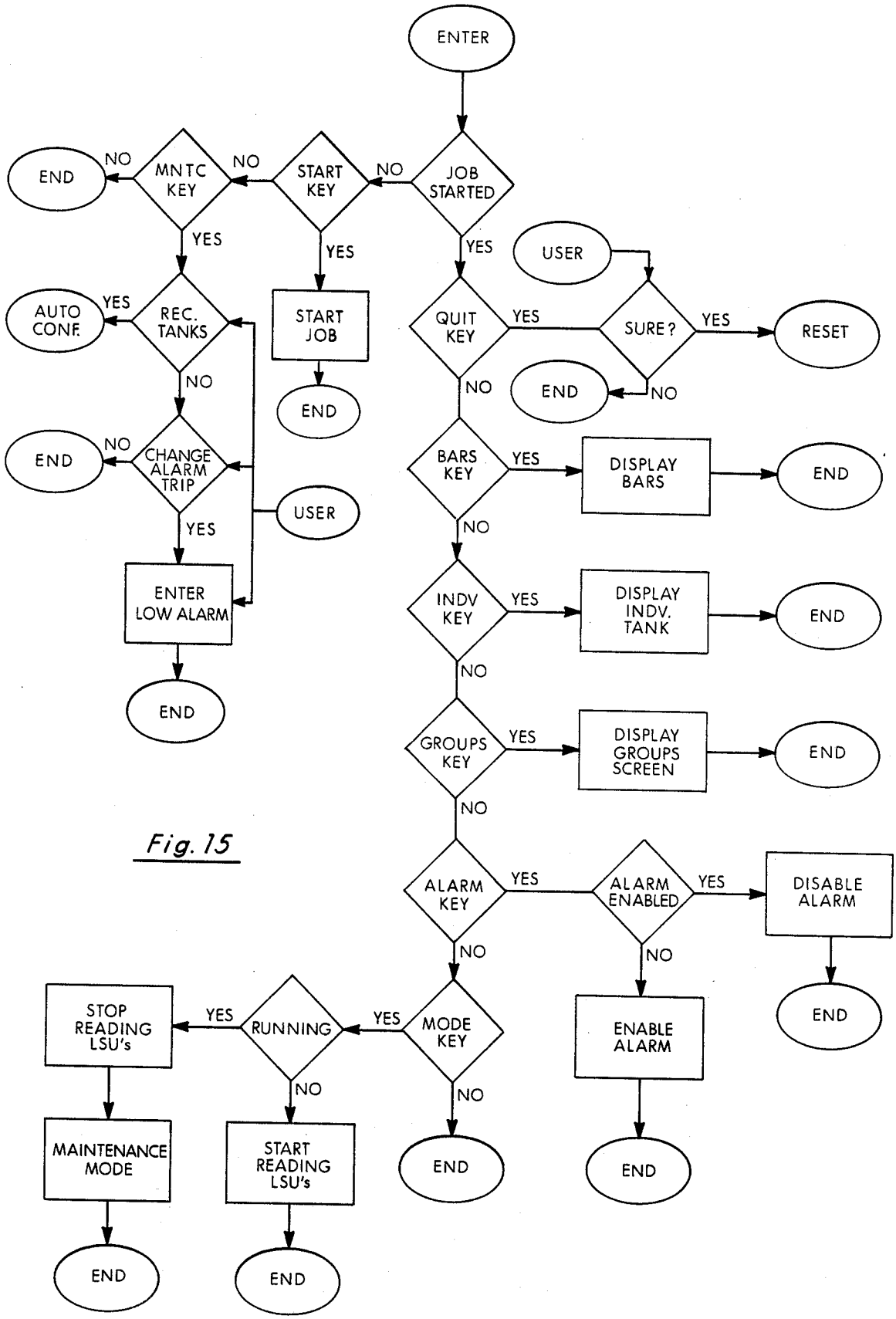
FIG. 15 sets forth the key function sequence of the present invention.

In FIG. 15, the operational sequences for the key functions are set forth and the associated software is contained within STFLK. Upon entering this sequence, the appearance of the start and maintenance keys on the touch screen 270 indicates that the frac job is ready but not yet started. If the start key has not been activated the system determines whether the maintenance key (MNTC) has been pushed, if not the sequence ends. If so, the system inquires of the user if it would like to reconfigure the tanks. If the response is affirmative, then autoconfiguration of the tanks will occur as previously discussed. If negative, the system asks if the user wants to change the alarm trip points. If the user does, he enters the new alarm trip points and if not the sequence ends. The display for the TAM would then show:

| | | | |
|---|---|---|---|
| 1 | 10′ 7″ | | START |
| 0:0 | I:468 | . . . | |
| Rate: | 0.0 | | MNTC |

The example above only shows data for tank 1 and this data would include the current level of fluid (i.e., 10′7″) and the amount in storage (i.e., 468 barrels). The rate of flow and the barrels delivered out of the tank (since pumping has not started) is zero. Comparable data for each tank is shown on the screen.

If the start switch has been activated, the job is started. Starting the frac job consists of displaying new action keys and "locking" the current volume in each tank as its respective "maximum volume" which is later used to calculate volume delivered. If the job has been started, the sequence analyzes each of the keys in turn to see which has been activated. If the QUIT key has been activated, the touch screen displays a question such as "are you sure you want to quit." If so, the TAM 160 is reset. The reset software is termed FRSTRT (frac start) and is presented later. It is important to note that the double check as to whether or not the QUIT key has been activated is necessary to prevent an accidental hitting of the QUIT key since, upon resetting, all the prior information relating to the setting of the groups and the limits is all erased. However, the strapping table for each tank is retained.

The setup Display routine of FIG. 14 displays the "BARS" graph display showing all of the tanks and their current levels when the job is first started and any time the "BARS" key is pressed. In FIG. 16, the touch screen 270 is shown displaying the bars for all of the individual tanks which in this case is twenty tanks. The bar graph also conveniently shows the nature of the liquid in each of the tanks by a system of dots, solid, and bars. The relative percent full is shown on a vertical scale and, therefore, irregardless of a tank's capacity all bars will be of equal height when filled (i.e., 100% full). This bar display also shows the minutes until empty for each of the tanks which is an important parameter for the treater to follow. Although, not shown, in FIGS. 16 through 18, the following information is also displayed:

TIME: 14:43:39
ELAPSED: 00:07:54
START: 14:35:45

This indicates the start time, the current time, and the elapsed time since the start of the job.

The keys 272 are reconfigured for each different display in the following fashion. For example, if the GROUPS key is activated in FIG. 16, then the display, as shown in FIG. 17, will be presented showing the following keys 272:

BARS
INDV
ALARM
MODE
(MNTC)
QUIT

The maintenance key MNTC is normally not shown and hence is shown in dotted lines. It is only shown when the MODE key is pressed. Each tank, as mentioned, can be assigned to one of three groups and the display summarizes this information for each group. The type of liquid content is then set forth. This display also shows the total group flow rate, the total group pumped volume and the number of tanks in each group. It is to be understood that the total volume pumped for all three groups could be displayed if desired on the three displays of FIGS. 16 through 19.

When the individual key (INDV) is activated, the fluid height in each tank is numerically displayed as well as, the barrels pumped out, the barrels remaining, and the flow rate in barrels per minute. A representative display showing this information is shown in FIG. 18. For example and as shown in FIG. 18, Tank 1, for example, has a fluid level of 7′ 6″, 348 barrels remaining in the tank (I:), 120 barrels delivered out of the tank (0:), and a flow rate of 10 barrels per minute.

An alarm occurs when the level of fluid in a tank actually drops below the predetermined low point value. It is to be expressly understood that each tank can have a different predetermined level which will activate the alarm. When the level drops below the set value, an internal audible alarm is activated as well as a visual indication will start flashing on and off. In FIG. 16, the visual indication is the flashing of the lower portion of the bar display for that tank; in FIG. 17, it is the group number that flashes; and in FIG. 18, it is the tank number that flashes. Hence, when the alarm key is enabled, the audible alarm is silenced.

Returning back to FIG. 15 when the mode key is activated, the system determines whether or not it is running. If it is not, it erases the maintenance (MNTC) key and starts reading the LSUs. If it is running, it stops reading the LSUs 140 and displays the maintenance key.

Whenever the system is STOPPED by use of the MODE key, the maintenance key is visible and active. It is important to note that power is always supplied to the LSUs except during LSU maintenance/reconfiguration. In the maintenance mode, as discussed as LSU can be replaced, the system reconfigured, and new trip levels added. Hence, in the maintenance mode, power to all the LSUs is turned off so that the installer can go to the particular defective LSU and repair or replace it. Once repaired, the system is brought back up and continues to run.

In FIG. 19, the final sequencing operation of the system termed STNODE (start node) software relates to the reading of each LSU 140. This sequence is middle in priority and an entry point occurs every time a one-half second, in the preferred embodiment, timer times out. It will then read the next LSU and convert that reading to an actual level and volume value and pass that reading to the display driver sequence in the start setup routine of FIG. 14. When done, the timer will restart itself.

The above represents the preferred operation of the system especially as it autoconfigures itself, obtains information from the user, and sequences on a step-by-step basis. It is to be expressly understood that variations could be made to the system operation as presented and still be under the teachings of the present invention.

6. System Hardware

Figure 20:
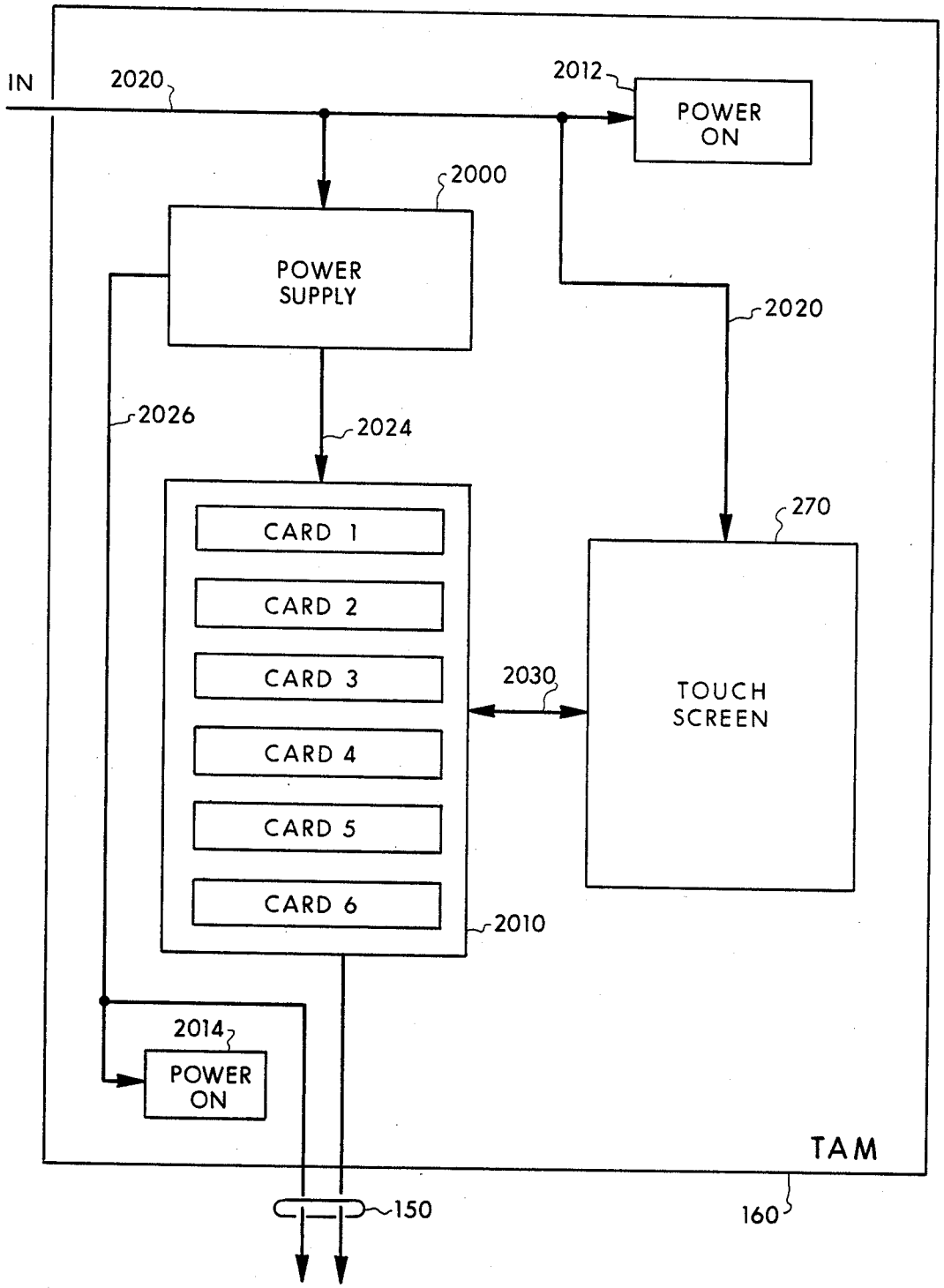
FIG. 20 is a block diagram representation of the circuitry contained in the TAM of the present invention.

The circuit diagram for the hardware resident in the TAM 160 is detailed in FIG. 20 and includes a regulated power supply 2000, a touch screen 270, a card cage 2010, and indicators 2012 and 2014.

The AC line power supply is connected to AC line power over lines 2020. A visual indicator 2012 is provided to show when power is on. Lines 2020 are further connected to touch screen 270 providing AC power to that device. The power supply 2000 is connected over to the card cage power supply over lines 2024. The regulated output provides control and power to the card cage 2010 which contains its own power supply. Powwer is also delivered over lines 2026 to the LSU bus 150 and to a loop power visual indicator 2014. The two power supplies are conventionally available from:

Card Cage Power Supply: Power General Corporation, 152 Well Drive, Canton, Mass. 02021, Part No. 127-CM LSU Power Supply 2000: Power Mate Corporation, 514 S. River Street, Hackensack, N.J. 07601, Part No. ES24H The touch screen as previously mentioned is available from John Fluke Manufacturing Co. Inc. and is connected over bus 2030 to card #3 in the card cage 2010. The card cage 2010 contains five commercially available electronic cards, these cards are all conventionally available from National Semiconductor Corporation, 2900 Semiconductor Drive, Santa Clara, Calif. 95051.

Card 1:

Power Supply Card No. CIM-610, (Power supply and regulation for computer cards in cage 2010)

Card 2:

Serial I/O Card, Part No. CIM-201, (Wired as DTE (Date Terminal Equipment) for communications to LSUs)

Card 3:

Serial I/O Card, Part No. CIM-201, (Wired as DCE (Data Communication Equipment) for communication with TAM display)

Card 4:

CPU Card, Part No. CIM-802A, (800 CPU modified for offboard ROM)

Card 5:

Memory Card, Part No. CMX-300, Citadel Computer Corporation, 2 Paul's Way, Amherst, N.H. 03031, (Gives machine instruction PROM and data RAM for TAM operation)

Figure 24:
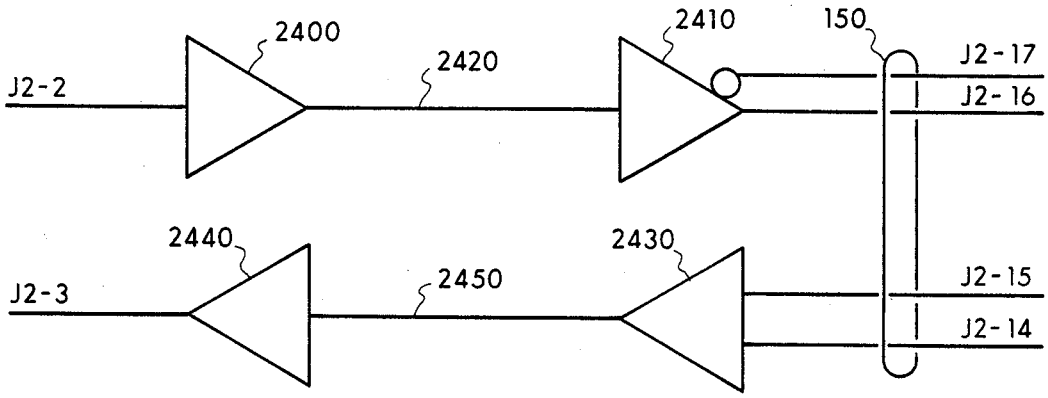
FIG. 24 is the circuit diagram of Card 6 of FIG. 20.

The circuitry contained on Card 6 is detailed in FIG. 24 and contains an RS 422 to RS 232 communications converters. The conversion is necessary to provide sufficient strength to the signals for transmission over lines 150. The RS 232 to TTL receiver 2400 is connected over pin J2-2 via ribbon cable to the corresponding pin of Card 2 which is the serial I/O communications and Circuit 2400 is commercially available from National Semiconductor Corporation as Model No. DS 1489. Receiver 2400 interconnects with transmitter 2410 over lines 2420 whcih is a TTL to RS 422 transmitter commercially available as Model No. DS 26LS31. The output of transmitter 2410 is delivered to the first interconnected LSU over cable 150. Likewise, the signals from the first interconnected LSU are delivered over cable 150 into a RS 422 to TTL receiver (Model No. DS26LS32) 2430 which, in turn, is connected to a TTL to RS 232 transmitter (Model No. DS 1488) 2440 over line 2450. The transmitters 2410 and 2440 and the receivers 2400 and 2430 are conventionally connected to power and ground.

The above six cards plug into a National Semiconductor Corporation card rack Part No. CIM-602 CIM-BUS card carrier and interconnection board as per National Semiconductor Corporations defined CIM-BUS standard. The backplane wiring is fixed per this standard.

In essence, TAM 160 from an operations viewpoint is similar to the operation of the monitoring system 50 of the aforesaid Oilfield Lease reference.

Figure 21:
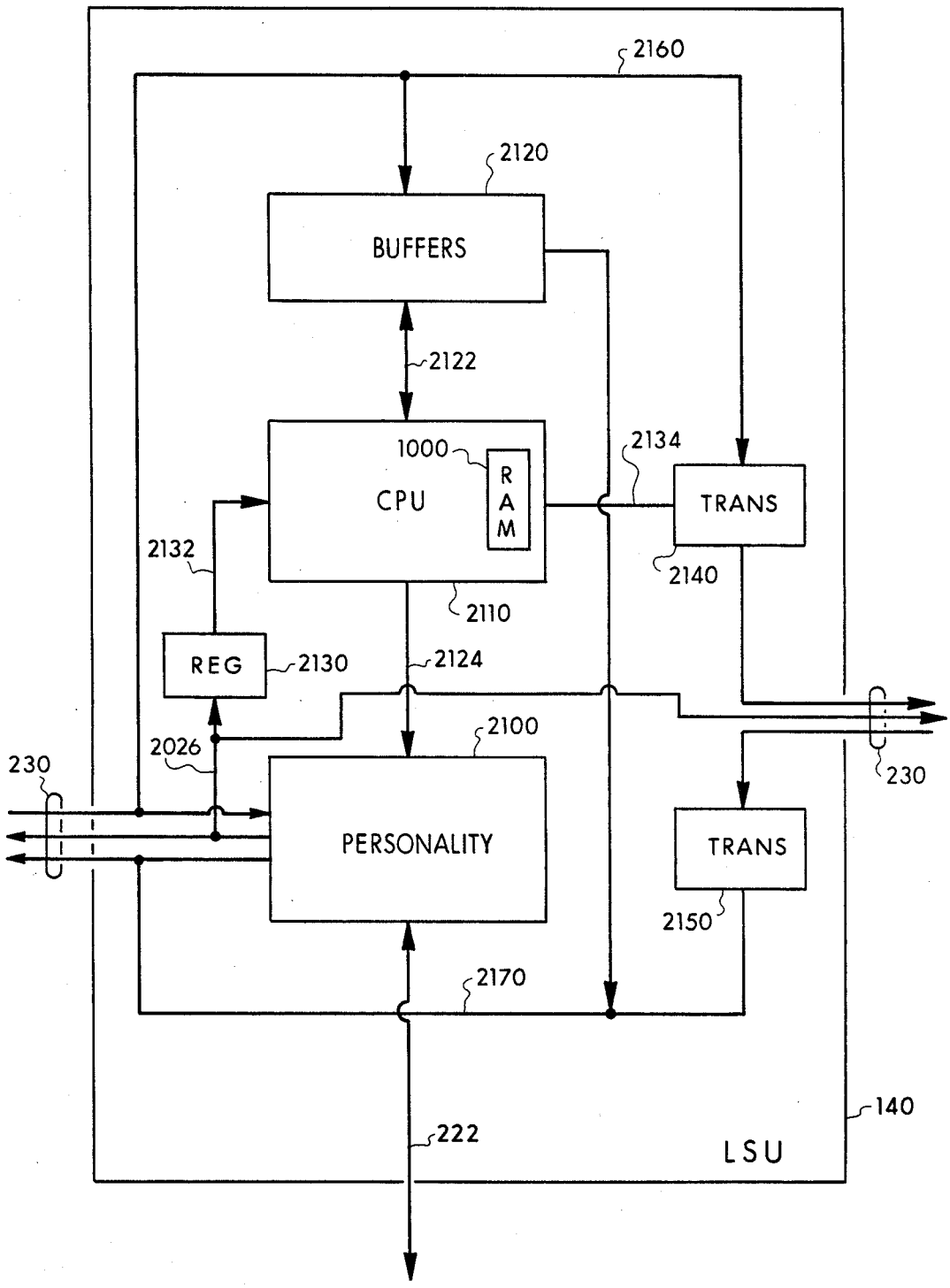
FIG. 21 is a circuit diagram of the components contained in the LSU of the present invention.
Figure 22:
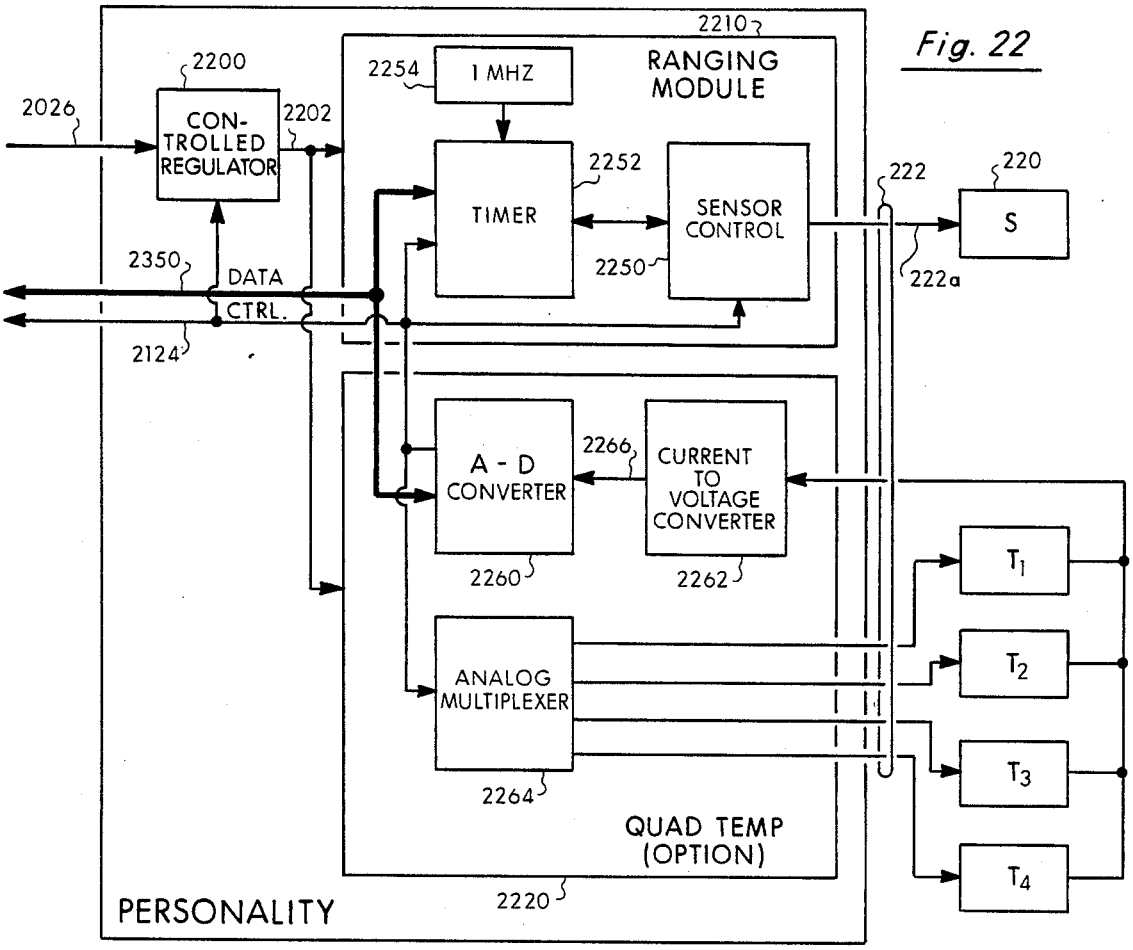
FIG. 22 is a circuit diagram of the personality board of the present invention.
Figure 23:
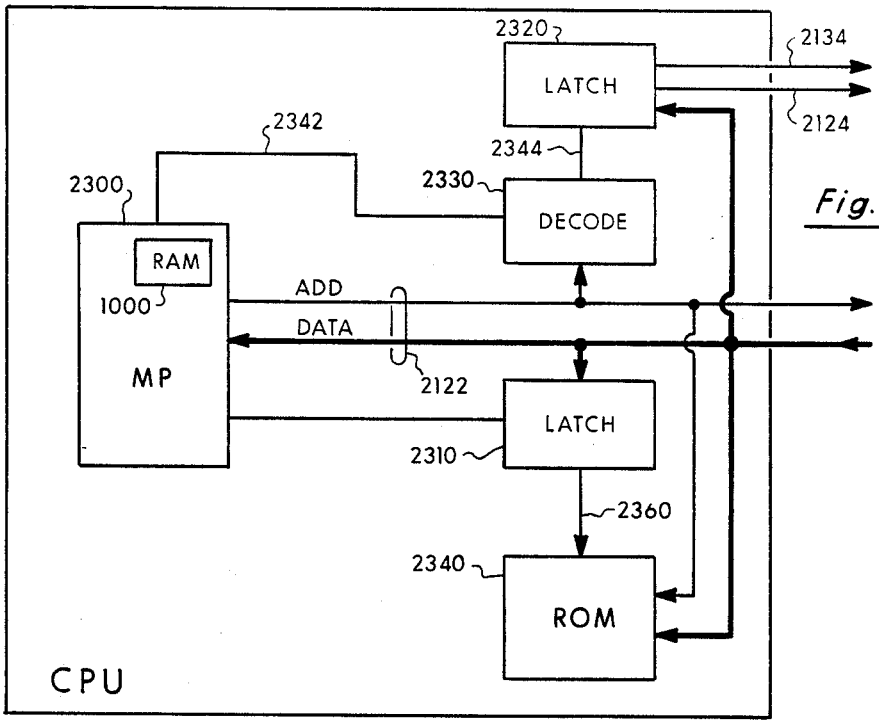
FIG. 23 is a circuit diagram of the CPU board of the present invention.

The circuit diagrams for the hardware resident in the LSU 140 is set forth in FIGS. 21 through 23 and as shown in FIG. 21 includes a personality circuit 2100, a CPU circuit 2110, buffers 2120, a regulator 2130, a receiving transceiver 2140 and a sending transceiver 2150.

The cable 230 carries power on lines 2026, a receiving bus on lines 2160, and a sending bus 2170. Power on lines 2026 is delivered to regulator 2130 which is a UPC 7805H and is conventionally available from:

NEC, 252 Humbolt Court, Sunnyvale, CA 94086

The regulator 2130 always supplies power to the CPU circuit 2110.

The personality circuit 2100 functions to communicate over cable 222 with the ultrasonic sensor 220 and receives tank level (and, optionally, tank temperature) measurements as priorly discussed.

The CPU circuit 2110 contains the internal RAM 1000 which stores the identity address for each LSU 140 based on the aforesaid autoconfigure mode of operation and functions to provide internal control over bus 2124 to the personality circuit 2100 and is in communication with the transmitters 2140 and 2150, over buses 2160 and 2170 and with the TAM 160.

The buffers 2120 function to buffer data between the buses 2160 and 2170 and the CPU circuit 2110 and are conventionally available from National Semiconductor Corporation as Part No. SN74 LS373.

The transmitters 2140 and 2150 are also conventionally available from National Semiconductor Corporation as Part Nos. SN26 LS33A-Receiver, and DS3487-Driver.

In FIG. 22, the personality circuit 2100 is shown to include a controlled regulator 2200 which receives power from the loop over lines 2026, a ranging module 2210 which receives regulated power over lines 2202, and an optional quad temp module 2220 which also receives power over lines 2202. The regulator is conventional and is capable of operating from a voltage range of 8 to 24 volts DC appearing on lines 2026 to output a regulated 5 VDC only upon an enable signal appearing on controls 2124 from the CPU circuit 2110. Hence, when not enabled the ranging module 2210 and the optional quad temp module 2220 are not powered (i.e., "asleep"). However, when enabled the regulator 2200 delivers power over lines 2202 to these circuits (i.e., "awakened"). As explained in the earlier filed Oilfield Lease reference, such an arrangement saves on power consumption.

The ranging module 2210 and the quad temperature module 2220 function as those taught in the Oilfield Lease reference and disclosed in FIGS. 15 and 16 thereof. The ranging module 2210 includes a sensor control 2250, a timer 2252, and a one MegaHertz clock 2254. In the preferred embodiment, the sensor control 2250 is an ultrasonic control circuit made by Texas Insrument Co., PO Box 5012, Dallas, Tex. 75222 as Model T1-Board SN28827 and the timer 2252 is available as D8253 from National Semiconductor. The ranging module functions as follows. A signal is delivered over control lines 2124 from the CPU circuit 2110 to cause the sensor control 2250 to activate the sensor 220 to emit an ultrasonic pulse. The sensor 220 is available from the POLAROID Corporation, 784 Memorial Drive, Cambridge, Mass. 02139. When an echo is received by the sensor 220, the time between emission and receipt is measured through the cooperation of clock 2254 and timer 2252. An interrupt signal is delivered back to the CPU circuit over control lines 2124 and the CPU circuit determines the level of fluid based upon elapsed time.

The quad temperature module 2220 is optional but includes an analog to digital converter 2260, a current to voltage converter 2262, and an analog multiplexer 2264. The quad temperature circuit 2220 interconnects with four temperature probes T1, T2, T3, and T4. These temperature probes are conventional and are available through National Semiconductor Corporation as Model No. AD590. Each temperature sensor increases the current through it one microamp per one degree centigrade rise in temperature. The analog multiplexer which is conventionally available as Part No. MC14016B and is available from MOTOROLA Semiconductor, PO Box 20912, Phoenix, Ariz. 85036 selects which one of the four temperature probes are to be measured and that selection is made based upon digital signals appearing on the control line 2124 from the CPU circuit. The analog multiplexer 2264 functions to provide a twelve volt signal to each of the temperature probes T1-T4. Based upon the temperature of the probe, a current is delivered back over lines 222 to the current to voltage converter which converts the current to a voltage signal for delivery to the analog to digital converter 2260 over lines 2266 for delivery back to the CPU circuit 2110.

FIG. 23 discloses the details of the CPU board 2110 and includes a microprocessor 2300, two latch circuits 2310 and 2320, a decode chip 2330 and a Read Only Memory 2340 all of which receive regulated power from regulator 2130 over lines 2132. The microprocessor 2300 is interconnected over serial communication lines 2122 to buffers 2120. The Data Bus accesses latch 2310 which is connected to ROM 2340 over bus 2360. The ROM 2340 is also connected to both the address and data busses. The latch 2310 is under control of the microprocessor chip 2300 and serves to address the ROM 2340. The decode circuit 2330 is connected to the address bus and under control of signals on lines 2342 decodes certain address into control signals on lines 2344 which are retained in a latch circuit for delivery to the personality circuit 2100 over lines 2124 and to the transmitter 2150 over lines 2134. The microprocessor is conventionally available as:

Model Nos. 80C31 or 8031, Intel Corporation, 3065 Bowers Avenue, Santa Clara, Calif. 95051

The latch circuits 2310 and 2320 are available from National Semiconductor Corporation as Model No. SN74 LS374. The ROM 2340 is also available from National Semiconductor Corporation as Model No. 27C16. Finally, the decode circuit 2330 is available from National Semiconductor Company as SN74LS138.

The connection of the upstream data path discussed in reference to FIG. 10 occurs as follows. When the microprocessor receives the redelivered binary address back from the TAM 160, it compares the redelivered address to the address stored in RAM 1000 which is resident in the microprocessor 2300. If the redelivered address is identical to the stored address, then a control signal is issued on lines 2134 to the sending transmitter 2140. This control signal enables the sending transmitter 2140 to operate thereby establishing the upstream data transmission path.

It is to be expressly understood that the above sets forth a preferred hardware embodiment and that changes could be made thereto without departing from the scope and coverage of the present invention.

7. System Software

Attached to the appendix of this application is the source code programming for the programming contained in the central touch activated monitor TAM 160. The source code presented is based on the "C" source standard programming language found, as for example, in the book entitled "The C Programming Language" by Kernighan and Ritchie of Bell Telephone Laboratories and published by Prentice Hall (1978). This programming is found in Card 5, the memory card of the TAM and is contained in a programmable read only memory (PROM). The assembler for this source code can be any commercially available 8080/Z80 assembler such as that available from Microsoft, 10700 Northup Way, Belleview, Wash. 98004. The following modules are contained in alphabetical order in the appendix.

The build page module (BLDPG) contains the global definitions for the offsets into the various group structures according to C source and provides the utility routines for assigning tanks 10 and 20 to one of three groups (i.e., types of fluids).

The block move module (BLKMOV) is a utility program designed to move blocks of data within the memory in Card 5 of the TAM.

The interface software (CAMXLB) provides the necessary software interface between the C source code and the AMX operating system. In the preferred embodiment, the AMX operating system is conventionally available from Kadak Products Ltd., 206-1847 West Broadway Avenue, Vancouver, British Columbia VSJ 1Y5.

The configure tank routine (CONTNK) provides the utility routine that performs the aforesaid autoconfiguration of the various local sensing units.

The input/output routines interfacing the TAM display to the system is provided by the FLUKEIO routine. The utility routine for outputting and formatting data and information for the TAM display is set forth in the FLUTIL module. The utility routine for communication by the TAM with the LSUs is set forth through the NODEIO module which utilizes the terminal handler through the aforesaid AMX software.

The STFLUK module is the main source module which implements the major functions in the "start setup" flow chart.

The STFRAC module is the main source module which performs initialization of the TAM system including the strapping tables and the like.

The STNODE module is the main module that performs polling of the local sensing units, converts new data into systems and into useful information.

The STTUCH module is the main software module that peforms the "start touch" key input scanning as previously discussed.

The TKUTIL module is a utility routine to manipulate tank setup data such as strapping tables.

The FRSTRT module is the main software module executable at the time of system reset and, therefore, initializes system hardware to the proper state.

The FRACTH module is the software module for the TAM display and for the local sensing unit communications interface routines which operates the interface IO drivers.

The TABLES module is a software module necessary for the data area for storage of tank and local sensing unit tables.

Finally, the UTIL 32 module is the software interface routine from the "C" source programs to the AMX 32 bit math package.

The program listings contained in the appendix to this application are protected by Federal Copyright Law.

The program listings for the operation of the Processor 2110 in the local sensing unit, in Intel Corporation machine code (IS1SII MCS-51), is set forth in the Appendix and follows the UTIL 32 software priorly discussed. Eighteen input modules are provided with a link map setting forth how they are linked together. The operation of this software has been priorly discussed.

While the present invention has been described with reference to a preferred embodiment, it is to be expressly understood that modifications could be made thereto which would still be covered by the following claims. In particular, the preferred embodiment made reference to a system adaptable to a frac or well treatment arrangement. It is to be expressly understood that the teachings of the present invention could be adapted to environments requiring a portable system for the continuous monitoring of fluids in tanks. Furthermore, the system can be adapted to include recording capabilities at the TAM so that a permanent record can be made of the well treatment. This record can serve as proof as to the types and quantities of fluids that were delivered downhole and could further be used as the simulation data for training purposes.

```
 1: B:
 2: ERA FRAC.HEX
 3: ERA FRTST.HEX
 4: ERA BLDPG.BAK
 5: A:CPRE -$1 BLDPG.C1 BLDPG.C
 6: A:CMAC -CR$1 BLDPG.C2 BLDPG.C1
 7: ERA BLDPG.C1
 8: A:COPT BLDPG.MAC BLDPG.C2
 9: ERA BLDPG.C2
10: A:M80 ,$2=BLDPG/R
11: ERA BLDPG.MAC
12: ERA BLKMOV.BAK
13: A:CPRE -$1 BLKMOV.C1 BLKMOV.C
14: A:CMAC -CR$1 BLKMOV.C2 BLKMOV.C1
15: ERA BLKMOV.C1
16: A:COPT BLKMOV.MAC BLKMOV.C2
17: ERA BLKMOV.C2
18: A:M80 ,$2=BLKMOV/R
19: ERA BLKMOV.MAC
20: ERA CAMXLB.BAK
21: A:CPRE -$1 CAMXLB.C1 CAMXLB.C
22: A:CMAC -CR$1 CAMXLB.C2 CAMXLB.C1
23: ERA CAMXLB.C1
24: A:COPT CAMXLB.MAC CAMXLB.C2
25: ERA CAMXLB.C2
26: A:M80 ,$2=CAMXLB/R
27: ERA CAMXLB.MAC
28: ERA CONTNK.BAK
29: A:CPRE -$1 CONTNK.C1 CONTNK.C
30: A:CMAC -CR$1 CONTNK.C2 CONTNK.C1
31: ERA CONTNK.C1
32: A:COPT CONTNK.MAC CONTNK.C2
33: ERA CONTNK.C2
34: A:M80 ,$2=CONTNK/R
35: ERA CONTNK.MAC
36: ERA FLUKEIO.BAK
37: A:CPRE -$1 FLUKEIO.C1 FLUKEIO.C
38: A:CMAC -CR$1 FLUKEIO.C2 FLUKEIO.C1
39: ERA FLUKEIO.C1
40: A:COPT FLUKEIO.MAC FLUKEIO.C2
41: ERA FLUKEIO.C2
42: A:M80 ,$2=FLUKEIO/R
43: ERA FLUKEIO.MAC
44: A:
45: @ B:BUILD2 $1 $2
```

```
 1: B:
 2: ERA FLUTIL.BAK
 3: A:CPRE -$1 FLUTIL.C1 FLUTIL.C
 4: A:CMAC -CR$1 FLUTIL.C2 FLUTIL.C1
 5: ERA FLUTIL.C1
 6: A:COPT FLUTIL.MAC FLUTIL.C2
 7: ERA FLUTIL.C2
 8: A:M80 ,$2=FLUTIL/R
 9: ERA FLUTIL.MAC
10: ERA GTSPEC.BAK
11: A:CPRE -$1 GTSPEC.C1 GTSPEC.C
12: A:CMAC -CR$1 GTSPEC.C2 GTSPEC.C1
13: ERA GTSPEC.C1
14: A:COPT GTSPEC.MAC GTSPEC.C2
15: ERA GTSPEC.C2
16: A:M80 ,$2=GTSPEC/R
17: ERA GTSPEC.MAC
18: ERA NODEIO.BAK
19: A:CPRE -$1 NODEIO.C1 NODEIO.C
20: A:CMAC -CR$1 NODEIO.C2 NODEIO.C1
21: ERA NODEIO.C1
22: A:COPT NODEIO.MAC NODEIO.C2
23: ERA NODEIO.C2
24: A:M80 ,$2=NODEIO/R
25: ERA NODEIO.MAC
26: ERA STFLUK.BAK
27: A:CPRE -$1 STFLUK.C1 STFLUK.C
28: A:CMAC -CR$1 STFLUK.C2 STFLUK.C1
29: ERA STFLUK.C1
30: A:COPT STFLUK.MAC STFLUK.C2
31: ERA STFLUK.C2
32: A:M80 ,$2=STFLUK/R
33: ERA STFLUK.MAC
34: ERA STFRAC.BAK
35: A:CPRE -$1 STFRAC.C1 STFRAC.C
36: A:CMAC -CR$1 STFRAC.C2 STFRAC.C1
37: ERA STFRAC.C1
38: A:COPT STFRAC.MAC STFRAC.C2
39: ERA STFRAC.C2
40: A:M80 ,$2=STFRAC/R
41: ERA STFRAC.MAC
42: ERA STNODE.BAK
43: A:CPRE -$1 STNODE.C1,STNODE.C
44: A:CMAC -CR$1 STNODE.C2 STNODE.C1
45: ERA STNODE.C1
46: A:COPT STNODE.MAC STNODE.C2
47: ERA STNODE.C2
48: A:M80 ,$2=STNODE/R
49: ERA STNODE.MAC
```

```
50: A:
51: @ B:BUILD3 $1 $2
```

```
 1: B:
 2: ERA STTUCH.BAK
 3: A:CPRE -$1 STTUCH.C1 STTUCH.C
 4: A:CMAC -CR$1 STTUCH.C2 STTUCH.C1
 5: ERA STTUCH.C1
 6: A:COPT STTUCH.MAC STTUCH.C2
 7: ERA STTUCH.C2
 8: A:M80 ,$2=STTUCH/R
 9: ERA STTUCH.MAC
10: ERA TKUTIL.BAK
11: A:CPRE -$1 TKUTIL.C1 TKUTIL.C
12: A:CMAC -CR$1 TKUTIL.C2 TKUTIL.C1
13: ERA TKUTIL.C1
14: A:COPT TKUTIL.MAC TKUTIL.C2
15: ERA TKUTIL.C2
16: A:M80 ,$2=TKUTIL/R
17: ERA TKUTIL.MAC
18: ERA UTIL.BAK
19: A:CPRE -$1 UTIL.C1 UTIL.C
20: A:CMAC -CR$1 UTIL.C2 UTIL.C1
21: ERA UTIL.C1
22: A:COPT UTIL.MAC UTIL.C2
23: ERA UTIL.C2
24: A:M80 ,$2=UTIL/R
25: ERA UTIL.MAC
26: A:
27: @ B:BUILD4 $1 $2
```

```
1: B:
2: A:M80 ,$2=FRACAM/R
3: A:M80 ,$2=FRACROM/R
4: A:M80 ,$2=FRACSTRT/R
5: A:M80 ,$2=FRACTH/R
6: A:M80 ,$2=TABLES/R
7: A:M80 ,$2=UTIL32/R
8: A:
9: @ B:BUILDF
```

```
1: B:
2: ERA LBSEG?.REL
3: A:LIB80 LBSEG1=FRACAM,A:AMZ755X,A:AMZTD755,A:AMZTH755,UTIL32,A:AAMPX759/E
4: A:LIB80 LBSEG2=TABLES,CAMXLB,FLUKEIO,FRACTH,UTIL,NODEIO/E
5: A:LIB80 LBSEG3=FLUTIL,GTSPEC,TKUTIL,BLDPG,CONTNK,BLKMOV/E
6: ERA TSTLIB.BAK
7: REN TSTLIB.BAK=TSTLIB.REL
8: A:LIB80 TSTLIB=LBSEG1,LBSEG2,LBSEG3/E
9: ERA LBSEG?.REL
```

```
Line          Statement

              /* */

              #Include <GROUPS.DEF>
        +
        +     /* Global Definitions for Offsets into Group Structures */
        +
        +     #define GMXVOL 0                /* Integer - Group Maximum Volume */
        +     #define GCRVOL 2                /* Integer - Group Current Volume */
        +     #define GFRATE 4                /* Integer - Group Flow Rate in BPM */
        +     #define GNTANKS 6               /* Char    - Number of Tanks in Group */
        +
        +     #define ELSIZE 7                /* Size in bytes of one element in Group Table */
        +     #define GRPSIZE 21              /* Size in bytes of Group Table */
        +
 1      +     extern char grpnod[];
 2      +     extern char tnktyp[];

 3            bldpg(sysmap)
 4                  char sysmap[];
 5                  {

 6                  int chrtyp,i,j,k;
 7                  char s[35],t[20],selmap[20];

 8                  blkmov(sysmap,t,20);
 9                  grpnod[0]=grpnod[1]=grpnod[2]=0;

10                  for (chrtyp=0; chrtyp<2; ++chrtyp)
11                          {
12                          strcpy(s,"Select the Tanks in Group #x");
13                          s[27]=chrtyp+'1';
14                          for (i=0; i<20; selmap[i++]=0);
15                          seltnk(s,selmap,t);
16                          for (i=j=k=0; i<20; i++)
17                                  {
18                                  if (selmap[i])
19                                          {
20                                          tnktyp[i]=chrtyp;
21                                          t[i]=0;
22                                          k++;
23                                          }
24                                  if (t[i]) j++;
25                                  }
26                          grpnod[chrtyp*ELSIZE+GNTANKS]=k;
27                          if (!j) break;
28                          }
```

```
Line        Statement
29                  for (i=j=0; i<20; ++i)
30                          {
31                          if (t[i])
32                                  {
33                                  tnktyp[i]=2;
34                                  selmap[i]=1;
35                                  j++;
36                                  }
37                          else selmap[i]=0;
38                          }
39                  if (grpnod[ELSIZE+ELSIZE+GNTANKS]=j)    /* Tanks were automatically assigned to Group 3 */
40                          {
41                          tanks(selmap,t);
42                          banner("These are the Tanks in Group #3");
43                          cwaitm(183);
44                          }
45                  }
46          tanks(selmap,sysmap)
47                  char selmap[],sysmap[];
48                  {
                    /* draw the tank selection menu on the TSO */
49                  int i;
50                  boxes();
51                  for (i=0; i<20; ++i) if (sysmap[i])
52                          {
53                          if (selmap[i]) keyon(i);
54                          fldca((i/10)*2+4,(i%10)*6+13);
55                          printf("%d",i+1);
56                          }
57                  }
58          seltnk(s,selmap,sysmap)
59                  char *s,selmap[],sysmap[];
60                  {
                    /* display the tanks menu and allow the user to select them */
61                  int i,j;
62                  tanks(selmap,sysmap);
63                  banner(s);
64                  flputs("\033[14;12HALL\033[14;23HCLEAR\033[14;66HDONE");
65                  flush();
66                  do      {
67                          i=getkey();
```

```
Line            Statement
 68                         if (i==51)      /* all key pressed */
 69                                 {
 70                                 for (j=0; j<20; ++j) if (sysmap[j])
 71                                         {
 72                                         keyon(j);
 73                                         selmap[j]=1;
 74                                         }
 75                                 }
 76                         else if (i==53)
 77                                 {
 78                                 for (j=0; j<20; ++j) if (selmap[j])
 79                                         {
 80                                         keyoff(j);
 81                                         selmap[j]=0;
 82                                         }
 83                                 }
 84                         else if (i<=20)
 85                                 {
 86                                 if (sysmap[--i])
 87                                         {
 88                                         if (selmap[i])
 89                                                 {
 90                                                 selmap[i]=0;
 91                                                 keyoff(i);
 92                                                 }
 93                                         else    {
 94                                                 selmap[i]=1;
 95                                                 keyon(i);
 96                                                 }
 97                                         }
 98                                 }
 99                         } while (i!=60);
100                 boxbot();
101                 flush();
102             }
*** Variables and Arrays ***

grpnod    *CA          tnktyp    *CA

*** Functions ***

bldpg      F           blkmov    *F          strcpy    *F          seltnk     F
tanks      F           banner    *F          cwaitm    *F          boxes     *F
keyon     *F           fldca     *F          printf    *F          flputs    *F
flush     *F           getkey    *F          keyoff    *F          boxbot    *F

There were no errors in compilation.
```

```
Line                Statement
                    /* test block move function */

 1                  blkmov(src,dest,len)
 2                          char *src,*dest;
 3                          int len;
 4                          {
                            /* move len bytes from src to dest */

 5        A         #asm
 6        A                  ;
 7        A                  ; this routine requires going critical (interrupts disabled)
 8        A                  ; for it's entire length
 9        A                  ;
10        A                  di                          ; here we go - critical
11        A                  ;
12        A                  lxi     h,2
13        A                  dad     sp
14        A                  call    ccgint##
15        A                  mov     b,h
16        A                  mov     c,l
17        A                  lxi     h,4
18        A                  dad     sp
19        A                  call    ccgint##
20        A                  xchg
21        A                  lxi     h,6
22        A                  dad     sp
23        A                  call    ccgint##
24        A                  .z80
25        A                  ldir
26        A                  .8080
27        A                  ;
28        A                  ; now we can return to normal interrupts enabled
29        A                  ;
30        A                  ei
31        A                  ;
32        A         #endasm
33                           }
*** CMAC  V1.2 ***                    Module
Romable Code Segment

*** Variables and Arrays ***


*** Functions ***

blkmov     F

There were no errors in compilation.
```

```
Line          Statement

              /* C to AMX interface subroutines */

1             cclrst(size,lst)
2                     char size,*lst;
3                     {
                      /* intialize a circular list at lst to size slots */

4       A     #asm
5       A             lxi     h,4
6       A             dad     sp
7       A             call    ccgchr##                ; get size byte
8       A             xchg                            ; put in DE for safe keeping
9       A             lxi     h,2
10      A             dad     sp
11      A             call    ccgint##                ; get address of list
12      A             call    clrst##                 ; make the sys call
13      A             ei
14      A     #endasm
15                    }

16            cclabl(item,lst)
17                    int item;
18                    char *lst;
19                    {
                      /* add item to the bottom of circular list lst */

20      A     #asm
21      A             pop     d
22      A             pop     h                       ; address of list
23      A             pop     b                       ; item
24      A             push    b
25      A             push    h
26      A             push    d
27      A             call    clabl##
28      A             ei
29      A             lxi     h,1                     ; normal add result = 1
30      A             rnc                             ; return if list not full - all ok
31      A             dcx     h                       ; add ok - list now full ; result = 0
32      A             rnz                             ; return if add ok
33      A             dcx     h                       ; not added result = -1
34      A     #endasm
35                    }

36            cclatl(item,lst)
37                    int item;
38                    char *lst;
39                    {
```

```
Line          Statement
                      /* add item to the top of circular list lst */

 40     A     #asm
 41     A             pop     d
 42     A             pop     h                       ; address of list
 43     A             pop     b                       ; item
 44     A             push    b
 45     A             push    h
 46     A             push    d
 47     A             call    clatl##
 48     A             ei
 49     A             lxi     h,1                     ; normal add result = 1
 50     A             rnc                             ; return if list not full - all ok
 51     A             dcx     h                       ; add ok - list now full ; result = 0
 52     A             rnz                             ; return if add ok
 53     A             dcx     h                       ; not added result = -1
 54     A     #endasm
 55                   }

 56            cclrbl(lst,status)
 57                   char *lst;
 58                   int *status;
 59                   {
                      /* remove and return item - update int at status */
 60     A     #asm
 61     A             lxi     h,4
 62     A             dad     sp
 63     A             call    ccgint##                ; address of circular list
 64     A             call    clrbl##                 ; get bottom item
 65     A             ei
 66     A             lxi     d,1                     ; remove ok - list not full
 67     A             jnc     $+8
 68     A             dcx     d                       ; remove ok - list is empty ; status = 0
 69     A             jnz     $+4
 70     A             dcx     d
 71     A             lxi     h,2
 72     A             dad     sp
 73     A             call    ccgint##                ; address of integer status
 74     A             xchg                            ; status - HL ; &status -DE
 75     A             call    ccpint##                ; store it
 76     A             mov     h,b
 77     A             mov     l,c                     ; put item into HL
 78     A     #endasm
 79                   }

 80            cclrtl(lst,status)
 81                   char *lst;
```

```
Line            Statement

82                      int *status;
83                      {
                        /* remove and return item - update int at status */

84      A       #asm
85      A               lxi     h,4
86      A               dad     sp
87      A               call    ccgint##                ; address of circular list
88      A               call    clrtl##                 ; get bottom item
89      A               ei
90      A               lxi     d,1                     ; remove ok - list not full
91      A               jnc     $+8
92      A               dcx     d                       ; remove ok - list is empty ; status = 0
93      A               jnz     $+4
94      A               dcx     d
95      A               lxi     h,2
96      A               dad     sp
97      A               call    ccgint##                ; address of integer status
98      A               xchg                            ; status - HL ; &status -DE
99      A               call    ccpint##                ; store it
100     A               mov     h,b
101     A               mov     l,c                     ; put item into HL
102     A       #endasm
103                     }

104             cctask(tsknbr,wait,pri,parl,par2,par3)
105                     int tsknbr,wait,pri,parl,par2,par3;
106                     {
                        /* AMX Call Task tsknbr - Pass params <parl,par2>,par3 */

107     A       #asm
108     A               lxi     h,2
109     A               dad     sp
110     A               call    ccgint##                ; get par3 (AMX par2)
111     A               xchg                            ; put into DE
112     A               lxi     h,10
113     A               dad     sp
114     A               call    ccgint##                ; get wait flag
115     A               mov     b,l                     ; save in B
116     A               lxi     h,8
117     A               dad     sp
118     A               call    ccgint##                ; get priority
119     A               mov     c,l                     ; save in C
120     A               lxi     h,12
121     A               dad     sp
122     A               call    ccgint##                ; get task number
123     A               mov     a,l                     ; into A
```

```
Line          Statement
124     A             lxi     h,4
125     A             dad     sp                      ; point to <par1,par2>
126     A             call    ctask##                 ; make the call
127     A             call    ccsxt##                 ; sign extend result
128     A     #endasm
129                   }

130           creshd()
131                   {
                      /* force task rescheduling */

132                   reshd(); /* same as AMX - no parameters */
133                   }

134           cstask(tsknbr)
135                   int tsknbr;
136                   {
                      /* start task tsknbr */

137     A     #asm
138     A             lxi     h,2
139     A             dad     sp
140     A             call    ccgint##                ; get the task number
141     A             mov     a,l
142     A             call    stask##                 ; and then start it
143     A             call    ccsxt##                 ; prepare the result
144     A     #endasm
145                   }

146           ctend()
147                   {
                      /* task end - remove from active list */

148                   tend(); /* same as AMX - no parameters */
149                   }

150           ctmget(tmradd,value)
151                   int tmradd,value[];
152                   {
                      /* get the current value of the timer at tmradd */

153     A     #asm
154     A             lxi     h,4
155     A             dad     sp
156     A             call    ccgint##                ; the timer address
157     A             call    tmget##                 ; read the value
158     A             ei
```

```
Line          Statement
 159    A            lxi     h,2
 160    A            dad     sp
 161    A            call    ccgint##              ; address of word array
 162    A            mov     m,b                   ; begin storing bytes
 163    A            inx     h
 164    A            mov     m,c
 165    A            inx     h
 166    A            mov     m,d
 167    A            inx     h
 168    A            mov     m,e                   ; done storing in array
 169    A            xchg                          ; put lower word in HL for return
 170    A      #endasm
 171                 }

 172            ctmput(tmradd,value)
 173                 int tmradd,value[];
 174                 {
                     /* store the timer count in array value into timer at tmradd */

 175    A      #asm
 176    A            lxi     h,2
 177    A            dad     sp
 178    A            call    ccgint##              ; get address of array
 179    A            mov     c,m
 180    A            inx     h
 181    A            mov     b,m
 182    A            inx     h
 183    A            mov     e,m
 184    A            inx     h
 185    A            mov     d,m                   ; got array into BCDE
 186    A            lxi     h,4
 187    A            dad     sp
 188    A            call    ccgint##              ; get timer address
 189    A            call    tmput##               ; and start it
 190    A            ei
 191    A      #endasm
 192                 }

 193            ctmstp(tmradd)
 194                 int tmradd;
 195                 {
                     /* stop timer at tmradd */

 196    A      #asm
 197    A            lxi     h,2
 198    A            dad     sp
 199    A            call    ccgint##              ; get timer address
 200    A            call    tmstp##               ; reset it to zero
```

```
Line          Statement
 201    A              ei
 202    A       #endasm
 203                   }

 204            cwait()
 205                   {
                       /* wait unconditionally for an event */

 206                   wait(); /* same as AMX - no parameters */
 207                   }

 208            cwaitm(i)
 209                   int i;
 210                   {
                       /* call AMX task to wait for i ticks */

 211    A       #asm
 212    A              pop     b
 213    A              pop     h
 214    A              push    h
 215    A              push    b
 216    A              lxi     b,0
 217    A              xchg
 218    A              call    waitm##
 219    A              call    ccsxt##                 ; convert the result
 220    A       #endasm
 221                   }

 222            cwake(tsknbr)
 223                   int tsknbr;
 224                   {
                       /* wake task number tsknbr */

 225    A       #asm
 226    A              lxi     h,2
 227    A              dad     sp
 228    A              call    ccgint##                ; get task number
 229    A              mov     a,l
 230    A              call    wake##                  ; and make the call
 231    A              call    ccsxt##                 ; convert the result
 232    A       #endasm
 233                   }

 234            cwakec()
 235                   {
                       /* wake the task that called this task */

 236    A       #asm
```

```
Line                Statement
 237     A                call    wakec##                 ; call the routine
 238     A                call    ccsxt##                 ; and convert the result
 239     A          #endasm
 240                      }

                    /* C to Time/Date interface subroutines */

 241                ctdget(s)
 242                      char *s;
 243                      {
                          /* get the current time and date into buffer s */
 244     A          #asm
 245     A                pop     b
 246     A                pop     h
 247     A                push    h
 248     A                push    b
 249     A                call    tdget##                 ; buffer address in HL
 250     A                ei
 251     A          #endasm
 252                      }

 253                ctdset(s)
 254                      char *s;
 255                      {
                          /* put the time buffer at s to the td module */
 256     A          #asm
 257     A                pop     b
 258     A                pop     h
 259     A                push    h
 260     A                push    b
 261     A                call    tdset##
 262     A                ei
 263     A          #endasm
 264                      }

 265                ctdfmt(format,time,buffer)
 266                      char format,*time,*buffer;
 267                      {
                          /* format the time in time to buffer by type format */
 268     A          #asm
 269     A                pop     h
 270     A                pop     d                       ; get the return address in HL
 271     A                pop     b                       ; output buffer address
 272     A                xthl                            ; time buffer address
 273     A                mov     a,l                     ; put return back - get format byte
                                                          ; and put into A
```

```
274   A            xthl                          ; now to restore the stack
275   A            push    b
276   A            push    d
277   A            push    h                     ; whew!!
278   A            ;
279   A            ; A=format ; DE=buffer ; BC=time (gotta move it to HL)
280   A            ;
281   A            mov     l,c
282   A            mov     h,b
283   A            ;
284   A            ; now call the td routine
285   A            ;
286   A            call    tdfmt##
287   A            ;
288   A      #endasm
289                }

             /* C to AMX Task Abort routines */

290          cstop(tsknbr)
291                int tsknbr;
292                {
                   /* STOP the task number tsknbr */

293   A      #asm
294   A            lxi     h,2
295   A            dad     sp
296   A            call    ccgint##              ; get the task number
297   A            mov     a,l                   ; and put in A for call
298   A            call    aastop##
299   A            call    ccsxt##               ; convert the result
300   A      #endasm
301                }

302          ckill(tsknbr)
303                int tsknbr;
304                {
                   /* KILL the task number tsknbr - ALL CTASK Calls are canceled */

305   A      #asm
306   A            lxi     h,2
307   A            dad     sp
308   A            call    ccgint##              ; get the task number
309   A            mov     a,l                   ; and put in A for call
310   A            call    aakill##
311   A            call    ccsxt##               ; convert the result
312   A      #endasm
313                }
```

```
*** Functions ***

cclrst    F          cclabl    F          cclatl    F          cclrbl    F
cclrtl    F          cctask    F          creshd    F          reshd    *F
cstask    F          ctend     F          tend     *F          ctmget    F
ctmput    F          ctmstp    F          cwait     F          wait     *F
cwaitm    F          cwake     F          cwakec    F          ctdget    F
ctdset    F          ctdfmt    F          cstop     F          ckill     F

There were no errors in compilation.

Line          Statement
              /* procedure to auto-configure the node loop */

              #Include <A:STD.H>
        +     /* system parameters */
        +
        +     #define YES     1
        +     #define NO      0
        +     #define NULL    0
        +     #define EOF     (-1)
        +     #define BYTMASK 0xff
        +     #define CHARMASK 0x7f
        +
        +     /* macros */
        +
        +     /* All char type macros use the external character type array 'ctype' */
        +     /* we now declare it in the code that includes us */
        +
1       +     extern char ctype[];
        +
        +     /* we now define the bit masks for the various types */
        +     /* NOTE - all of these begin with underscore '_' to avoid collisions */
        +
        +     #define _upper          0x01
        +     #define _lower          0x02
        +     #define _numeric        0x04
        +     #define _control        0x08
        +     #define _punct          0x10
        +     #define _print          0x20
        +
        +     /* most of the ctype macros use this macro as a base type */
        +
        +     #define istype(c,type)  (?(ctype[(c) & CHARMASK] & (type)))
        +
        +     /* herewith follows the ctype macros plus a few other misc. defines */
        +
        +     #define isalnum(c)      istype(c, _upper | _lower | _numeric)
```

```
Line          Statement

+       #define isalpha(c)      istype(c, _upper | _lower)
+       #define isascii(c)      ((c) <= 0x7f)
+       #define iscntrl(c)      istype(c, _control)
+       #define isdigit(c)      istype(c, _numeric)
+       #define islower(c)      istype(c, _lower)
+       #define isprint(c)      istype(c, _print)
+       #define ispunct(c)      istype(c, _punct)
+       #define isspace(c)      ((c)==' ')
+       #define isupper(c)      istype(c, _upper)
+       #define abs(x)          ((x < 0) ? -(x) : (x))
+       #define iswhite(c)      ((c) <= ' ' || 0177 <= (c)) /* ASCII ONLY */
+       #define max(x, y)       (((x) < (y)) ? (y) : (x))
+       #define min(x, y)       (((x) < (y)) ? (x) : (y))
+       #define tolower(c)      (isupper(c) ? ((c) + 32) : (c)) /* ASCII ONLY */
+       #define toupper(c)      (islower(c) ? ((c) - 32) : (c)) /* ASCII ONLY */
+       #define hibyte(i)       ((i) >> 8)
+       #define lobyte(i)       ((i) & BYTMASK)

2               extern char sysmap[];
3               contnk(recnfg)
4                       int recnfg;     /* set if this is a reconfiguration */
5                       {
                        /* modify the external char array sysmap as follows: */

6                       char noddat[6];
7                       char tmpmap[20];
8                       int nodcnt,badtnks,chksum,i;

9                       blkmov(sysmap,tmpmap,20);
10                      badtnks=0;
11                      do      {

12                              pwroff();

                        /* prompt the user to find out if all nodes connected */

13                              dblsize();
14                              while (!ques( (badtnks==0) ?
15                      "Have all Sensors been/Installed and Connected/to the Computer Box ?/@Node Power is OFF" :
16                      "Have all BAD Sensors/been Replaced and the/Cable Re-Connected ?/@Node Power is OFF"))
17                                      {
18                                      if (badtnks)
19                                              msg("Please Replace all/BAD Sensors.@Touch When Done.    ");
20                                      else
21                                              msg("Please Install one Sensor/per tank.@Touch When Done.    ");
22                                      block();
```

```
Line        Statement
 23                     kwait();
 24                     }
 25             pwron();
 26             dblsize();
 27             flputs("\033[5;23H\033[m\033[2;5HNode Power is :\033[5;17H\033[7m O N");
 28             nputc(1,0xff);  /* knock down all upstreams remaining */
 29             cwaitm(61);
 30             nputc(1,0xff);
 31             badtnks=0;
 32             boxes();
 33             banner("Auto-Configuring Tanks - Please Wait");
 34             for (nodcnt=0; nodcnt<20; ++nodcnt)
 35                     {
 36                     while (nstat(1)) ngetc(1);
 37                     keywd(nodcnt,"Chk");
 38                     nputc(1,nodcnt+1);
 39                     if ((noddat[0]=ngetc(1))<0) break;
 40                     for (i=1; i<4; ++i) noddat[i]=ngetc(1);
 41                     if (noddat[1]==-1 && noddat[2]==-1 && noddat[3]==-1) break;
 42                     for (i=chksum=0; i<4; ++i) chksum+=noddat[i] & BYTMASK;
 43                     if (noddat[0]==(nodcnt+1) && (chksum&BYTMASK)==0)
 44                             {
 45                             nputc(1,nodcnt+1);
 46                             keyon(nodcnt);
 47                             tmpmap[nodcnt]=1;
 48                             }
 49                     else    {
 50                             nputc(1,NULL);
 51                             keyflash(nodcnt,"BAD");
 52                             tmpmap[nodcnt]=2;
 53                             badtnks=1;
 54                             }
/*                      printf("\033[10;10H\033[2K%d\t%d\t%d\t%d", */
 55                     cwaitm(21);
 56                     }
 57             keyoff(nodcnt);
 58             for (i=nodcnt; i<20; ++i) tmpmap[i]=0;
 59             if (recnfg)
 60                     {
 61                     int difbool;
 62                     for (difbool=i=0; i<20; ++i) if (tmpmap[i]!=sysmap[i])
 63                             {
 64                             difbool=1;
 65                             if (tmpmap[i]) keyflash(i," ? ");
 66                             else keyflash(i,"NEW");
```

```
Line        Statement
 67                                     }
 68                             if (difbool)
 69                                     {
 70                                     banner("WARNING - Tanks have been Added or Lost!");
 71                                     bells();
 72                                     for (i=0; i<20; ++i) if (tmpmap[i]!=sysmap[i])
 73                                             keyoff(i);
 74                                     cwaitm(183);
 75                                     }
 76                             }
 77                     if (badtnks)
 78                             {
 79                             banner("ERROR - One or more Sensors is BAD!");
 80                             bells();
 81                             flputs("\033[9;20HCan I 'Ignore' the\033[5;7mBAD\033[mTanks ?");
 82                             if (smlyn())
 83                                     {
 84                                     for (i=0;i<20;i++) if (tmpmap[i]==2) tmpmap[i]=0;
 85                                     badtnks=0;
 86                                     }
 87                             }
 88                     else    {
 89                             banner("These are the Tanks found during Auto-Configure");
 90                             flputs("\033[9;20HAre these the Correct Tanks ?");
 91                             badtnks=(!smlyn());
 92                             }
 93                     } while (badtnks);      /* end of whole sheebang */

 94             blkmov(tmpmap,sysmap,20);
 95             seltnk("Select ONLY those Tanks to be Displayed",tmpmap,sysmap);
 96             blkmov(tmpmap,sysmap,20);
 97             for (i=nodcnt=0; i<20; ++i) if (sysmap[i]) ++nodcnt;
 98             return (nodcnt);
 99             }

100     smlyn()
101             {
                /* prompt the user for a small yes or no */

102             int i;

103             flputs("\033[14;18HYes");
104             flputs("\033[14;60HNo");
105             do i=getkey(); while (i!=52 && i!=59);
106             return (i==52);
107             }

108     bells()
```

```
Line          Statement
109                   {
                      /* beep 8 times */

110                   int i;

111                   for (i=0;i<8;i++)
112                           {
113                           flputc(7);
114                           cwaitm(20);
115                           }
116                   }

117           inipwr()
118                   {
                      /* initialize the power on/off circuitry */

119     A     #asm
120     A             mvi     a,0             ; basic i/o for mode control
121     A             sta     0f887h
122     A             mvi     a,0ffh          ; all port a is output
123     A             sta     0f884h
124     A             mvi     a,0             ; and all bits low to power off
125     A             sta     0f880h
126     A     #endasm
127                   }

128           pwron()
129                   {
                      /* turn node loop power on */

130     A     #asm
131     A             mvi     a,0ffh          ; all bits high for power on
132     A             sta     0f880h
133     A     #endasm
134                   }

135           pwroff()
136                   {
                      /* turn node loop power off */
137     A     #asm
138     A
139     A             mvi     a,0
140     A             sta     0f880h          ; all bits low for power off
141     A     #endasm
                      }
```

```
*** Functions ***

contnk    F          blkmov   *F          pwroff    F          dblsize  *F
ques     *F          msg      *F          block    *F          kwait    *F
pwron     F          flputs   *F          nputc    *F          cwaitm   *F
boxes    *F          banner   *F          nstat    *F          ngetc    *F
keywd    *F          keyon    *F          keyflash *F          keyoff   *F
bells     F          smlyn     F          seltnk   *F          getkey   *F
flputc   *F          inipwr    F

There were no errors in compilation.

                /* subroutine module for fluke input and output routines */

1               flgetc()
2                       {
                        /* get one character from the fluke serial I/O board */

3       A       #asm
4       A               mvi     e,255           ; direct console input char
5       A               mvi     c,6             ; TH direct console I/O fn
6       A               call    ioc##           ; call the terminal handler
7       A               jmp     ccsxt##
8       A       #endasm
9                       }

10              flstat()
11                      {
                        /* return true if character available */

12      A       #asm
13      A               mvi     c,11
14      A               call    ioc##           ; get console status to A
15      A               call    ccsxt##
16      A       #endasm
17                      }

18              putchar(c)
19                      char c;
20                      {
                        /* included for parity with most C programs */

21                      flputc(c);
22                      }

23              flputc(c)
24                      char c;
25                      {
                        /* put one character out to the fluke serial I/O board */
```

```
Line          Statement

26    A       #asm
27    A               pop     b
28    A               pop     h
29    A               push    h
30    A               push    b
31    A               ;
32    A               ; char to send now in HL
33    A               ;
34    A               mov     e,l             ; put char into E for TH
35    A               mvi     c,2             ; TH put console char fn
36    A               jmp     ioc##
37    A       #endasm
38                    }

39              puts(s)
40                      char *s;
41                      {
                        /* included for parity with existing programs */

42                      flputs(s);
43                      }

44              flputs(s)
45                      char *s;
46                      {
                        /* put the string at s out the fluke serial I/O board */

47                      while (*s) flputc(*s++);
48                      }

49              flptbf(s,i)
50                      char *s;
51                      int i;
52                      {
                        /* put the buffer at s for i bytes to the fluke */

53                      while (i--) flputc(*s++);
54                      }

55              flgets(s)
56                      char *s;
57                      {
                        /* get one line from the fluke tso ending with a CR */

58                      char c,*t;
59                      t=s;
60                      while ((c=flgetc())!=13) *s++=c;
```

```
Line            Statement
;1                      *s=0;
;2                      return(t);
;3                      }

;4              flcmd(s)
;5                      char *s;
;6                      {
                        /* send command leadin 'ESC-[' and then string at s */

 7                      printf("\033[%s",s);
 8                      }

 9              fldca(y,x)
 0                      int y,x;
 1                      {
                        /* position the fluke cursor to line y column x */

                /*      flputc(27); */

 2                      printf("\033[%d;%dH",y,x);
 3                      }

*** Functions ***

flgetc    F          flstat    F          putchar   F          flputc    F
puts      F          flputs    F          flptbf    F          flgets    F
flcmd     F          printf   *F          fldca     F

There were no errors in compilation.

Line            Statement

                /* Utility Programs for use with the Fluke TSO */

                #Include <FLUKE.DEF>
        +
        +       /* Global definitions for use with Fluke TSO */
        +
        +               /* These definitions are for drawing a key box display */
        +
        +       #define TLINE1 "1444444444444444444444444444444"
        +       #define TLINE2 "4444444444444444444444444444440"
        +       #define CLINE1 "9     9     9     9     9     "
        +       #define CLINE2 "9     9     9     9     9     9"
        +       #define XLINE1 "3444447444447444447444447444444"
        +       #define XLINE2 "7444447444447444447444447444442"
        +
        +               /* These definitions are screen size and formatting for the TSO */
```

```
Line          Statement

        +      #define HINDENT 10
        +      #define HSIZE 60
        +      #define VINDENT 2
        +      #define VSIZE 12
        +
        +              /* These defs cover routine I/O info */
        +
        +      #define EOL 13
        +      #define ESC 27
        +      #define BS  8
        +      #define NULL 0
        +      #define EOF (-1)

1              altgraf()
2                      {
                       /* put the Fluke TSO into Alternate Graphics mode */
3                      flcmd("3p");
4                      }

5              normgraf()
6                      {
                       /* Fluke TSO to Normal Graphics mode */
7                      flcmd("2p");
8                      }

9              invid()
10                     {
                       /* Select Inverse Video Display */
11                     flcmd("7m");
12                     }

13             altcset()
14                     {
                       /* Select the Fluke TSO alternate character set */
15                     flcmd("8m");
16                     }

17             normcset()
18                     {
                       /* Select the Fluke TSO normal character set */
19                     flcmd("m");
20                     }
```

Statement

```
21              clrscrn()
22                      {
                        /* Clear the Fluke TSO Screen */
23                      flcmd("2J");
24                      }
25              dblsize()
26                      {
                        /* Select Double Size characters */
27                      flcmd("lp");
28                      }
29              normsize()
30                      {
                        /* Select Normal Size characters */
31                      flcmd("0p");
32                      }
33              yesno()
34                      {
                        /* Display a sideline Yes/No Prompt and return true if Yes */
35                      int i;
36                      flush();
37                      fldca(3,33);
38                      block();
39                      flputs(" NO");
40                      fldca(6,33);
41                      block();
42                      flputs(" YES");
43                      do i=getkey(); while (i!=20 && i!=50);
44                      return(i==50);
45                      }
46              block()
47                      {
                        /* print a 3 char wide block */
48                      flputs("\177\177\177");
49                      }
ques(s)
        char *s;
        {
        /* print the yes no question in s breaking lines at '/' */
```

```
        msg(s);
        return(yesno());
        }

msg(s)
        char *s;
        {
        /* Print the message in s - break lines at '/' */

        int line,chr;

        clrscrn();
        fldca(line=2,chr=5);
        while (*s)
                {
                if (*s=='/')
                        {
                        line++;
                        chr=6;
                        fldca(line,chr);
                        }
                else if (*s=='@')
                        {
                        line+=2;
                        chr=5;
                        fldca(line,chr);
                        }
                else flputc(*s);
                s++;
                }
        }

onebox(i)
        int i;
        {
        /* draw one line of boxes on the Fluke TSO */

        fldca(i,HINDENT);
        printf("%s%s",CLINE1,CLINE2);
        fldca(++i,HINDENT);
        printf("%s%s",XLINE1,XLINE2);
        }

boxes()
        {
        /* draw keyboxes on the Fluke TSO */
```

```
Line        Statement
90                int i;

91                normsize();
92                fldca(i=VINDENT,HINDENT);
93                altgraf();
94                printf("%s%s",TLINE1,TLINE2);
95                for (i++;i<7;i+=2) onebox(i);
96                fldca(12,HINDENT);
97                printf("%s%s",TLINE1,TLINE2);
98                onebox(13);
99                normgraf();
100               }

101         boxbot()
102               {
                  /* redraw the bottom of the key boxes */

103               altgraf();
104               onebox(13);
105               normgraf();
106               }

107         nboxes(i,j)
108               int i,j;
109               {
                  /* draw the keyboxes and number them from i to j */

110               normsize();
111               fldca(10,HINDENT);
112               altgraf();
113               printf("%s%s",TLINE1,TLINE2);
114               onebox(11);
115               onebox(13);
116               normgraf();
117               for (i;i<=j;i++)
118                       {
119                       fldca(i/10*2+12,i%10*6+13);
120                       printf("%d",i);
121                       }
122               fldca(14,12);
123               flputs("<--");
124               fldca(14,24);
125               flputs("-->");
126               fldca(14,66);
127               flputs("DONE");
128               }

129         banner(s)
130               char *s;
```

```
Line        Statement
131                 {
                    /* display the banner in s highlighted centered */

132                 fldca(1,71);
133                 flcmd("2K");
134                 flcmd("m");
135                 fldca(1,10);
136                 flcmd("1m");
137                 fldca(1,(80-strlen(s))>>1);
138                 flputs(s);
139                 }

140         kwait()
141                 {
                    /* delay till one key is pressed */

142                 flush();
143                 while (!flstat());
144                 cwaitm(2);
145                 flush();
146                 }

147         getkey()
148                 {
                    /* get one key press - return it's number */

149                 char s[5];

150                 fldca(15,80);
151                 flcmd("7m");
152                 while ((s[0]=flgetc())<0);
153                 flgets(s+1);
154                 fldca(15,80);
155                 flcmd("m");
156                 return numin(s);
157                 }

158         keyon(i)
159                 int i;
160                 {
                    /* display key i indicator */

161                 fldca(i/10*2+3,i%10*6+11);
162                 flputs("\177\177\177\177\177");
163                 }

164         keyoff(i)
165                 int i;
```

```
Line        Statement
 166                {
                    /* remove key i indicator */

 167                fldca(i/10*2+3,i%10*6+11);
 168                flputs("     ");
 169                }

 170        keywd(i,s)
 171                int i;
 172                char *s;
 173                {
                    /* put the word in s in the banner of key i */
 174
 175                fldca(i/10*2+3,i%10*6+15);
 176                flcmd("m");
 177                fldca(i/10*2+3,i%10*6+11);
 178                flcmd("7m");
 179                flputs(s);
                    }

 180        keyflash(i,s)
 181                int i;
 182                char *s;
 183                {
                    /* put the word in s in the banner of key i - make it flash */
 184
 185                fldca(i/10*2+3,i%10*6+15);
 186                flcmd("m");
 187                fldca(i/10*2+3,i%10*6+11);
 188                flcmd("5;7m");
 189                flputs(s);
                    }

 190        flush()
 191                {
                    /* flush the TSO type-ahead buffer */
 192
 193                while (flstat()) flgetc();
                    }

 194        getnum(s,mask)
 195                char *s,mask[];
 196                {
                    /* have user enter a number of required format */
 197
 198                return chgnum(s,mask,0);
                    }

 199        chgnum(s,mask,preval)
```

```
Line            Statement
 200                    char *s,mask[];
 201                    int preval;
 202                    {
                        /* Have user accept or alter preval using a required format */

 203                    char t[10],u[7];
 204                    int i,j,k;

 205                    for (i=j=0;mask[i];i++) if (mask[i]=='#') j++;

                        /* convert preval to a string and zero pad to fit into mask */
 206                    if (preval<0) preval = -preval;
 207                    numout(u,preval);
 208                    i=0;
 209                    if (j>=strlen(u))       /* if mask bigger than preval */
 210                            {
 211                            for (k=j-strlen(u) ; k>0 ; k--) t[i++]='0';
 212                            j=0;
 213                            }

  +
  +             /* First the Offsets for integer arrays */
  +
  +     #define ILSTRD 0                /* Integer - Last Reading in Microseconds */
  +     #define IPREVRD 1               /* Integer - Smoothing function value */
  +     #define IBOTRD 2                /* Integer - Microseconds to Bottom of Tank */
  +     #define IVOLUME 3               /* Integer - Current Tank Volume */
  +     #define IMAXVOL 4               /* Integer - Maximum Volume since Beginning */
  +     #define IRDTIME 5               /* Char[8] - AMX Time Buffer - time of last read */
  +     #define IFLOWRATE 9             /* Integer - Calculated Flow Rate */
  +     #define IMTE 10                 /* Integer - Minutes Till Empty */
  +     #define IREVLVL 11              /* Char[4] - 4 Char Version String from Node */
  +     #define ITRIPLVL 13             /* Integer - individual tank trip level */
  +     #define IVOLTBL 14              /* Integer[72] - Volumes at every 6 inch interval */
  +
  +             /* The size of the volumes table in bytes */
  +     #define VOLLEN 64       /* up to 16 ft. in 6 inch chunks */
  +
  +             /* Sizes of an individual structure and the whole sheebang */
  +     #define NDSIZE 92       /* one structure (IVOLTBL * 2 + VOLLEN) */
  +     #define TBLSIZE 1840    /* 20 node tables */
  +
  +             /* The tank structure access defines */
        /* this module contains tank strapping table utilities */

        #Include <FLUKE.DEF>
  +
  +     /* Global definitions for use with Fluke TSO */
```

```
Line            Statement
     +
     +              /* These definitions are for drawing a key box display */
     +
     +      #define TLINE1 "1444444444444444444444444444444"
     +      #define TLINE2 "4444444444444444444444444444440"
     +      #define CLINE1 "9     9     9     9     9     "
     +      #define CLINE2 "9     9     9     9     9     9"
     +      #define XLINE1 "3444447444447444447444447444444"
     +      #define XLINE2 "7444447444447444447444447444442"
     +
     +              /* These definitions are screen size and formatting for the TSO */
     +
     +      #define HINDENT 10
     +      #define HSIZE 60
     +      #define VINDENT 2
     +      #define VSIZE 12
     +
     +              /* These defs cover routine I/O info */
     +
     +      #define EOL 13
     +      #define ESC 27
     +      #define BS  8
     +      #define NULL 0
     +      #define EOF (-1)
            #Include <TANKS.DEF>
     +
     +      /* Global Definitions for Offsets and such in the use of the tank structures */
214                 else    {
215                         j=strlen(u)-j;
216                         }
217                 strcpy(t+i,u+j);

218                 banner(s);
219                 fldca(6,20);
220                 flcmd("2K");
221                 flush();
222                 for (i=k=0;mask[k];k++)
223                         {
224                         if (mask[k]=='#') flputc(t[i++]);
225                         else flputc(mask[k]);
226                         }
227                 i=j=k=0;        /* i=buf ptr; j=key nbr; k=mask ptr */
228                 cwaitm(20);
229                 flcmd("0x"); flcmd("0x");
230                 while (j!=20)
231                         {
232                         while ((mask[k]!='#') && (mask[k])) k++;
```

```
Line            Statement
 233                            fldca(6,20+k);
 234                            while ((u[0]=flgetc())<0);
 235                            flgets(u+1);
 236                            j=numin(u)-40;
 237                            if ((j>=1) && (j<=10) && (mask[k]))
 238                                    {
 239                                    flputc(t[i++]=j-1+'0');
 240                                    k++;
 241                                    }
 242                            else if ((j==13) && (mask[k]))
 243                                    {
 244                                    k++;
 245                                    i++;
 246                                    }
 247                            else if ((j==11) && (i>0))
 248                                    {
 249                                    i--;
 250                                    k--;
 251                                    if (i>0) while ((mask[k]!='#') && (k>0)) k--;
 252                                    }
 253                            }
 254                    flcmd("2x");
 255                    return(numin(t));
 256                    }
*** Functions ***

altgraf   F        flcmd     *F        normgraf  F        invid     F
altcset   F        normcset   F        clrscrn   F        dblsize   F
normsize  F        yesno      F        flush     F        fldca    *F
block     F        flputs    *F        getkey    F        ques      F
msg       F        flputc    *F        onebox    F        printf   *F
boxes     F        boxbot     F        nboxes    F        banner    F
strlen   *F        kwait      F        flstat   *F        cwaitm   *F
flgetc   *F        flgets    *F        numin    *F        keyon     F
keyoff    F        keywd      F        keyflash  F        getnum    F
chgnum    F        numout    *F        strcpy   *F

There were no errors in compilation.
        +
        +       #define TNK_PTR(item) ((item)*NDSIZE+tnknod)
1       +       extern char tnknod[];
                #Include <GROUPS.DEF>
        +
        +       /* Global Definitions for Offsets into Group Structures */
        +
        +       #define GMXVOL 0                /* Integer - Group Maximum Volume */
        +       #define GCRVOL 2                /* Integer - Group Current Volume */
        +       #define GFRATE 4                /* Integer - Group Flow Rate in BPM */
        +       #define GNTANKS 6               /* Char    - Number of Tanks in Group */
        +
```

```
Line            Statement
        +       #define ELSIZE 7                /* Size in bytes of one element in Group Table */
        +       #define GRPSIZE 21              /* Size in bytes of Group Table */
        +
2       +       extern char grpnod[];
3       +       extern char tnktyp[];
                #Include <RATES.DEF>
        +       /* Rate Smoothing Table Offsets */
        +
        +       #define BBL0     0              /* Volume 0 in table */
        +
        +       #define BBLLEN   6              /* Number of Volume Readings          */
        +       #define RATELEN  12             /* Total Byte Elements in one entry   */
        +       #define RATESIZE 120            /* Total Entries in Smooth Table      */
                #Include <FRAC.DEF>
        +       /* this file contains definitions peculiar to the Frac System */
        +
        +       #define HALFINCH 74     /* microseconds per 1/2 inch */
        +       #define ONEINCH 147     /* microseconds per inch */
        +       #define SIXINCH 882     /* microseconds per six inches */
        +       #define ONEFOOT 1764    /* microseconds per one foot */
        +       #define DEADZONE ONEFOOT /* dead zone in microseconds */

4               extern char sysmap[];

5               gtspec(tnkno,olddat)
6                       int tnkno,olddat;
7                       {
                        /* get full specs on tank tnkno */

8                       int *ndiptr,higage,maxrd,crntrd,prlvl,ft,in,j,k,l;
9                       char s[80],*t,u[6];
10                      char selmap[20];
11                      char tmap[20];

12                      ndiptr=TNK_PTR(tnkno);
13                      crntrd=ndiptr[ILSTRD];
14                      if (olddat && crntrd)
15                              {
                /*              normsize(); */
16                              return;
17                              }
18                      if (crntrd)
19                              {
20                              strcpy(s,"Do you want to review the//Table for Tank ");
21                              numout(s+strlen(s),tnkno+1);
22                              strcat(s," ?");
23                              dblsize();
24                              if (!ques(s)) return;
25                              }
```

```
Line        Statement
26              strcpy(s,"Tank ");
27              numout(s+strlen(s),tnkno+1);
28              strcat(s,": ");
29              t=s+strlen(s);
30              dblsize();
31              msg(strcat(s,((crntrd) ? "@  Review Strapping Table" : "@  Enter Strapping Table")));
32              cwaitm(366);
33              prlvl=(crntrd==0);
34              do      {
35                      if (crntrd==0)
36                              {
37                              nboxes(0,9);
38                              do      {
39                                      *t=0;
40                                      crntrd=getnum(strcat(s,"Enter High Gauge (Present Tank Level)"),"## ft  ## in");
41                                      crntrd=((crntrd/100*12)+(crntrd%100));
42                                      } while (crntrd<0 || crntrd>180);
43                              ndiptr[ILSTRD]=(crntrd*=ONEINCH);
44                              }
45                      ndcomm(tnkno+1,0,u);
46                      cwaitm(122);
47                      ndcomm(tnkno+1,0,u);
48                      ndiptr[IBOTRD]=higage=crntrd + *(1+u);
49                      higage=(higage+HALFINCH)/ONEINCH;
50                      *t=0;
51                      strcat(s,"Is it about//");
52                      txtft(s,higage/6);
53                      strcat(s," tall ?");
54                      dblsize();
55                      crntrd = ((ques(s)) ? crntrd : 0);
56                      } while (crntrd==0);
57              if (!olddat && prlvl)
58                      {
59                      nboxes(0,9);
60                      for (j=0;j<((higage+6)/6);j++)
61                              {
62                              *t=0;
63                              strcat(s,"Enter the Barrels at ");
64                              txtft(s,j);
65                              ndiptr[IVOLTBL+j]=chgnum(s,"###.# bbls",ndiptr[IVOLTBL+j]);
66                              }
67                      }
68              dstrp(ndiptr,(higage+6)/6);
69              invbox(" No",5);
70              invbox(" Yes",9);
71              *t=0;
72              banner(strcat(s,"Strapping Table - Is it CORRECT ?"));
73              flush();
74              do j=getkey(); while (j!=20 && j!=40);
```

```
Line        Statement
 75                 l=0;
 76                 if (j==20) while (l)
 77                         {
 78                         for (j=5;j<11;j++)
 79                                 {
 80                                 fldca(j,64);
 81                                 flcmd("OK");
 82                                 }
 83                         invbox("\034",3);       /* up arrow */
 84                         invbox("\004",5);       /* down arrow */
 85                         invbox("Chng",9);
 86                         invbox("Done",13);
 87                         fldca(l%12+3,l/12*15+2);
 88                         flputc(26);     /* right arrow */
 89                         flcmd("14p");   /* auto-repeat */
 90                         banner("Make the ARROW point to the Number to Correct");
 91                         while ((k=getkey())!=40)
 92                                 {
 93                                 if (k==60) break;
 94                                 if ((k==10)||(k==20))
 95                                         {
 96                                         fldca(l%12+3,l/12*15+2);
 97                                         flputc(' ');
 98                                         if (k==10) {if (--l<0) l=(higage+6)/6-1;}
 99                                         else {if (++l>=((higage+6)/6)) l=0;}
100                                         fldca(l%12+3,l/12*15+2);
101                                         flputc(26);
102                                         }
103                                 }
104                         flcmd("15p");
105                         *t=0;
106                         if (k==60) break;
107                         if (k==40)
108                                 {
109                                 nboxes(0,9);
110                                 strcat(s,"Enter the Barrels at ");
111                                 txtft(s,l);
112                                 ndiptr[IVOLTBL+l]=chgnum(s,"###.# bbls",ndiptr[IVOLTBL+l]);
113                                 }
114                         dstrp(ndiptr,(higage+6)/6);
115                         }
116                 ndiptr[IMAXVOL]=0;
117                 for (j=k=0;j<20;j++)
118                         {
119                         selmap[j]=0;
120                         tmap[j]=sysmap[j];
121                         sysmap[j]=((sysmap[j]) && (j>tnkno) && (*(ILSTRD+ILSTRD+TNK_PTR(j))==0));
122                         k=k||sysmap[j];
```

```
Line        Statement

123                     }
124             if ((!olddat) && k)
125                     {
126                     *t=0;
127                     seltnk(strcat(s,"Select Tanks with IDENTICAL Strapping Tables"),selmap,sysmap);
128                     for (j=0;j<tnkno;j++) keyoff(j);
129                     for (j=tnkno+1;j<20;j++)
130                             {
131                             keyoff(j);
132                             if ((selmap[j])&&(sysmap[j])&&(*(ILSTRD+ILSTRD+TNK_PTR(j))==0))
133                                     {
134                                     int *tiptr;

135                                     tiptr=TNK_PTR(j);
136                                     tiptr[IBOTRD]=maxrd=ndiptr[IBOTRD];
137                                     for (l=IVOLTBL; l<(NDSIZE>>1); l++)
138                                             tiptr[l]=ndiptr[l];
139                                     cwaitm(61);
140                                     ndcomm(j+1,0,u);
141                                     cwaitm(122);
142                                     ndcomm(j+1,0,u);
143                                     tiptr[ILSTRD]=maxrd-((u[1]&255)+(u[2]<<8));
144                                     tiptr[IMAXVOL]=0;
145                                     }
146                             }
147                     }
148             for (j=0;j<20;j++) sysmap[j]=tmap[j];
149             }

150     invbox(s,i)
151             char *s;
152             int i;
153             {
                /* display string s in an inverse video box on line i */

154             fldca(i,71);
155             normcset();
156             fldca(i++,64);
157             invid();
158             fldca(i,71);
159             normcset();
160             fldca(i,64);
161             flputs("\033[4;7m ");
162             flputs(s);
163             }

164     txtft(s,j)
```

```
165                     char *s;
166                     int j;
167                     {
                        /* convert 6 inch increments in j to text on the end of string s */

168                     int ft,in;

169                     ft=(j*6+6)/12;
170                     in=(!(j&1));
171                     numout(s+strlen(s),ft);
172                     if (ft==1) strcat(s," foot");
173                     else strcat(s," feet");
174                     if (in) strcat(s,", 6 inches");
175                     }
176             dstrp(ndiptr,higage)
177                     int *ndiptr,higage;
178                     {
                        /* display strapping table entered */

179                     int j,k;

180                     normsize();
181                     for (j=0;j<3;j++)
182                             {
183                             fldca(2,k=j*15+11);
184                             normcset();
185                             fldca(2,k-9);
186                             flputs("\033[4mLvl Bbls");
187                             }
188                     for (j=0;j<higage;j++)
189                             {
190                             fldca(j%12+3,j/12*15+3);
191                             k=ndiptr[IVOLTBL+j];
192                             printf("%d %d.%d",j*6+6,k/10,k%10);
193                             }
194                     }
```

* Functions *

| | | | | | | | |
|---|---|---|---|---|---|---|---|
| gtspec | F | strcpy | *F | numout | *F | strlen | *F |
| strcat | *F | dblsize | *F | ques | *F | msg | *F |
| cwaitm | *F | nboxes | *F | getnum | *F | ndcomm | *F |
| txtft | F | chgnum | *F | dstrp | F | invbox | F |
| banner | *F | flush | *F | getkey | *F | fldca | *F |
| flcmd | *F | flputc | *F | seltnk | *F | keyoff | *F |
| normcset | *F | invid | *F | flputs | *F | normsize | *F |
| printf | *F | | | | | | |

There were no errors in compilation.

```
Line            Statement

                /* Subroutine Module to perform I/O with Nodes on a loop */

1               ininod()
2                       {
                        /* call the node loop communications initialization routine */

3       A       #asm
4       A               lhld    thiobt##                ; get the address of the jump table
5       A               lxi     d,3 * 8                 ; the offset to the second table
6       A               dad     d                       ; HL now points to the start of the node loop jump table
7       A               pchl                            ; so jump there
8       A       #endasm
9                       }

10      A       #asm
11      A               ;
12      A               ; This function is not global and is only used by the I/O routines
13      A               ;  below.
14      A               ;
15      A               ; On Entry : register C contains the function number to perform
16      A               ;
17      A               ;       FN #    Function
18      A               ;        0       Cold Start driver
19      A               ;        1       Warm Start driver
20      A               ;        2       Character Input Status
21      A               ;        3       Console Input
22      A               ;        4       Console Output
23      A               ;        5       List Output
24      A               ;        6       Punch Output
25      A               ;        7       Reader Input
26      A               ;
27      A               ; On Exit : registers as defined by the function called
28      A               ;
29      A       nodefn:
30      A               ;
31      A               mvi     b,0                     ; clear top byte
32      A               lhld    thiobt##                ; get base address of jump table
33      A               push    d
34      A               lxi     d,3 * 8                 ; offset to node jump table
35      A               dad     d                       ; HL now points to base of node table
36      A               pop     d
37      A               dad     b
38      A               dad     b
39      A               dad     b                       ; function number times 3
40      A               ;
41      A               ; HL points to the jump entry for the function entered
42      A               ;
```

```
 Line                Statement
 43      A                mov     c,e                     ; copy any param in E to C
 44      A                pchl                            ; jump to function
 45      A                ;
 46      A        #endasm

 47               nstat(trmnbr)
 48                       int trmnbr;
 49                       {
                          /* check the status of loop trmnbr */

 50      A        #asm
 51      A                pop     b
 52      A                pop     h                       ; get trmnbr to HL (NOT USED)
 53      A                push    h
 54      A                push    b
 55      A                mvi     c,2
 56      A                call    nodefn                  ; do the status call
 57      A                call    ccsxt##                 ; prepare result
 58      A        #endasm
 59                       }

 60               nputc(trmnbr,c)
 61                       int trmnbr;
 62                       char c;
 63                       {
                          /* put character c to loop using terminal trmnbr */

 64      A        #asm
 65      A                pop     d
 66      A                pop     h                       ; get character
 67      A                pop     b                       ; and terminal number (NOT USED)
 68      A                push    b
 69      A                push    h
 70      A                push    d                       ; restore stack
 71      A                ;
 72      A                mov     e,l                     ; get char to send to E
 73      A                mvi     c,4                     ; char out function
 74      A                call    nodefn                  ; and do the call
 75      A                jmp     ccsxt##                 ; return result
 76      A        #endasm
 77                       }

 78               ngetc(trmnbr)
 79                       int trmnbr;
 80                       {
                          /* get one char (or error -1) from loop on terminal trmnbr */

 81      A        #asm
```

```
Line            Statement

 82     A              lxi     h,2
 83     A              dad     sp
 84     A              mov     b,m                     ; get terminal number at (HL) (NOT USED)
 85     A              mvi     c,3                     ; char input
 86     A              call    nodefn                  ; and do it
 87     A              jmp     ccsxt##                 ; and convert return char
 88     A      #endasm
 89                    }

 90             ndcomm(nodnbr,version,s)
 91                     int nodnbr,version;
 92                     char s[];
 93                     {
                        /* address node nodnbr - request version report if set */
 94                     int trmnbr,cksum,i;

 95                     trmnbr=(nodnbr-1)/20+1;
 96                     while (nstat(trmnbr)) ngetc(trmnbr);
 97                     for (i=0;i<5;s[i++]=0);
 98                     if (version) nodnbr=nodnbr|128;
 99                     nputc(trmnbr,nodnbr);
100                     if ((s[0]=ngetc(trmnbr))==-1)
101                             {
102                             s[0]=0;
103                             return 0;
104                             }
105                     for (i=1;i<4;s[i++]=ngetc(trmnbr));
106                     s[4]=0;
107                     if (version) return 1;
108                     else    {
109                             cksum=0;
110                             for (i=0;i<4;i++) cksum=(cksum&255)+(s[i]&255);
                /* */
111                             return 1;
112                             }
113                     }


*** Functions ***

ininod    F            nstat     F
ndcomm    F

There were no errors in compilation.
```

```
Line          Statement

              /* The Fluke TSO Output Driver */

              #Include <FRAC.DEF>
        +     /* this file contains definitions peculiar to the Frac System */
        +
        +     #define HALFINCH 74      /* microseconds per 1/2 inch */
        +     #define ONEINCH 147      /* microseconds per inch */
        +     #define SIXINCH 882      /* microseconds per six inches */
        +     #define ONEFOOT 1764     /* microseconds per one foot */
        +     #define DEADZONE ONEFOOT /* dead zone in microseconds */
              #Include <FLUKE.DEF>
        +
        +     /* Global definitions for use with Fluke TSO */
        +
        +             /* These definitions are for drawing a key box display */
        +
        +     #define TLINE1 "1444444444444444444444444444444"
        +     #define TLINE2 "4444444444444444444444444444440"
        +     #define CLINE1 "9     9     9     9     9     "
        +     #define CLINE2 "9     9     9     9     9     9"
        +     #define XLINE1 "3444447444447444447444447444444"
        +     #define XLINE2 "7444447444447444447444447444442"
        +
        +             /* These definitions are screen size and formatting for the TSO */
        +
        +     #define HINDENT 10
        +     #define HSIZE 60
        +     #define VINDENT 2
        +     #define VSIZE 12
        +
        +             /* These defs cover routine I/O info */
        +
        +     #define EOL 13
        +     #define ESC 27
        +     #define BS  8
        +     #define NULL 0
        +     #define EOF (-1)
              #Include <TANKS.DEF>
        +
        +     /* Global Definitions for Offsets and such in the use of the tank structures */
        +
        +             /* First the Offsets for integer arrays */
        +
        +     #define ILSTRD 0                /* Integer - Last Reading in Microseconds */
        +     #define IPREVRD 1               /* Integer - Smoothing function value */
        +     #define IBOTRD 2                /* Integer - Microseconds to Bottom of Tank */
        +     #define IVOLUME 3               /* Integer - Current Tank Volume */
        +     #define IMAXVOL 4               /* Integer - Maximum Volume since Beginning */
```

```
Line          Statement

        +     #define IRDTIME 5                /* Char[8] - AMX Time Buffer - time of last read */
        +     #define IFLOWRATE 9              /* Integer - Calculated Flow Rate */
        +     #define IMTE 10                  /* Integer - Minutes Till Empty */
        +     #define IREVLVL 11               /* Char[4] - 4 Char Version String from Node */
        +     #define ITRIPLVL 13              /* Integer - individual tank trip level */
        +     #define IVOLTBL 14               /* Integer[72] - Volumes at every 6 inch interval */
        +
        +             /* The size of the volumes table in bytes */
        +     #define VOLLEN 64          /* up to 16 ft. in 6 inch chunks */
        +
        +             /* Sizes of an individual structure and the whole sheebang */
        +     #define NDSIZE 92          /* one structure (IVOLTBL * 2 + VOLLEN) */
        +     #define TBLSIZE 1840       /* 20 node tables */
        +
        +             /* The tank structure access defines */
        +
        +     #define TNK_PTR(item) ((item)*NDSIZE+tnknod)
1       +     extern char tnknod[];
              #Include <GROUPS.DEF>
        +
        +     /* Global Definitions for Offsets into Group Structures */
        +
        +     #define GMXVOL 0                 /* Integer - Group Maximum Volume */
        +     #define GCRVOL 2                 /* Integer - Group Current Volume */
        +     #define GFRATE 4                 /* Integer - Group Flow Rate in BPM */
        +     #define GNTANKS 6                /* Char    - Number of Tanks in Group */
        +
        +     #define ELSIZE 7                 /* Size in bytes of one element in Group Table */
        +     #define GRPSIZE 21               /* Size in bytes of Group Table */
        +
2       +     extern char grpnod[];
3       +     extern char tnktyp[];
              #Include <RATES.DEF>
        +     /* Rate Smoothing Table Offsets */
        +
        +     #define BBL0      0              /* Volume 0 in table */
        +
        +     #define BBLLEN    6              /* Number of Volume Readings          */
        +     #define RATELEN   12             /* Total Byte Elements in one entry   */
        +     #define RATESIZE 120             /* Total Entries in Smooth Table      */
4
              #define RECON 1          /* Causes contnk to force use of old tanks */
4
5             extern char sysmap[];
6             extern char rtetbl[];
7             extern int tmnode[],hlfsec[];          /* MUST BE DEFINED AS CHAR */
              extern int tnfluk,tntuch,tnnode;       /* various task numbers */
```

```
Line            Statement

 8               char job;
 9               char begtime[8];
10               char lstblk[20];
11               char typchr[4];
12               char beeper,beepen;
13               char run;
14               char barpage;                          /* boolean to determine which page */

15               main(parl,par2,par3)
16                       int parl,par2,par3;
17                       {
18      A        #asm
19      A                mov     c,m
20      A                inx     h
21      A                mov     b,m
22      A                inx     h
23      A                push    b                      ; par2 in BC -> Stack
24      A                mov     c,m
25      A                inx     h
26      A                mov     b,m
27      A                push    b                      ; parl in BC -> Stack
28      A                pop     h                      ; get it to HL
29      A                pop     b                      ; and par2 back into BC
30      A                xthl                           ; parl -> Stack ; Ret Addr -> HL
31      A                push    b                      ; par2 -> Stack
32      A                push    d                      ; par3 -> Stack
33      A                lxi     h,tend##               ; address of cleanup routine - just in case
34      A                push    h                      ; and then the return address
35      A        #endasm

36                       char tmbuf[8],tmptim[8];
37                       int i,j;

38                       if (parl)
39                               {
40                               if (run && (par2!=0))
41                                       {
42                                       if (barpage==1) dspnod(parl,par2,par3);
43                                       else if (barpage==2) dspgrp(parl,par2,par3);
44                                       else numnode(parl,par2,par3);
45                                       }
46                               else if (par2==0)       /* dead node */
47                                       {
48                                       ckill(tnnode);
49                                       flputs("\007\033[16;40H\033[1K\033[m\033[16;1H\033[1;5;7m");
50                                       printf("Tank %d is NOT RESPONDING !!!\007",parl);
51                                       }
```

```
Line        Statement

 52                    }
 53            else if (par2)
 54                    {
                       /* Refresh the Time on Display */
 55                    ctdget(tmbuf);
 56                    prtime(1,72,tmbuf);
 57                    if (job)
 58                            {
 59                            diftime(tmbuf,begtime,tmptim);
 60                            prtime(2,72,tmptim);
 61                            if (beeper&&beepen) flputc(7);
 62                            }
 63                    if (tmbuf[0]==0)        /* update rate buffers */
 64                            {
 65                            int *iptr,*jptr;

 66                            for (i=0; i<20; ++i) if (sysmap[i])
 67                                    {
 68                                    iptr=i*RATELEN+rtetbl;
 69                                    blkmov(&iptr[1],&iptr[0],(BBLLEN-1)<<1);
 70                                    jptr=i*NDSIZE+tnknod;
 71
 72                                    iptr[BBLLEN-1]=jptr[IVOLUME];
 73                                    }
 74                            }
 75                    }
 76            else if (par3)
                       {
 77                    /* touch detected */
 78                    if (!job)                       /* If Job NOT Started Yet */
 79                            {
 80                            if (par3==10 || par3==20 || par3==30)   /* Start Job */
 81                                    {
 82                                    job=1;
 83                                    barpage=1;
 84                                    beeper=0;
 85                                    beepen=1;
 86                                    ctdget(begtime);
 87                                    cctask(tnfluk,0,0,0,0,0);
 88                                    }
 89                            else if (par3==40 || par3==50 || par3==60) /* Maintenance */
 90                                    maint();
 91                            }
 92                    else if (par3==10) newpag(1);   /* select the next page */
 93                    else if (par3==20) newpag(0);   /* select the next page */
 94                    else if (par3==60)              /* Quit/Restart */
 95                            {
                               ctmstp(tmnode);
```

```
Line        Statement
 96                         clrscrn();
 97                         cwaitm(l22);            /* delay for awhile */
 98                         flush();                /* then clear the type-ahead buffer */
 99                         dblsize();
100                         if (ques("Q U I T ! ! !@Are You Sure???"))
101                                 {
102                                 clrscrn();
103                                 begin();
104                                 }
105                         cctask(tnfluk,0,0,0,0,0);
106                         flush();
107                         ctmput(tmnode,hlfsec);
108                         }
109                 else if (par3==30)                      /* Beeper On/Off */
110                         {
111                         if (beepen)
112                                 {
113                                 beeper=beepen=0;
114                                 flputs("\033[8;80H\033[m\033[8;71H\033[1;5mOFF/on");
115                                 }
116                         else    {
117                                 beepen=1;
118                                 beeper=0;
119                                 flputs("\033[8;71H\033[mON/off");
120                                 if (barpage!=2)
121                                         {
122                                         for (i=0;i<20;i++) if (sysmap[i])
123                                                 {
124                                                 if (barpage==1)
125                                                         {
126                                                         fldca(l2,i*3+4);
127                                                         flputc(' ');
128                                                         fldca(l2,i*3+2);
129                                                         flputc(' ');
130                                                         }
131                                                 else if (barpage==0)
132                                                         {
133                                                         fldca((i/4)*3+1,(i%4)*15+1);
134                                                         invid();
135                                                         }
136                                                 }
137                                         }
138                                 else for (i=0;i<3;i++)
139                                         {
140                                         fldca(2,i*20+1);
141                                         normcset();
142                                         }
143                                 }
```

```
Line        Statement
 144                        }
 145                 else if (par3==40)                    /* < Stop/Start > */
 146                        {
 147                        if (run)
 148                                {
 149                                run=0;
 150                                invbox("Mntc","Power On",12);
 151                                flputs("\033[10;80H\033[m\033[10;71H\033[1;5mSTOP/run");
 152                                ctmstp(tmnode);
 153                                flush();
 154                                }
 155                        else    {
 156                                run=1;
 157                                flputs("\033[10;71H\033[mRUN/stop");
 158                                flputs("\033[11;64H\033[0K\033[12;64H\033[0K");
 159                                ctmput(tmnode,hlfsec);
 160                                }
 161                        }
 162                 else if (par3==50 && !run) maint();
 163                 }
 164         else    {
 165                 /* setup the screen */
 166                 ctmstp(tmnode);
 167                 typchr[0]='X';  /* solid single  */
 168                 typchr[1]='.';  /* large checks  */
 169                 typchr[2]='J';  /* small checks  */
 170                 typchr[3]='<';  /* medium checks */
 171                 flputs("\033[p\033[1;66HTime");
 172                 if (job)        /* if Job has been started */
 173                        {
 174                        flputs("\033[2;66HElpsd\033[16;66HStart");
 175                        prtime(16,72,begtime);
 176                        }
 177                 else for (i=0; i<7; begtime[i++]=0);
 178                 drawkeys();
 179                 for (i=1;i<17;i++)
 180                        {
 181                        fldca(i,63);
 182                        normcset();
 183                        }
 184                 newform();
 185                 if (run) ctmput(tmnode,hlfsec);
 186                 }
         }
 187 dspnod(nodnbr,ndiptr,rate)
```

```
Line        Statement
188                 int nodnbr,ndiptr[],rate;
189                 {
                    /* Bar Chart Display for a node */

190                 int i,pcntf,mntlmt;
191                 int horpos,newblk,oldblk,oldpos,newpos,alrmpt;

192                 rate=ndiptr[IFLOWRATE];
193                 nodnbr--;
194                 pcntf=dopcntf(ndiptr);
195                 dopvol(ndiptr,nodnbr);
196                 mntlmt=ndiptr[IMTE];
197                 if ((mntlmt<0) || (mntlmt>99)) mntlmt=99;
198                 newblk=(pcntf*140)/100;         /* convert to block number */
199                 horpos=nodnbr*3+3;
200                 fldca(2,horpos-1);
201                 flputnum(mntlmt,2);
202                 if (newblk!=(oldblk=lstblk[nodnbr]&255))
203                         {
204                         if ((oldpos=oldblk/14)>=(newpos=newblk/14))
205                                 {
206                                 for (i=oldpos;i>newpos;--i)
207                                         {
208                                         fldca(12-i,horpos);
209                                         flputc(' ');
210                                         }
211                                 }
212                         else    {
213                                 for (i=oldpos; i<newpos; ++i)
214                                         {
215                                         fldca(12-i,horpos);
216                                         flputc(typchr[tnktyp[nodnbr]]+14);
217                                         }
218                                 }
219                         fldca(12-newpos,horpos);
220                         flputc((newblk%14)+typchr[tnktyp[nodnbr]]+1);
221                         lstblk[nodnbr]=newblk;
222                         }
223                 if (ckalrm(ndiptr))
224                         {
225                         beeper=1;
226                         fldca(12,horpos+1);
227                         altcset();
228                         fldca(12,horpos-1);
229                         if (rate>0) flcmd("1;4;5;8m");
230                         else flcmd("4;5;8m");
231                         }
232                 }
```

```
Line        Statement
 233         dspgrp(nodnbr,ndiptr,rate)
 234                 int nodnbr,ndiptr[],rate;
 235                 {
                     /* update the group display page */

 236                 int i,grptr,horpos;

 237                 rate=ndiptr[IFLOWRATE];
 238                 horpos=tnktyp[--nodnbr]*20+14;
 239                 grptr=tnktyp[nodnbr]*ELSIZE;
 240                 if (ckalrm(ndiptr))
 241                         {
 242                         beeper=1;
 243                         fldca(2,horpos-5);
 244                         normcset();
 245                         fldca(2,horpos-13);
 246                         flcmd("5;7m");
 247                         }
 248                 dopvol(ndiptr,nodnbr);
 249                 fldca(4,horpos);
 250                 if ((i=getgrp(grptr+GMXVOL)-getgrp(grptr+GCRVOL))<0) prtens(0,4);
 251                 else prtens(i,4);
 252                 fldca(6,horpos);
 253                 if ((i=getgrp(grptr+GFRATE))<0) prtens(0,4);
 254                 else prtens(i,4);
 255                 }

 256         numnode(nodnbr,ndiptr,rate)
 257                 int nodnbr,ndiptr[],rate;
 258                 {
                     /* Numeric Display for node */

 259                 int i,verpos,horpos;

 260                 rate=ndiptr[IFLOWRATE];
 261                 verpos=(--nodnbr/4)*3+1;
 262                 horpos=(nodnbr%4)*15+1;
 263                 if (ckalrm(ndiptr))
 264                         {
 265                         beeper=1;
 266                         fldca(verpos,horpos);
 267                         flcmd("5;7m");
 268                         }
 269                 fldca(verpos,horpos+4);
 270                 prftin(ndiptr[ILSTRD]);
 271                 fldca(++verpos,horpos+3);
 272                 flputnum(dopvol(ndiptr,nodnbr)/10,4);
```

```
Line        Statement
 273                fldca(verpos,horpos+10);
 274                if (dopcntf(ndiptr)<5) flputs("Emty");
 275                else flputnum(ndiptr[IVOLUME]/10,4);
 276                fldca(++verpos,horpos+8);
 277                prtens(rate,4);
 278                }

 279        invbox(s,t,i)
 280                char *s,*t;
 281                int i;
 282                {
                    /* display strings s and t in inverse video for a box at line i */

 283                fldca(i-1,71);
 284                normcset();
 285                fldca(i-1,64);
 286                invid();
 287                fldca(i,71);
 288                normcset();
 289                fldca(i,64);
 290                flcmd("4;7m ");
 291                flputs(s);
 292                fldca(i,72);
 293                flputs(t);
 294                }

 295        newpag(keytyp)
 296                int keytyp;
 297                {
                    /* prepare for a new page to be displayed */

 298                int i;

 299                for (i=1;i<17;i++)
 300                        {
 301                        fldca(i,62);
 302                        flcmd("1K");
 303                        }
 304                if (keytyp)
 305                        {
 306                        if (barpage==1)
 307                                {
 308                                invbox("Bars","",4);
 309                                invbox("Indv","",6);
 310                                barpage=2;
 311                                }
 312                        else    {
 313                                invbox("Grps","",4);
 314                                invbox("Indv","",6);
```

```
Line        Statement
 315                                barpage=1;
 316                                }
 317                        }
 318                else    {
 319                        if (barpage)
 320                                {
 321                                barpage=0;
 322                                invbox("Bars","",4);
 323                                invbox("Grps","",6);
 324                                }
 325                        else    {
 326                                barpage=2;
 327                                invbox("Bars","",4);
 328                                invbox("Indv","",6);
 329                                }
 330                        }
 331                newform();
 332                }

 333        newform()
 334                {
                    /* put the proper display format on the TSO dependent on the */

 335                int i,j,verpos,horpos;

 336                if (barpage==1) /* display form for Bar Graph Display */
 337                        {
 338                        flputs("\033[1;22HMinutes Till Empty\033[2;1H\033[4m\033[13;1H");
 339                        invid();
 340                        flputs(" 1");
 341                        for (i=2;i<=20;i++) flputnum(i,3);
 342                        for (i=3;i<=12;i++)
 343                                {
 344                                fldca(i,1);
 345                                altcset();
 346                                }
 347                        for (i=0;i<20;i++)
 348                                {
 349                                lstblk[i]=0;
 350                                if (sysmap[i]) dspnod(i+1,i*NDSIZE+tnknod,0);
 351                                }
 352                        }
 353                else if (barpage==2)    /* group display page */
 354                        {
 355                        altgraf();
 356                        for (i=1;i<16;i++)
 357                                {
 358                                fldca(i,20);
```

```
Line        Statement
359                             flputc('6');
360                             fldca(i,40);
361                             flputc('6');
362                             }
363                     normgraf();
364                     for (i=0;i<3;i++)
365                             {
366                             horpos=i*20+2;
367                             verpos=i*ELSIZE;
368                             fldca(2,horpos);
369                             printf("Group %d :    Tanks",i+1);
370                             fldca(2,horpos+10);
371                             flputnum(grpnod[verpos+GNTANKS],2);
372                             fldca(4,horpos);
373                             flputs("BBLs Pumped ");
374                             prtens(getgrp(verpos+GMXVOL)-getgrp(verpos+GCRVOL),4);
375                             fldca(6,horpos);
376                             flputs("  Pump Rate ");
377                             prtens(getgrp(verpos+GFRATE),4);
378                             }
379                     }
380             else    {       /* display form for Numeric Display */
381                     for (i=0;i<20;i++) if (sysmap[i])
382                             {
383                             verpos=(i/4)*3+1;
384                             horpos=(i%4)*15+1;
385                             fldca(verpos,horpos+3); normcset();
386                             fldca(verpos,horpos); invid(); flputnum(i+1,2);
387                             normcset();
388                             flputs("  0'  0.0\"");
389                             fldca(++verpos,horpos);
390                             flputs(" O:   0 I:   0");
391                             fldca(++verpos,horpos);
392                             flputs("   Rate:   0.0");
393                             normcset();
394                             fldca(verpos,horpos);
395                             flcmd("4m");
396                             numnode(i+1,i*NDSIZE+tnknod,0);
397                             }
398                     }
399             }

400     flputnum(i,width)
401             int i,width;
402             {
                /* output i in ascii right justified in a field width chars wide */

403             char s[7];
```

```
Line        Statement
404                 int j;

405                 j=strlen(numout(s,i));
406                 if (j<=width)
407                         {
408                         while (j++<width) flputc(' ');
409                         j=0;
410                         }
411                 else j=j-width;
412                 while (s[j]) flputc(s[j++]);
413                 }

414         drawkeys()
415                 {
                    /* draw the key boxes on the Fluke TSO */

416                 int i;

417                 for (i=3; i<15; ++i)
418                         {
419                         printf("\033[%d;64H\033[0K",i);
420                         if (!job)                       /* Job not started */
421                                 {
422                                 fldca(i,71);
423                                 normcset();
424                                 fldca(i,64);
425                                 if (i!=8) invid();
426                                 else flputs("\033[4;7m"); /* line break */
427                                 }
428                         }

429                 if (job)                                /* Job HAS started */
430                         {
431                         if (barpage!=1) invbox("Bars","",4);
432                         else invbox("Grps","",4);
433                         if (barpage) invbox("Indv","",6);
434                         else invbox("Grps","",6);
435                         invbox("Alrm","ON/off",8);
436                         invbox("Mode","RUN/stop",10);
437                         invbox("Quit","",14);
438                         if (!run)
439                                 {
440                                 flputs("\033[10;80H\033[m\033[10;71H\033[1;5mSTOP/run");
441                                 invbox("Mntc","Power On",12);
442                                 }
443                         if (!beepen)
444                                 {
445                                 flputs("\033[8;80H\033[m\033[8;71H\033[1;5mOFF/on");
```

```
446                                     }
447                             }
448                     else flputs("\033[6;66HSTRT\033[12;66HMNTC");
449                     }

450             diftime(inl,in2,out)
451                     char inl[],in2[],out[];
452                     {
                        /* calculate the difference between inl and in2 time buffers */

453                     int i,j;

454                     for (i=0;i<7;i++) out[i]=in2[i];
455                     out[7]=1;
456                     for (i=0;i<3;i++)
457                             {
458                             j=(inl[i]&255)-(out[i]&255);
459                             if (j<0)
460                                     {
461                                     if (i<2) j+=60;
462                                     else j+=24;
463                                     out[i+1]++;
464                                     }
465                             out[i]=j;
466                             }
467                     }

468             prtime(ver,hor,buf)
469                     int ver,hor;
470                     char buf[];
471                     {
                        /* format and print the time in buf at line ver column hor */

472                     char tmprt[25];

473                     ctdfmt(64,buf,tmprt);
474                     tmprt[8]=0;
475                     fldca(ver,hor);
476                     flputs(tmprt);
477                     }

478             prtens(i,width)
479                     int i,width;
480                     {
                        /* print i as xxx.x with width digits before the decimal point */

481                     if (i<0)
482                             {
483                             flputc('-');
```

```
Line        Statement

484                     i=(-i);
485                     --width;
486                     }
487             flputnum(i/10,width);
488             printf(".%d",i%10);
489             }

490     prftin(crntrd)
491             int crntrd;
492             {
                /* print feet and inches from reading in microseconds */

493             int ft,in;

494             ft=crntrd/ONEFOOT;
495             in=crntrd%ONEFOOT*10/ONEINCH;
496             flputnum(ft,3);
497             flputs("' ");
498             prtens(in,2);
499             flputs("\"");
500             }

501     dopcntf(ndiptr)
502             int ndiptr[];
503             {
                /* calculate the tanks percent of full */

504             int pcntf;

505             pcntf=ndiptr[ILSTRD]/(ndiptr[IBOTRD]/100);
506             if (pcntf>99) return (99);
507             if (pcntf<0) return (0);
508             return (pcntf);
509             }
510     ckalrm(ndiptr)
511             int ndiptr[];
512             {
                /* return non-zero if tank at ndiptr is in alarm */

513             return (((dopcntf(ndiptr)<10) ||
514                 ((ndiptr[ILSTRD]<ndiptr[ITRIPLVL]) && (ndiptr[ILSTRD]>=0)))
515                && (beepen));
516             }

517     dopvol(ndiptr,nodnbr)
518             int ndiptr[],nodnbr;
519             {
                /* calculate and return the pumped volume */
```

```
Line        Statement
 520                int *grptr,pmpvol,i;

 521                grptr=tnktyp[nodnbr]*ELSIZE+grpnod;
 522                i=ndiptr[IMAXVOL];
 523                pmpvol=i-ndiptr[IVOLUME];
 524                if (!job)
 525                        {
 526                        i=grptr[GMXVOL>>1];
 527                        grptr[GMXVOL>>1]=i-pmpvol;
 528                        ndiptr[IMAXVOL]=ndiptr[IVOLUME];
 529                        pmpvol=0;
 530                        }
 531                return (pmpvol);
 532                }

 533        maint()
 534                {
                    /* user has asked to do maintenance */

 535                ctmstp(tmnode);
 536                clrscrn();
 537                cwaitm(122);
 538                dblsize();
 539                if (ques("Reconfigure Tanks ?")) contnk(RECON);
 540                dblsize();
 541                if (ques("Change Strapping Tables ?"))
 542                        {
 543                        int i;
 544                        char selmap[20];

 545                        for (i=0; i<20; selmap[i++]=0);
 546                        seltnk("Select the Tanks You want to Change",selmap,sysmap);
 547                        for (i=0; i<20; ++i) if (selmap[i])
 548                                {
 549                                *(ILSTRD+ILSTRD+TNK_PTR(i))=0;
 550                                gtspec(i,RECON);
 551                                }
 552                        }
 553                dblsize();
 554                if (ques("Change Alarm Trip Points ?")) getrip(sysmap);
 555                cctask(tnfluk,0,0,0,0,0);
 556                if (run) ctmput(tmnode,hlfsec);
 557                }
```

```
*** Variables and Arrays ***

tknod    *CA          grpnod   *CA          tnktyp   *CA          sysmap   *CA
rtetbl   *CA          tmnode   *IA          hlfsec   *IA          tnfluk   *IV
tntuch   *IV          tnnode   *IV          job       CV 1        begtime   CA 8
lstblk    CA 20       typchr    CA 4        beeper    CV 1        beepen    CV 1
run       CV 1        barpage   CV 1

*** Functions ***

main      F           dspnod    F           dspgrp    F           numnode   F
ckill    *F           flputs   *F           printf   *F           ctdget   *F
prtime    F           diftime   F           flputc   *F           blkmov   *F
cctask   *F           maint     F           newpag    F           ctmstp   *F
clrscrn  *F           cwaitm   *F           flush    *F           dblsize  *F
ques     *F           begin    *F           ctmput   *F           fldca    *F
invid    *F           normcset *F           invbox    F           drawkeys  F
newform   F           dopcntf   F           dopvol    F           flputnum  F
ckalrm    F           altcset  *F           flcmd    *F           getgrp   *F
prtens    F           prftin    F           altgraf  *F           normgraf *F
strlen   *F           numout   *F           ctdfmt   *F           contnk   *F
seltnk   *F           gtspec   *F           getrip   *F

There were no errors in compilation.
Line            Statement

                #Include <FLUKE.DEF>
        +
        +       /* Global definitions for use with Fluke TSO */
        +
        +               /* These definitions are for drawing a key box display */
        +
        +       #define TLINE1 "14444444444444444444444444444"
        +       #define TLINE2 "44444444444444444444444444444440"
        +       #define CLINE1 "9     9     9     9     9     "
        +       #define CLINE2 "9     9     9     9     9     9"
        +       #define XLINE1 "34444474444474444474444474444"
        +       #define XLINE2 "74444474444474444474444474444442"
        +
        +               /* These definitions are screen size and formatting for the TSO */
        +
        +       #define HINDENT 10
        +       #define HSIZE 60
        +       #define VINDENT 2
        +       #define VSIZE 12
        +
        +               /* These defs cover routine I/O info */
        +
        +       #define EOL 13
```

```
Line          Statement
        +      #define ESC 27
        +      #define BS  8
        +      #define NULL 0
        +      #define EOF (-1)
               #Include <TANKS.DEF>
        +
        +      /* Global Definitions for Offsets and such in the use of the tank structures */
        +
        +              /* First the Offsets for integer arrays */
        +
        +      #define ILSTRD 0                /* Integer - Last Reading in Microseconds */
        +      #define IPREVRD 1               /* Integer - Smoothing function value */
        +      #define IBOTRD 2                /* Integer - Microseconds to Bottom of Tank */
        +      #define IVOLUME 3               /* Integer - Current Tank Volume */
        +      #define IMAXVOL 4               /* Integer - Maximum Volume since Beginning */
        +      #define IRDTIME 5               /* Char[8] - AMX Time Buffer - time of last read */
        +      #define IFLOWRATE 9             /* Integer - Calculated Flow Rate */
        +      #define IMTE 10                 /* Integer - Minutes Till Empty */
        +      #define IREVLVL 11              /* Char[4] - 4 Char Version String from Node */
        +      #define ITRIPLVL 13             /* Integer - individual tank trip level */
        +      #define IVOLTBL 14              /* Integer[72] - Volumes at every 6 inch interval */
        +
        +              /* The size of the volumes table in bytes */
        +      #define VOLLEN 64       /* up to 16 ft. in 6 inch chunks */
        +
        +              /* Sizes of an individual structure and the whole sheebang */
        +      #define NDSIZE 92       /* one structure (IVOLTBL * 2 + VOLLEN) */
        +      #define TBLSIZE 1840    /* 20 node tables */
        +
        +              /* The tank structure access defines */
        +      #define TNK_PTR(item) ((item)*NDSIZE+tnknod)
1       +      extern char tnknod[];
               #Include <GROUPS.DEF>
        +
        +      /* Global Definitions for Offsets into Group Structures */
        +
        +      #define GMXVOL 0                /* Integer - Group Maximum Volume */
        +      #define GCRVOL 2                /* Integer - Group Current Volume */
        +      #define GFRATE 4                /* Integer - Group Flow Rate in BPM */
        +      #define GNTANKS 6               /* Char    - Number of Tanks in Group */
        +
        +      #define ELSIZE 7                /* Size in bytes of one element in Group Table */
        +      #define GRPSIZE 21              /* Size in bytes of Group Table */
        +
2       +      extern char grpnod[];
3       +      extern char tnktyp[];
               #Include <RATES.DEF>
        +      /* Rate Smoothing Table Offsets */
        +
```

```
Line          Statement
        +     #define BBL0     0              /* Volume 0 in table */
        +
        +     #define BBLLEN   6              /* Number of Volume Readings          */
        +     #define RATELEN  12             /* Total Byte Elements in one entry   */
        +     #define RATESIZE 120            /* Total Entries in Smooth Table      */
              #Include <FRAC.DEF>
        +     /* this file contains definitions peculiar to the Frac System */
        +
        +     #define HALFINCH 74     /* microseconds per 1/2 inch */
        +     #define ONEINCH 147     /* microseconds per inch */
        +     #define SIXINCH 882     /* microseconds per six inches */
        +     #define ONEFOOT 1764    /* microseconds per one foot */
        +     #define DEADZONE ONEFOOT /* dead zone in microseconds */

              /* */

4             extern int tntuch,tnfluk,tnnode;        /* AMX Task Numbers */
5             extern int tmnode[];                    /* External Timer Address */
6             extern char run,beepen,beeper,barpage;  /* Control Varbs for STFLUK */
7             extern char job;                        /* Set if Job Started */
8             extern char datdat[];                   /* Date from last run in BBRam */
9             extern char sysmap[];                   /* Map of the Installed Tanks */

10            int  rtetbl[RATESIZE];  /* Global Rate Smoothing Table */
11            char nxtnk;             /* Global Next Tank Number Variable */
12            int hlfsec[2];          /* half second timer value */

13            main()
14                    {
15                    char selmap[20];        /* byte flags for tanks installed */
16                    int olddat;             /* set if old data should be used */
17                    char s[5],time[9];
18                    int i,j,k,*iptr;

19                    inipwr();       /* init the node loop power */
20                    ininod();       /* then the node loop I/O routines */

21                    for (j=0;j<GRPSIZE;grpnod[j++]=0);              /* Clear Group Tables */
22                    for (j=0;j<RATESIZE;rtetbl[j++]=0);             /* and Rate Table   */
23                    flush();
24                    while (!flstat())
25                            {
26                            flputs("\033[1p\033[2x\033[6;10;12;15;17p\033[v\033[13w");
27                            flputs("\033[2;14HCypher Systems");
28                            flputs("\033[3;7HMonitoring Services Division");
29                            flputs("\033[4;17HTAM-1010");
30                            flputs("\033[6;12HTOUCH        TOUCH");
```

```
Line        Statement
 31                     fldca(6,18);
 32                     block(); block();
 33                     cwaitm(61);
 34                     }
 35             cwaitm(61);
 36             flush();

        /* DEBUG */

 37             flputs("\033[1p\033[2x\033[6;10;12;15;17p\033[v\033[13w");
 38             flputs("\033[2;33H\033[m");
 39             flputs("\033[2;7H\033[1;7m Touch Activated Monitor");
 40             flputs("\033[4;12HCopyright (C) 1983");
 41             flputs("\033[5;14HCypher Systems");
 42             flputs("\033[7;11HAll Rights Reserved");
 43             cwaitm(183);
 44             flush();
 45             nboxes(0,9);
 46             for (i=0;i<8;time[i++]=0);
 47             i=getnum("Enter the Current Time in Military Time","##:##");
 48             i=(i/100)*60+(i%100);
 49             time[1]=i%60;
 50             time[2]=i/60%24;
 51             ctdset(time);
 52             flush();
 53             cwaitm(61);
 54             dblsize();

        /* check to see if we should use the old data in BBRam */

 55             if (!(olddat=getdat()))        /* set true if old data to be used */
 56                     {
 57                     for (j=0;j<TBLSIZE;tnknod[j++]=0);      /* Clear Node Tables */
 58                     savdat();
 59                     for (j=0;j<20;++j) sysmap[j]=1;
 60                     }
 61             else for (j=0;j<20;j++)
 62                     {
 63                     iptr=TNK_PTR(j);
 64                     iptr[IFLOWRATE]=0;
 65                     iptr[IVOLUME]=0;
 66                     iptr[IPREVRD]=0;
 67                     }
 68             do      {
 69                     j=contnk(olddat);
 70                     for (i=k=0;i<20;i++) if (sysmap[i]) ++k;
 71                     } while (k<1);
```

```
Line            Statement
72                      for (i=0;i<20;i++) *(ILSTRD+ILSTRD+TNK_PTR(i))=0;
73                      do      {
74                              for (i=0;i<20;i++) if (sysmap[i]) gtspec(i,olddat);
75                              dblsize();
76                              if (!(k=ques("LAST CHANCE TO CHANGE/Strapping Tables.@Are all Tables CORRECT ?")))
77                                      {
78                                      for (i=0;i<20;selmap[i++]=0);
79                                      seltnk("Select the Tanks that You want to Correct",selmap,sysmap);
80                                      for (i=0;i<20;i++) if (selmap[i])
81                                              *(ILSTRD+ILSTRD+TNK_PTR(i))=0;
82                                      flush();
83                                      }
84                              olddat=1;
85                              } while (!k);
86                      cwaitm(61);
87                      getrip(sysmap);         /* get tank trip levels */

                /*      All of the Tank Structures are now created. */

88                      bldpg(sysmap);

                /*      Figure out how many nodes we got then set service interval */

89                      for (i=j=0;i<20;i++) if (sysmap[i]) j++;
90                      hlfsec[0]=0;
91                      hlfsec[1]=122; /* ((j>1) ? 61 : 122); */

                /*      now initialize the node arrays */

92                      for (i=0; i<20; ++i)
93                              {
94                              char acc1[4],acc2[4];   /* 32 bit accumulators */

95                              iptr=TNK_PTR(i);
96                              iptr[IPREVRD]=iptr[ILSTRD];

97                              j=single(getvol(iptr,get32(&iptr[ILSTRD],acc1),acc2));
98                              iptr=i*RATELEN+rtetbl;
99                              for (k=0; k<BBLLEN; ++k) iptr[k]=j;
100                             }

                /*      Then start everybody else */

101                     cstask(tntuch);         /* Start the console watcher */
102                     run=1;                  /* Start STFLUK in the run mode */
103                     barpage=0;              /* first page displayed is bar page */
104                     beepen=beeper=0;        /* but alarm off to begin with */
```

```
Line        Statement
105                 job=0;                  /* Job has not started yet */
106                 nxtnk=0;                /* Start with Tank 0 */
107                 cctask(tnfluk,1,0,0,0,0); /* Send Init Message to Output Driver */
108                 ctdget(time);           /* Get the current time */
109                 time[7]=1;
110                 ctdset(time);           /* Set the Clock Validity Flag */
111                 tend();                 /* and COMMIT SUICIDE */
112                 }

113         getdat()
114                 {
                    /* examine the date string in BBRam. if it is not valid, return false */

115                 if (datdat[2]!='-' || datdat[5]) return 0;

116                 char msg[50];

117                 strcpy(msg,"Do you want to use the//Tables from ");
118                 strcat(msg,datdat);
119                 strcat(msg," ?");
120                 dblsize();
121                 return (ques(msg));
122                 }

123         savdat()
124                 {
                    /* prompt the user for the current month and day */

125                 int mo,da;
126                 char *strptr;

127                 normsize();
128                 nboxes(0,9);
129                 do      {
130                         mo=getnum("Enter todays date - Month and Day","##-##");
131                         da=mo%100;
132                         mo/=100;
133                         } while (mo<1 || mo>12 || da<0 || da>31);
134                 strptr=datdat;
135                 *strptr++ = (mo<10) ? ' ' : '1';
136                 *strptr++ = mo%10+'0';
137                 *strptr++ = '-';
138                 *strptr++ = da/10+'0';
139                 *strptr++ = da%10+'0';
140                 *strptr=0;
141                 }
```

```
*** Variables and Arrays ***

tnknod   *CA          grpnod   *CA          tnktyp   *CA          tntuch   *IV
tnfluk   *IV          tnnode   *IV          tmnode   *IA          run      *CV
beepen   *CV          beeper   *CV          barpage  *CV          job      *CV
datdat   *CA          sysmap   *CA          rtetbl    IA 240      nxtnk     CV 1
hlfsec    IA 4

*** Functions ***

main      F           inipwr   *F           ininod   *F           flush    *F
flstat   *F           flputs   *F           fldca    *F           block    *F
cwaitm   *F           nboxes   *F           getnum   *F           ctdset   *F
dblsize  *F           getdat    F           savdat    F           contnk   *F
gtspec   *F           ques     *F           seltnk   *F           getrip   *F
bldpg    *F           single   *F           getvol   *F           get32    *F
cstask   *F           cctask   *F           ctdget   *F           tend     *F
strcpy   *F           strcat   *F           normsize *F

There were no errors in compilation.

Line          Statement
              /* the node service routine */

              #Include <FRAC.DEF>
+             /* this file contains definitions peculiar to the Frac System */
+
+             #define HALFINCH 74      /* microseconds per 1/2 inch */
+             #define ONEINCH 147      /* microseconds per inch */
+             #define SIXINCH 882      /* microseconds per six inches */
+             #define ONEFOOT 1764     /* microseconds per one foot */
+             #define DEADZONE ONEFOOT /* dead zone in microseconds */
              #Include <TANKS.DEF>
+
+             /* Global Definitions for Offsets and such in the use of the tank structures */
+
+                     /* First the Offsets for integer arrays */
+
+             #define ILSTRD 0                /* Integer - Last Reading in Microseconds */
+             #define IPREVRD 1               /* Integer - Smoothing function value */
+             #define IBOTRD 2                /* Integer - Microseconds to Bottom of Tank */
+             #define IVOLUME 3               /* Integer - Current Tank Volume */
+             #define IMAXVOL 4               /* Integer - Maximum Volume since Beginning */
+             #define IRDTIME 5               /* Char[8] - AMX Time Buffer - time of last read */
+             #define IFLOWRATE 9             /* Integer - Calculated Flow Rate */
+             #define IMTE 10                 /* Integer - Minutes Till Empty */
+             #define IREVLVL 11              /* Char[4] - 4 Char Version String from Node */
+             #define ITRIPLVL 13             /* Integer - individual tank trip level */
+             #define IVOLTBL 14              /* Integer[72] - Volumes at every 6 inch interval */
```

```
Line          Statement
        +             /* The size of the volumes table in bytes */
        +     #define VOLLEN 64       /* up to 16 ft. in 6 inch chunks */
        +
        +             /* Sizes of an individual structure and the whole sheebang */
        +     #define NDSIZE 92       /* one structure (IVOLTBL * 2 + VOLLEN) */
        +     #define TBLSIZE 1840    /* 20 node tables */
        +
        +             /* The tank structure access defines */
        +
        +     #define TNK_PTR(item) ((item)*NDSIZE+tnknod)
1       +     extern char tnknod[];
              #Include <GROUPS.DEF>
        +
        +     /* Global Definitions for Offsets into Group Structures */
        +
        +     #define GMXVOL 0                /* Integer - Group Maximum Volume */
        +     #define GCRVOL 2                /* Integer - Group Current Volume */
        +     #define GFRATE 4                /* Integer - Group Flow Rate in BPM */
        +     #define GNTANKS 6               /* Char    - Number of Tanks in Group */
        +
        +     #define ELSIZE 7                /* Size in bytes of one element in Group Table */
        +     #define GRPSIZE 21              /* Size in bytes of Group Table */
        +
2       +     extern char grpnod[];
3       +     extern char tnktyp[];
              #Include <RATES.DEF>
        +     /* Rate Smoothing Table Offsets */
        +
        +     #define BBL0     0              /* Volume 0 in table */
        +
        +     #define BBLLEN   6              /* Number of Volume Readings          */
        +     #define RATELEN  12             /* Total Byte Elements in one entry   */
        +     #define RATESIZE 120            /* Total Entries in Smooth Table      */

4             extern char nxtnk;
5             extern char sysmap[];
6             extern int tnfluk;
7             extern char rtetbl[];

8             main()
9                     {
10                    char s[6],      /* the node results array */
11                         acc1[4],
12                         acc2[4];   /* two 32-bit accumulators */

13                    int *ndiptr,    /* temporary tank structure pointer */
14                        *rtiptr,    /* temporary rate structure pointer */
15                        grptr,      /* groups structure pointer */
```

```
Line            Statement
16                          crdsec;     /* time calculations variable */

17                      int i,j;        /* garbage work varbs */
18                      int tgvol,tgrate;

19                      while (sysmap[nxtnk]!=1) if (++nxtnk>=20) nxtnk=0;
20                      if (ndcomm(nxtnk+1,0,s))
21                              {
22                              ctdget(&ndiptr[IRDTIME]);
23                              ndiptr=nxtnk*NDSIZE+tnknod;     /* set temp tank structure pointer */
24                              grptr=tnktyp[nxtnk]*ELSIZE;
25                              rtiptr=nxtnk*RATELEN+rtetbl;
26                              tgvol=getgrp(grptr+GCRVOL)-ndiptr[IVOLUME];
27                              tgrate=getgrp(grptr+GFRATE)-ndiptr[IFLOWRATE];
28                              double(acc2,*(1+s));
29                              sub32(get32(&ndiptr[IBOTRD],acc1),acc2);

30                              if (acc1[0]) /* sign byte non-zero */ /* current read > max read */
31                                      get32(&ndiptr[IBOTRD],acc2); /* so copy max to current */

32                              put32(&ndiptr[ILSTRD],sub32(get32(&ndiptr[IBOTRD],acc1),acc2));
33                              put32(&ndiptr[IVOLUME],getvol(ndiptr,get32(&ndiptr[ILSTRD],acc1),acc2));
34                              putgrp(grptr+GCRVOL,tgvol+ndiptr[IVOLUME]);

35                              ndiptr[IFLOWRATE]=((0+rtiptr[0])-rtiptr[BBLLEN-1])/(BBLLEN-1);
36                              ndiptr[IMTE]=ndiptr[IVOLUME]/ndiptr[IFLOWRATE];
37                              putgrp(grptr+GFRATE,tgrate+ndiptr[IFLOWRATE]);
38                              cctask(tnfluk,0,2,nxtnk+1,ndiptr,0);
39                              }
40                      else    {       /* sensor is dead - signal stfluk about it */
41                              cctask(tnfluk,0,0,nxtnk+1,0,0);
42                              }
43                      if (++nxtnk>=20) nxtnk=0;
44                      }
*** Variables and Arrays ***

tnknod   *CA          grpnod   *CA          tnktyp   *CA          nxtnk    *CV
sysmap   *CA          tnfluk   *IV          rtetbl   *CA

*** Functions ***

main      F           ndcomm   *F           ctdget   *F           getgrp   *F
double   *F           sub32    *F           get32    *F           put32    *F
getvol   *F           putgrp   *F           cctask   *F

There were no errors in compilation.
```

```
Line            Statement
                /* This routine watches the console input from the Fluke TSO */

1               extern int tnfluk;      /* so we can call it */

2               main()
3                       {
4                       char s[6];

5                       flush();
6                       while (1)
7                               {
8                               while ((s[0]=flgetc())<0);
9                               flgets(s+1);
10                              cctask(tnfluk,1,0,0,0,numin(s));
11                              flush();
12                              }
13                      }
*** Variables and Arrays ***

tnfluk   *IV
*** Functions ***

main      F            flush    *F            flgetc   *F            flgets   *F
cctask   *F            numin    *F

There were no errors in compilation.
                /* Utility Routines for tank data manipulation */

                #Include <FRAC.DEF>
        +       /* this file contains definitions peculiar to the Frac System */
        +
        +       #define HALFINCH 74     /* microseconds per 1/2 inch */
        +       #define ONEINCH 147     /* microseconds per inch */
        +       #define SIXINCH 882     /* microseconds per six inches */
        +       #define ONEFOOT 1764    /* microseconds per one foot */
        +       #define DEADZONE ONEFOOT /* dead zone in microseconds */
                #Include <TANKS.DEF>
        +
        +       /* Global Definitions for Offsets and such in the use of the tank structures */
        +
        +               /* First the Offsets for integer arrays */
        +
        +       #define ILSTRD 0                /* Integer - Last Reading in Microseconds */
        +       #define IPREVRD 1               /* Integer - Smoothing function value */
        +       #define IBOTRD 2                /* Integer - Microseconds to Bottom of Tank */
        +       #define IVOLUME 3               /* Integer - Current Tank Volume */
        +       #define IMAXVOL 4               /* Integer - Maximum Volume since Beginning */
```

```
Line          Statement
        +     #define IRDTIME 5              /* Char[8] - AMX Time Buffer - time of last read */
        +     #define IFLOWRATE 9            /* Integer - Calculated Flow Rate */
        +     #define IMTE 10                /* Integer - Minutes Till Empty */
        +     #define IREVLVL 11             /* Char[4] - 4 Char Version String from Node */
        +     #define ITRIPLVL 13            /* Integer - individual tank trip level */
        +     #define IVOLTBL 14             /* Integer[72] - Volumes at every 6 inch interval */
        +
        +             /* The size of the volumes table in bytes */
        +     #define VOLLEN 64       /* up to 16 ft. in 6 inch chunks */
        +
        +             /* Sizes of an individual structure and the whole sheebang */
        +     #define NDSIZE 92       /* one structure (IVOLTBL * 2 + VOLLEN) */
        +     #define TBLSIZE 1840    /* 20 node tables */
        +
        +             /* The tank structure access defines */
        +
        +     #define TNK_PTR(item) ((item)*NDSIZE+tnknod)
1       +     extern char tnknod[];
              #Include <GROUPS.DEF>
        +
        +     /* Global Definitions for Offsets into Group Structures */
        +
        +     #define GMXVOL 0                /* Integer - Group Maximum Volume */
        +     #define GCRVOL 2                /* Integer - Group Current Volume */
        +     #define GFRATE 4                /* Integer - Group Flow Rate in BPM */
        +     #define GNTANKS 6               /* Char    - Number of Tanks in Group */
        +
        +     #define ELSIZE 7                /* Size in bytes of one element in Group Table */
        +     #define GRPSIZE 21              /* Size in bytes of Group Table */
        +
2       +     extern char grpnod[];
3       +     extern char tnktyp[];
4             getvol(ndiptr,crntrd,outbuf)
5                     int ndiptr[];
6                     char crntrd[],outbuf[];
7                     {
                      /* interpolate the volume for the current reading */

8                     int tmptr;
9                     char vol0[4],lvl0[4],accl[4];

10                    div32(dblcpy(vol0,crntrd),double(accl,SIXINCH));
11                    tmptr=single(vol0);
12                    get32(&ndiptr[IVOLTBL+tmptr],outbuf);
13                    if (tmptr>0) get32(&ndiptr[IVOLTBL+tmptr-1],vol0);
14                    else double(vol0,0);
15                    dblcpy(lvl0,crntrd);
16                    mod32(lvl0,double(accl,SIXINCH));
```

```
Line        Statement
17                  mul32(sub32(outbuf,vol0),lvl0);
18                  div32(outbuf,double(accl,SIXINCH));
19                  return add32(outbuf,vol0);
20                  }

21          getrip(sysmap)
22                  char sysmap[];
23                  {
                    /* get the individual trip levels for tanks */

24                  int alrmpt,i;
25                  char selmap[20];

26                  do      {
27                          nboxes(0,9);
28                          if ((i=getnum("Enter a Low Fluid Level Alarm Trip Point",
29                                  "## ft, ## in"))==0) break;
30                          alrmpt=(i/100*12+i%100) * ONEINCH;
31                          for (i=0; i<20; selmap[i++]=0);
32                          seltnk("Select Tanks with this Alarm Trip Point",selmap,sysmap);
33                          for (i=0; i<20; ++i) if (selmap[i]) *(ITRIPLVL+ITRIPLVL+TNK_PTR(i))=alrmpt;
34                          } while (1);
35                  }

36          get32(addr,buf)
37                  char *addr,buf[];
38                  {
                    /* get a tank parameter into 32-bit register buf */

39                  buf[0]=buf[1]=0;
40                  buf[3]=*addr++;
41                  buf[2]=*addr;
42                  return buf;
43                  }

44          put32(addr,buf)
45                  char *addr,buf[];
46                  {
                    /* put 32-bit register in tank parameter at addr */
47                  *addr++=buf[3];
48                  *addr=buf[2];
49                  return buf;
50                  }

51          getgrp(i)
52                  int i;
53                  {
                    /* return the integer at group address i */
```

```
Line            Statement
54                      return *(i+grpnod);
55                      }

56              putgrp(i,par)
57                      int i,par;
58                      {
                        /* put par into group structure at address i */

59                      *(i+grpnod)=par;
60                      }
*** Variables and Arrays ***

tknod   *CA             grpnod   *CA            tnktyp   *CA

*** Functions ***

getvol    F             div32    *F             dblcpy   *F             double   *F
single   *F             get32     F             mod32    *F             mul32    *F
sub32    *F             add32    *F             getrip    F             nboxes   *F
getnum   *F             seltnk   *F             put32     F             getgrp    F
putgrp    F

There were no errors in compilation.
                /* Utility programs for use with CMAC */

1               aschex(c)
2                       char c;
3                       {
                        /* convert the hex ASCII char in c to binary and return */

4       A       #asm
5       A               pop     b
6       A               pop     h
7       A               push    h
8       A               push    b
9       A               ;
10      A               ; char now in HL
11      A               ;
12      A               mov     a,l             ; put char in A
13      A               cpi     '0'
14      A               jc      ahxbad          ; bad char
15      A               cpi     '9'+1
16      A               jnc     ahxltr          ; no cy - check for proper letter
17      A               ;
18      A               ; char is '0'..'9'
19      A               ;
20      A               ani     0fh             ; mask out upper nibble
21      A               jmp     ahxret
22      A               ;
```

```
Line            Statement
23      A       ahxltr: cpi     'A'
24      A               jc      ahxbad          ; not valid letter either
25      A               cpi     'F'+1
26      A               jnc     ahxbad          ; again invalid letter
27      A               ;
28      A               ; char is 'A'..'F'
29      A               ;
30      A               sui     'A'-10          ; convert to binary
31      A       ahxret: jmp     ccsxt##         ; sign extend into HL and return
32      A               ;
33      A               ; char was not a valid hex digit
34      A               ;
35      A       ahxbad: mvi     a,0             ; default to zero
36      A               jmp     ccsxt##         ; and return it
37      A               ;
38      A       #endasm
39                      }

40              hexasc(i)
41                      int i;
42                      {
                        /* convert the lower 4 bits of i to an ASCII hex character */

43      A       #asm
44      A               pop     b
45      A               pop     h
46      A               push    h
47      A               push    b
48      A               ;
49      A               ; integer now in HL
50      A               ;
51      A               mov     a,l
52      A               ani     0fh             ; get lower nibble (4 bits)
53      A               ori     '0'
54      A               cpi     '9'+1           ; check for non-digit hex char
55      A               jc      hxaret
56      A               ;
57      A               ; nibble greater than 9 - generate letter hex char
58      A               ;
59      A               adi     7
60      A               ;
61      A       hxaret: jmp     ccsxt##         ; return sign extended char in hl
62      A               ;
63      A       #endasm
64                      }

65              hxbyin(s)
66                      char *s;
67                      {
```

```
Line            Statement
                        /* convert hex byte (2 chars) from s and return */

68                      return((aschex(*s)<<4)+aschex(*(s+1)));
69                      }
70              hxwdin(s)
71                      char *s;
72                      {
                        /* convert hex word (4 chars - MSB first) and return */

73                      return((hxbyin(s)<<8)+hxbyin(s+2));
74                      }
*** Variables and Arrays ***


*** Functions ***

aschex    F             hexasc    F             hxbyin    F             hxwdin    F

There were no errors in compilation.
```

```
                        TITLE FRACAM AMX Tables for FRAC
                ;
                ;BUILT 17:03 6/24/83
                ;AN AMX CONFIGURATION MODULE DEFINING ALL
                ;TASKS, TIMERS, QUEUES, STACKS, ETC. REQUIRED
                ;BY AMX FOR PROPER OPERATION
                ;(BUILT BY THE KADAK AMX CONFIGURATION BUILDER  (PN753-00))
                ;
                ;ENTRY POINTS REQUIRED BY AMX
                ;
                        ENTRY   AMTDT           ;TASK DEFINITION TABLE
                        ENTRY   AMTCBL          ;TCB LIST
                        ENTRY   AMSYSQ          ;SYSTEM QUEUE
                        ENTRY   AMNUMQ          ;# OF QUEUE PARAMETER BLOCKS
                        ENTRY   AMCLKP          ;CLOCK PERIOD
                        ENTRY   AMNTMR          ;NUMBER OF TIMERS
                        ENTRY   AMTMRL          ;TIMER LIST
                        ENTRY   AMTMRR          ;TIMER SUBROUTINE LIST
                        ENTRY   AMISTK          ;INTERRUPT STACK
                ;
                ;ENTRY POINTS REQUIRED BY TIME/DATE
                ;
                        ENTRY   TDFREQ          ;# SYSTEM TICKS PER SECOND
                        ENTRY   TDTMA           ;TIME/DATE TIMER
                        ENTRY   TDTN            ;TIME/DATE TASK#
                        ENTRY   TDRAMA          ;TIME/DATE RAM AREA
                        ENTRY   TDSHED          ;USER SCHEDULER
                ;
```

```
                        ;
                        ;ENTRY POINTS TO PARAMETERS DEFINED IN THIS MODULE
                        ;
                        ;TASK NUMBERS
                                ENTRY   TNTMR,TNTD,TNTUCH,TNFLUK,TNNODE,TNFRAC
                        ;
                        ;TASK STACKS
                                ENTRY   SPTMR,SPTD,SPTUCH,SPFLUK,SPNODE,SPFRAC
                        ;
                        ;TIMERS
                                ENTRY   TMTD,TMNODE
                        ;
                                PAGE
                        ;EXTERNAL LINKS TO AMX AND THE TASKS
                        ;
                        ;TASK START ADDRESSES
                                EXTRN   STTMR,STTD,STTUCH,STFLUK,STNODE,STFRAC
                        ;
                        ;RESTART PROCEDURES
                                EXTRN   RRTD,RRTIMR,RRTH,RRFRAC
                        ;
                        ;TIMER SUBROUTINES
                                EXTRN   TRTD,TRNODE
                        ;
                        ;USER SCHEDULER ROUTINE
                                EXTRN   DSPTIM
                        ;
                        ;
                                PAGE
                        ;PROM BEGINS HERE
                        ;
0000'                           CSEG
                        ;
                        ;AMX USER PARAMETER TABLE
                        ;(SECTION 2.2 OF AMX REFERENCE MANUAL)
                        ;
0000'   001C'           AMTDT:  DW      USRTDT          ;A(TASK DEFINITION TABLE)
0002'   0233"           AMTCBL: DW      USRTCB          ;A(TCB LIST)
0004'   0011"           AMSYSQ: DW      SYSQ            ;A(SYSTEM QUEUE)
0006'   0028            AMNUMQ: DW      NQB             ;# OF QUEUE PARAMETER BLOCKS
0008'   0001            AMCLKP: DW      TPSYS           ;CLOCK PERIOD (SYSTEM TICKS)
000A'   0002            AMNTMR: DW      NTMR            ;NUMBER OF TIMERS
000C'   0000"           AMTMRL: DW      TMLST           ;A(TIMER LIST)
000E'   0064'           AMTMRR: DW      TRLST           ;A(TIMER SUBROUTINE LIST)
0010'   0334"           AMISTK: DW      SPINT           ;A(INTERRUPT STACK)
                        ;
                        ;TIME/DATE USER PARAMETER TABLE
                        ;(SECTION 2.2 OF TIME/DATE REFERENCE MANUAL)
                        ;
```

```
0012'   007A        TDFREQ: DW      122             ;# OF SYSTEM TICKS IN 1 SECOND
0014'   0000"       TDTMA:  DW      TMTD            ;A(TIME/DATE TIMER)
0016'   0001        TDTN:   DW      1               ;TIME/DATE TASK #
0018'   0008"       TDRAMA: DW      TDRAM           ;A(TIME/DATE RAM)
001A'   0000*       TDSHED: DW      DSPTIM          ;A(USER SCHEDULER)
                    ;
                    ;TASK DEFINITION TABLE
                    ;(SECTION 2.3 OF AMX REFERENCE MANUAL)
                    ;
001C'               USRTDT:
                    ;
                    ;AMX TIMER TASK (#0) IS THE HIGHEST PRIORITY
                    ;TASK #     0
001C'   0000*               DW      STTMR           ;START ADDRESS
001E'   0374"               DW      SPTMR           ;STACK ADDRESS
0020'   00                  DB      0               ;LEVEL 0 (UNUSED)
0021'   00                  DB      0               ;LEVEL 1 (UNUSED)
0022'   00                  DB      0               ;LEVEL 2 (UNUSED)
0023'   00                  DB      0               ;LEVEL 3 (UNUSED)
                    ;
                    ;TASK #     1
0024'   0000*               DW      STTD            ;START ADDRESS
0026'   03A2"               DW      SPTD            ;STACK ADDRESS
0028'   00                  DB      0               ;LEVEL 0 (UNUSED)
0029'   00                  DB      0               ;LEVEL 1 (UNUSED)
002A'   00                  DB      0               ;LEVEL 2 (UNUSED)
002B'   00                  DB      0               ;LEVEL 3 (UNUSED)
                    ;
                    ;TASK #     2
002C'   0000*               DW      STTUCH          ;START ADDRESS
002E'   0402"               DW      SPTUCH          ;STACK ADDRESS
0030'   00                  DB      0               ;LEVEL 0 (UNUSED)
0031'   00                  DB      0               ;LEVEL 1 (UNUSED)
0032'   00                  DB      0               ;LEVEL 2 (UNUSED)
0033'   00                  DB      0               ;LEVEL 3 (UNUSED)
                    ;
                    ;TASK #     3
0034'   0000*               DW      STNODE          ;START ADDRESS
0036'   0702"               DW      SPNODE          ;STACK ADDRESS
0038'   00                  DB      0               ;LEVEL 0 (UNUSED)
0039'   00                  DB      0               ;LEVEL 1 (UNUSED)
003A'   00                  DB      0               ;LEVEL 2 (UNUSED)
003B'   00                  DB      0               ;LEVEL 3 (UNUSED)
                    ;
                    ;TASK #     4
003C'   0000*               DW      STFLUK          ;START ADDRESS
003E'   0602"               DW      SPFLUK          ;STACK ADDRESS
0040'   04                  DB      4               ;LEVEL 0
0041'   00                  DB      0               ;LEVEL 1 (UNUSED)
```

```
0042'   3C                      DB      60              ;LEVEL 2
0043'   01                      DB      1               ;LEVEL 3
                        ;
                        ;TASK #     5
0044'   0000*            *      DW      STFRAC          ;START ADDRESS
0046'   0982"                   DW      SPFRAC          ;STACK ADDRESS
0048'   00                      DB      0               ;LEVEL 0 (UNUSED)
0049'   00                      DB      0               ;LEVEL 1 (UNUSED)
004A'   00                      DB      0               ;LEVEL 2 (UNUSED)
004B'   00                      DB      0               ;LEVEL 3 (UNUSED)
                        ;
0006                    NT      EQU     ($-USRTDT)/8    ;NUMBER OF TASKS
004C'   0000                    DW      0               ;END OF LIST
                        ;
                        ;
                        ;RESTART PROCEDURES IN ORDER OF EXECUTION
                        ;
004E'   0000*                   DW      RRTD
0050'   0000*                   DW      RRTIMR
0052'   0000*                   DW      RRTH
0054'   0000*                   DW      RRFRAC
                        ;
0056'   0000                    DW      0               ;END OF TABLE
                        ;
                        ;
                        ;TABLE OF INTEGER TASK NUMBERS
                        ;
0058'   0000            TNTMR:  DW      0
005A'   0001            TNTD:   DW      1
005C'   0002            TNTUCH: DW      2
005E'   0003            TNNODE: DW      3
0060'   0004            TNFLUK: DW      4
0062'   0005            TNFRAC: DW      5
                        ;
                                PAGE
                        ;DEFINE PERIOD OF SYSTEM CLOCK =    8.197 MS
                        ;(SECTION 2.2 OF AMX REFERENCE MANUAL)
                        ;
0001                    TPSYS   EQU     1               ;1 INTERRUPTS/SYSTEM TICK
                        ;
                        ;TIMER SUBROUTINE LIST
                        ;(SECTION 2.6 OF AMX REFERENCE MANUAL)
                        ;
0064'                   TRLST:
                        ;
0064'   0000*                   DW      TRTD
0066'   0000*                   DW      TRNODE
                        ;
                                PAGE
```

```
                    ;RAM BEGINS HERE
                    ;
0068'                       DSEG
                    ;
                    ;TIMER LIST
                    ;(SECTION 2.6 OF AMX REFERENCE MANUAL)
                    ;
0000"               TMLST:
                    ;
0000"               TMTD:    DS      4                ;TIMER 1
0004"               TMNODE:  DS      4                ;NODE TASK RESTART TIMER
                    ;
                    ;
0002                NTMR     EQU     ($-TMLST)/4      ;# OF TIMERS
                    ;
                    ;
                    ;TIME/DATE RAM ALLOCATION
                    ;(SECTION 2.6 OF TIME/DATE REFERENCE MANUAL)
                    ;
0008"               TDRAM:   DS      1                ;TIME INTERLOCK FLAG
0009"                        DS      1                ;SECOND
000A"                        DS      1                ;MINUTE
000B"                        DS      1                ;HOUR
000C"                        DS      1                ;DAY
000D"                        DS      1                ;MONTH
000E"                        DS      1                ;YEAR
000F"                        DS      1                ;DAY OF WEEK
0010"                        DS      1                ;VALIDITY FLAG
                    ;
                    ;
                    ;SYSTEM QUEUE INFORMATION
                    ;(SECTION 2.2 OF AMX REFERENCE MANUAL)
                    ;
0028                NQB      EQU     40               ;# OF QUEUE PARAMETER BLOCKS
                    ;
                    ;SYSTEM AND TASK QUEUES
                    ;(SECTION 2.5 OF AMX REFERENCE MANUAL)
                    ;
0011"               SYSQ:    DS      4+(10*NQB)       ;SYSTEM QUEUE
                    ;                                 ;NO Q FOR TIMER TASK
                    ;TASK #1 (TD)                     ;NO Q FOR THIS TASK
                    ;
                    ;TASK #2 (TUCH)                   ;NO Q FOR THIS TASK
                    ;
                    ;TASK #3 (FLUK)
01A5"                        DS      4+(2*4)          ;LEVEL 0 Q
                    ;                                 ;LEVEL 1 Q (UNUSED)
01B1"                        DS      4+(2*60)         ;LEVEL 2 Q
022D"                        DS      4+(2*1)          ;LEVEL 3 Q
                    ;
```

```
                        ;TASK #4 (NODE)                 ;NO Q FOR THIS TASK
                        ;
                        ;TASK #5 (FRAC)                 ;NO Q FOR THIS TASK
                        ;
                        ;
                        ;
                        ;TASK CONTROL BLOCK (TCB) LIST
                        ;(SECTION 2.4 OF AMX REFERENCE MANUAL)
                        ;
0233"                   USRTCB: DS      (32*NT)+1       ;ONE TCB PER TASK+DELIMITER
                        ;
                        ;
                        ;
                        ;STACKS FOR TASKS AND INTERRUPTS
                        ;(SECTION 2.7 OF AMX REFERENCE MANUAL)
                        ;
02F4"                           DS      64
0334"                   SPINT   EQU     $               ;INTERRUPT STACK
                        ;
0334"                           DS      64
0374"                   SPTMR   EQU     $               ;TIMER TASK
                        ;
0374"                           DS      46
03A2"                   SPTD    EQU     $               ;TASK TD
                        ;
03A2"                           DS      96
0402"                   SPTUCH  EQU     $               ;TASK TUCH
                        ;
0402"                           DS      512
0602"                   SPFLUK  EQU     $               ;TASK FLUK
                        ;
0602"                           DS      256
0702"                   SPNODE  EQU     $               ;TASK NODE
                        ;
0702"                           DS      640
0982"                   SPFRAC  EQU     $               ;TASK FRAC
                        ;
                        ;
                        ;
                                END
Macros:

Symbols:
0008I'  AMCLKP          0010I'  AMISTK          000AI'  AMNTMR
0006I'  AMNUMQ          0004I'  AMSYSQ          0002I'  AMTCBL
0000I'  AMTDT           000CI'  AMTMRL          000EI'  AMTMRR
001A*   DSPTIM          0028    NQB             0006    NT
0002    NTMR            0054*   RRFRAC          004E*   RRTD
0052*   RRTH            0050*   RRTIMR          0602I"  SPFLUK
```

```
0982I"  SPFRAC     0334"   SPINT      0702I"  SPNODE
03A2I"  SPTD       0374I"  SPTMR      0402I"  SPTUCH
003C*   STFLUK     0044*   STFRAC     0034*   STNODE
0024*   STTD       001C*   STTMR      002C*   STTUCH
0011"   SYSQ       0012I'  TDFREQ     0008"   TDRAM
0018I'  TDRAMA     001AI'  TDSHED     0014I'  TDTMA
0016I'  TDTN       0000"   TMLST      0004I"  TMNODE
0000I"  TMTD       0060I'  TNFLUK     0062I'  TNFRAC
005EI'  TNNODE     005AI'  TNTD       0058I'  TNTMR
005CI'  TNTUCH     0001    TPSYS      0064'   TRLST
0066*   TRNODE     0064*   TRTD       0233"   USRTCB
001C'   USRTDT

No Fatal error(s)
```

```
                         TITLE   FRSTRT  FRAC Start Module - ROM BASED
                         SUBTTL  COPYRIGHT (C) 1983 CYPHER SYSTEMS
                         ;
                         ;
F880            PBASE    EQU     0F880H
F880            PAIO     EQU     PBASE
F881            PBIO     EQU     PBASE+1
F882            PCIO     EQU     PBASE+2
F884            PADDR    EQU     PBASE+4
F885            PBDDR    EQU     PBASE+5
F886            PCDDR    EQU     PBASE+6
F888            PABC     EQU     PBASE+8
F889            PBBC     EQU     PBASE+9
F88A            PCBC     EQU     PBASE+10
F88C            PABS     EQU     PBASE+12
F88D            PBBS     EQU     PBASE+13
F88E            PCBS     EQU     PBASE+14
F887            PAMDR    EQU     PBASE+7
                         ;
F890            T0LSB    EQU     PBASE+16
F891            T0MSB    EQU     PBASE+17
F892            T1LSB    EQU     PBASE+18
F893            T1MSB    EQU     PBASE+19
F894            T0STOP   EQU     PBASE+20
F895            T0STRT   EQU     PBASE+21
F896            T1STOP   EQU     PBASE+22
F897            T1STRT   EQU     PBASE+23
F898            T0CMD    EQU     PBASE+24
F899            T1CMD    EQU     PBASE+25
                         ;
                         PAGE
```

```
                                ;*********************************
                                ; Restart Vectors and Reset Jump  *
                                ;*********************************
                                ;
0000'                           CSEG
                                ;
0000'                   BOOT:
                                ORG     0*8                     ; Restart 0
0000'   F3                      DI
0001'   C3 0110'                JMP     BEGIN
                                ;
                                ORG     1*8                     ; Restart 1
0008'   C3 003F'                JMP     DMYINT                  ; (undefined)
                                ;
                                ORG     2*8                     ; Restart 2
0010'   C3 003F'                JMP     DMYINT                  ; (undefined)
                                ;
                                ORG     3*8                     ; Restart 3
0018'   C3 003F'                JMP     DMYINT                  ; (undefined)
                                ;
                                ORG     4*8                     ; Restart 4
0020'   C3 003F'                JMP     DMYINT                  ; (undefined)
                                ;
                                ORG     5*8                     ; Restart 5
0028'   C3 003F'                JMP     DMYINT                  ; (undefined)
                                ;
                                ORG     5*8+4                   ; Restart 5.5 (.5 sec int)
002C'   C3 0069'                JMP     TGLLED                  ; Flash the LED
                                ;
                                ORG     6*8                     ; Restart 6
0030'   C3 003F'                JMP     DMYINT                  ; (undefined)
                                ;
                                ORG     6*8+4                   ; Restart 6.5 (8 msec int)
0034'   C3 016B'                JMP     CLKISP
                                ;
                                ORG     7*8                     ; Restart 7
0038'   C3 003F'                JMP     DMYINT                  ; (undefined)
                                ;
                                ORG     7*8+4                   ; Restart 7.5 (Restart A)
003C'   C3 003F'                JMP     DMYINT                  ; (undefined)
                                ;
                                ;
003F'   FB              DMYINT: EI
0040'   C9                      RET                             ; Dummy Interrupt Routine
                                ;
                                ;
                                ORG     066H                    ; NMI Interrupt
0066'   C3 003F'                JMP     DMYINT                  ; (undefined)
                                ;
                                PAGE
```

```
                                ;
                                ;*************************
                                ; LED Flasher Routines   *
                                ;*************************
                                ;
0069'                   TGLLED: ; Clear the .5 sec interrupt flop and toggle the LED
                                ;
0069'   F5                      PUSH    PSW
006A'   3A 0000"                LDA     CTLWDT                  ; get the last LED value
006D'   2F                      CMA                             ; and complement it
006E'   32 0000"                STA     CTLWDT
0071'   B7                      ORA     A                       ; set flags
0072'   CA 007D'                JZ      TGL01
                                ;
                                ; turn on the LED
                                ;
0075'   3E 10                   MVI     A,00010000B
0077'   32 F88D                 STA     PBBS
007A'   C3 0082'                JMP     TGL02
                                ;
007D'                   TGL01:  ; turn off the LED
                                ;
007D'   3E 10                   MVI     A,00010000B
007F'   32 F889                 STA     PBBC
                                ;
0082'   3E 40           TGL02:  MVI     A,01000000B
0084'   32 F889                 STA     PBBC
0087'   32 F88D                 STA     PBBS
                                ;
                                ; All done - Cleanup stack and return
                                ;
008A'   F1                      POP     PSW
008B'   FB                      EI
008C'   C9                      RET
                                ;
008D'                   CLR19:  ; clear and re-enable the 1.9 Hz interrupt
                                ;
008D'   3E 40                   MVI     A,01000000B
008F'   32 F889                 STA     PBBC
0092'   32 F88D                 STA     PBBS
0095'   C9                      RET
                                ;
0096'                   CLR122: ; clear and re-enable the 122 Hz interrupt
                                ;
0096'   3E 20                   MVI     A,00100000B
0098'   32 F889                 STA     PBBC
009B'   32 F88D                 STA     PBBS
009E'   C9                      RET
                                ;
```

```
009F'                          UINIT:  ; Initialize the UARTs
                                       ;
009F'   AF                             XRA     A
00A0'   D3 02                          OUT     02H                     ; loop 1
00A2'   D3 C2                          OUT     0C2H                    ; the Fluke TSO
00A4'   3E 1D                          MVI     A,1DH
00A6'   D3 02                          OUT     02H
00A8'   D3 C2                          OUT     0C2H
00AA'   3E 9D                          MVI     A,9DH
00AC'   D3 02                          OUT     02H
00AE'   D3 C2                          OUT     0C2H
00B0'   C9                             RET
                                       ;
                                       PAGE
                                       ;
                                       ;*******************************
                                       ; Interrupt Mode 2 Jump Table  *
                                       ;*******************************
                                       ;
                                       ;
                                       ORG     0100H
                                       ;
0100'   0000*                  M2ITBL: DW      T2ISP##                 ; Vector 0 - Loop 1
0102'   003F'                          DW      DMYINT                  ; Vector 1 - (undefined)
0104'   003F'                          DW      DMYINT                  ; Vector 2 - (undefined)
0106'   003F'                          DW      DMYINT                  ; Vector 3 - (undefined)
0108'   003F'                          DW      DMYINT                  ; Vector 4 - (undefined)
010A'   003F'                          DW      DMYINT                  ; Vector 5 - (undefined)
010C'   003F'                          DW      DMYINT                  ; Vector 6 - (undefined)
010E'   0000*                          DW      T1ISP##                 ; Vector 7 - Fluke TSO
                                       ;
                                       ;
                                       PAGE
                                       ;
                                       ;*******************************
                                       ; Initialize the Environment   *
                                       ;*******************************
                                       ;
0110'                          BEGIN:: ; beginning point for system init
                                       ;
                                       ;
0110'   F3                             DI                              ; make sure nobody bothers us
0111'   31 F800                        LXI     SP,0F800H               ; reset the Stack Pointer
                                       ;
                                       ; now to setup the NSC-810
                                       ;
0114'   3E 20                          MVI     A,20H
0116'   32 F886                        STA     PCDDR                   ; Port C Data Direction Word
0119'   AF                             XRA     A
011A'   32 F887                        STA     PAMDR                   ; Port A Mode Register
```

```
011D'   32 F884          STA     PADDR           ; Port A Data Direction Word too
0120'   3E 7F            MVI     A,7FH
0122'   32 F885          STA     PBDDR           ; Port B Data Direction Word
0125'   AF               XRA     A
0126'   32 F881          STA     PBIO            ; Set all of port B low
                         ;
                         ; Now to work on the NSC-810 timers
                         ;
0129'   3E FD            MVI     A,0FDH
012B'   32 F898          STA     T0CMD
012E'   3E FF            MVI     A,0FFH
0130'   32 F890          STA     T0LSB
0133'   32 F891          STA     T0MSB
0136'   32 F895          STA     T0STRT          ; timer 0 setup and started
0139'   3E E5            MVI     A,0E5H
013B'   32 F899          STA     T1CMD
013E'   3E FF            MVI     A,0FFH
0140'   32 F892          STA     T1LSB
0143'   32 F893          STA     T1MSB
0146'   32 F897          STA     T1STRT          ; timer 1 also setup and started
                         ;
                         ; Next come the hardware clocks - 122Hz and 1.9Hz
                         ;
0149'   CD 008D'         CALL    CLR19
014C'   CD 0096'         CALL    CLR122
                         ;
                         ; And then the UARTs
                         ;
014F'   CD 009F'         CALL    UINIT
                         ;
                         ; Setup Interrupt mode and any last setup needed
                         ;
0152'   21 0100'         LXI     H,M2ITBL
0155'   7C               MOV     A,H
                         .Z80
0156'   ED 47            LD      I,A             ; init Mode 2 and vector in Z80 mode
0158'   ED 5E            IM      2
                         .8080
015A'   3E 0F            MVI     A,0FH
015C'   D3 BB            OUT     0BBH            ; unmask RSTA, RSTB, RSTC, and INT
015E'   AF               XRA     A
015F'   32 0000"         STA     CTLWDT          ; init the LED control byte
                         ;
                         ; thats all for now
                         ;
0162'   C3 0000*         JMP     START##         ; Go to AMX and begin
                         ;
                         ;
                         PAGE
```

```
                                ;
                                ;
0165'                   RRTIMR::; start the system timer
                                ;
                                ;
0165'   CD 008D'                CALL    CLR19
0168'   C3 0096'                JMP     CLR122                  ; clear and enable the two timers
                                ;
                                ;
016B'                   CLKISP: ; Keep the 8ms clock running
                                ;
                                ;
016B'   F5                      PUSH    PSW
016C'   3E 20                   MVI     A,20H
016E'   32 F889                 STA     PBBC
0171'   32 F88D                 STA     PBBS                    ; toggle the reset line
0174'   F1                      POP     PSW
0175'   C3 0000*                JMP     CLOCK##
                                ;
                                ;
0178'                   CMBOOT::; reboot the CIM-660 software
                                ;
                                ;
0178'   C3 0000                 JMP     0
                                ;
                                ;
017B'                   EXIT::  ; catch any C bailouts by returning to AMX at TEND
                                ;
017B'   C3 0000*                JMP     TEND##
                                ;
                                ;
017E'                   RRFRAC::; Start the main reset task
                                ;
017E'   2A 0000*                LHLD    TNFRAC##                ; get it's task number
0181'   7D                      MOV     A,L
0182'   CD 0000*                CALL    STASK##                 ; start it
0185'   C9                      RET
                                ;
                                ;
0186'                   TRNODE::; Restart the Node Task
                                ;
0186'   21 0000*                LXI     H,HLFSEC##              ; address of service interval
0189'   4E                      MOV     C,M
018A'   23                      INX     H
018B'   46                      MOV     B,M                     ; get upper word
018C'   23                      INX     H
018D'   5E                      MOV     E,M
018E'   23                      INX     H
018F'   56                      MOV     D,M                     ; and lower one too
0190'   21 0000*                LXI     H,TMNODE##
```

```
0193'   CD 0000*                CALL    TMPUT##         ; and restart the timer
0196'   2A 0000*                LHLD    TNNODE##        ; get the task number of the Node task
0199'   7D                      MOV     A,L
019A'   CD 0000*                CALL    STASK##         ; and start the task
019D'   C9                      RET
                                ;
                                ;
019E'                   DSPTIM::; Check the time validity flag - if set call STFLUK to update time
                                ;
019E'   EB                      XCHG                    ; move time pointer to DE
019F'   21 0007                 LXI     H,7
01A2'   19                      DAD     D               ; point to validity flag
01A3'   7E                      MOV     A,M
01A4'   B7                      ORA     A
01A5'   CA 01BC'                JZ      DSPT1           ; brif invalid time
                                ;
                                ; the time is valid - issue CTASK call
                                ;
01A8'   2A 0000*                LHLD    TNFLUK##        ; get the task number of STFLUK
01AB'   7D                      MOV     A,L
01AC'   21 0000                 LXI     H,0
01AF'   E5                      PUSH    H
01B0'   2B                      DCX     H
01B1'   E5                      PUSH    H               ; push par1=0; par2= 1
01B2'   23                      INX     H
01B3'   39                      DAD     SP              ; then point to what was just pushed
01B4'   01 0003                 LXI     B,3             ; priority 3 - do not wait
01B7'   CD 0000*                CALL    CTASK##         ; and then call the STFLUK task
01BA'   E1                      POP     H
01BB'   E1                      POP     H               ; cleanup the stack
                                ;
01BC'   EB              DSPT1:  XCHG                    ; put pointer back into HL
01BD'   C9                      RET                     ; and quit
                                ;
                                ;
                                PAGE


                                ;
                                ;*************************
                                ; The RAM Areas Needed   *
                                ;*************************
                                ;
01BE'                           DSEG
                                ;
0000"                   CTLWDT: DS      1               ; Control byte for the TPD flash
                                ;
                                ;
                                END     BOOT
```

```
Macros:

Symbols:
0110I'  BEGIN     0000'  BOOT      016B'  CLKISP
0176*   CLOCK     0096'  CLR122    008D'  CLR19
0178I'  CMBOOT    01B8*  CTASK     0000"  CTLWDT
003F'   DMYINT    01BC'  DSPT1     019EI' DSPTIM
017BI'  EXIT      0187*  HLFSEC    0100'  M2ITBL
F888    PABC      F88C   PABS      F884   PADDR
F880    PAIO      F887   PAMDR     F880   PBASE
F889    PBBC      F88D   PBBS      F885   PBDDR
F881    PBIO      F88A   PCBC      F88E   PCBS
F886    PCDDR     F882   PCIO      017EI' RRFRAC
0165I'  RRTIMR    0163*  START     019B*  STASK
F898    T0CMD     F890   T0LSB     F891   T0MSB
F894    T0STOP    F895   T0STRT    F899   T1CMD
010E*   T1ISP     F892   T1LSB     F893   T1MSB
F896    T1STOP    F897   T1STRT    0100*  T2ISP
017C*   TEND      007D'  TGL01     0082'  TGL02
0069'   TGLLED    0191*  TMNODE    0194*  TMPUT
01A9*   TNFLUK    017F*  TNFRAC    0197*  TNMODE
0186I'  TRNODE    009F'  UINIT

No Fatal error(s)

                          TITLE   FRSTRT  FRAC Start Module *FOR DEVELOPMENT*
                          SUBTTL  COPYRIGHT (C) 1983 CYPHER SYSTEMS
                          ;
                          ;
F7EC                BINTV   EQU     0F7ECH          ; Address to stick clock interrupt vector
F7E6                T1INTV  EQU     0F7E6H          ; Address to stick Fluke Interrupt vector
F7D1                T2INTV  EQU     0F7D1H          ; Address to stick Loop 1 Interrupt vector
F880                PBASE   EQU     0F880H
F880                PAIO    EQU     PBASE
F881                PBIO    EQU     PBASE+1
F882                PCIO    EQU     PBASE+2
F884                PADDR   EQU     PBASE+4
F885                PBDDR   EQU     PBASE+5
F886                PCDDR   EQU     PBASE+6
F888                PABC    EQU     PBASE+8
F889                PBBC    EQU     PBASE+9
F88A                PCBC    EQU     PBASE+10
F88C                PABS    EQU     PBASE+12
F88D                PBBS    EQU     PBASE+13
F88E                PCBS    EQU     PBASE+14
                          ;
```

```
0000'                          BEGIN:: ; beginning point for system init
                                       ;
                                       ;
0000'   F3                             DI                          ; make sure nobody bothers us
0001'   3E 60                          MVI     A,60H               ; to stop the clock
0003'   32 F889                        STA     PBBC                ; clear those bits
                                       ;
0006'   21 0022'                       LXI     H,CLKISP
0009'   22 F7EC                        SHLD    BINTV               ; set the user vector
                                       ;
000C'   21 0000*                       LXI     H,T1ISP##           ; address of the FLUKE ISP
000F'   22 F7E6                        SHLD    T1INTV
                                       ;
0012'   21 0000*                       LXI     H,T2ISP##
0015'   22 F7D1                        SHLD    T2INTV              ; setup for node interrupt
                                       ;
0018'   FB                             EI
0019'   C3 0000*                       JMP     START##             ; Start AMX
                                       ;
                                       ;
001C'                          RRTIMR:: ; start the system timer
                                       ;
                                       ;
001C'   3E 60                          MVI     A,60H
001E'   32 F88D                        STA     PBBS                ; start the two timers
0021'   C9                             RET
                                       ;
                                       ;
0022'                          CLKISP: ; Keep the 8ms clock running
                                       ;
                                       ;
0022'   F5                             PUSH    PSW
0023'   3E 20                          MVI     A,20H
0025'   32 F889                        STA     PBBC
0028'   32 F88D                        STA     PBBS                ; toggle the reset line
002B'   F1                             POP     PSW
002C'   C3 0000*                       JMP     CLOCK##
                                       ;
                                       ;
002F'                          CMBOOT:: ; reboot the CIM-660 software
                                       ;
                                       ;
002F'   C3 0000                        JMP     0
                                       ;
                                       ;
0032'                          EXIT::  ; catch any C bailouts by returning to AMX at TEND
                                       ;
0032'   C3 0000*                       JMP     TEND##
                                       ;
                                       ;
```

```
0035'                          RRFRAC::; Start the main reset task
                                       ;
0035'   2A 0000*                       LHLD    TNFRAC##          ; get it's task number
0038'   7D                             MOV     A,L
0039'   CD 0000*                       CALL    STASK##           ; start it
003C'   C9                             RET
                                       ;
                                       ;
003D'                          TRNODE::; Restart the Node Task
                                       ;
003D'   21 0000*                       LXI     H,HLFSEC##        ; address of service interval
0040'   4E                             MOV     C,M
0041'   23                             INX     H
0042'   46                             MOV     B,M               ; get upper word
0043'   23                             INX     H
0044'   5E                             MOV     E,M
0045'   23                             INX     H
0046'   56                             MOV     D,M               ; and lower one too
0047'   21 0000*                       LXI     H,TMNODE##
004A'   CD 0000*                       CALL    TMPUT##           ; and restart the timer
004D'   2A 0000*                       LHLD    TNNODE##          ; get the task number of the Node task
0050'   7D                             MOV     A,L
0051'   CD 0000*                       CALL    STASK##           ; and start the task
0054'   C9                             RET
                                       ;
                                       ;
0055'                          DSPTIM::; Check the time validity flag - if set call STFLUK to update time
                                       ;
0055'   EB                             XCHG                      ; move time pointer to DE
0056'   21 0007                        LXI     H,7
0059'   19                             DAD     D                 ; point to validity flag
005A'   7E                             MOV     A,M
005B'   B7                             ORA     A
005C'   CA 0073'                       JZ      DSPT1             ; brif invalid time
                                       ;
                                       ; the time is valid - issue CTASK call
                                       ;
005F'   2A 0000*                       LHLD    TNFLUK##          ; get the task number of STFLUK
0062'   7D                             MOV     A,L
0063'   21 0000                        LXI     H,0
0066'   E5                             PUSH    H
0067'   2B                             DCX     H
0068'   E5                             PUSH    H                 ; push par1=0; par2=-1
0069'   23                             INX     H
006A'   39                             DAD     SP                ; then point to what was just pushed
006B'   01 0003                        LXI     B,3               ; priority 3 - do not wait
006E'   CD 0000*                       CALL    CTASK##           ; and then call the STFLUK task
0071'   E1                             POP     H
0072'   E1                             POP     H                 ; cleanup the stack
                                       ;
```

```
0073'   EB                  DSPT1:  XCHG                        ; put pointer back into HL
0074'   C9                          RET                         ; and quit
                                    ;
                                    ;
                                    END     BEGIN
```

Macros:

Symbols:

| | | | | | |
|---|---|---|---|---|---|
| 0000I' | BEGIN | F7EC | BINTV | 0022' | CLKISP |
| 002D* | CLOCK | 002FI' | CMBOOT | 006F* | CTASK |
| 0073' | DSPT1 | 0055I' | DSPTIM | 0032I' | EXIT |
| 003E* | HLFSEC | F888 | PABC | F88C | PABS |
| F884 | PADDR | F880 | PAIO | F880 | PBASE |
| F889 | PBBC | F88D | PBBS | F885 | PBDDR |
| F881 | PBIO | F88A | PCBC | F88E | PCBS |
| F886 | PCDDR | F882 | PCIO | 0035I' | RRFRAC |
| 001CI' | RRTIMR | 001A* | START | 0052* | STASK |
| F7E6 | T1INTV | 000D* | T1ISP | F7D1 | T2INTV |
| 0013* | T2ISP | 0033* | TEND | 0048* | THNODE |
| 004B* | THPUT | 0060* | TNFLUK | 0036* | TNFRAC |
| 004E* | TNNODE | 003DI' | TRNODE | | |

No Fatal error(s)

```
                                    TITLE FRACTH     FRAC TERMINAL HANDLER MODULE
                                    SUBTTL COPYRIGHT (C) 1983 CYPHER SYSTEMS
                                    ;
                                    ;
                                    ENTRY   THNTRM,THIOBT,THRAMA
                                    ;
                                    ; entry points for the AMX Terminal Handler
                                    ;
0000'                               CSEG
                                    ;
0001                        NLOOPS  EQU     1               ; for development
0001                        NTRM    EQU     1
                                    ;
0000'   0001                THNTRM: DW      NTRM            ; They gotta know
0002'   0006'               THIOBT: DW      TIOBT           ; Address of my terminal block handler
0004'   04B2"               THRAMA: DW      THRAM           ; RAM for use by the handler
                                    ;
                                    ;
                                    PAGE
```

```
                ;*************************************************************
                ;  Terminal Driver Routines for use with CIM-201 Cards      *
                ;*************************************************************
                ;
                ;
                ; First - the equates
                ;
0028            RXSIZ   EQU     40
00FF            TXSIZ   EQU     255
                ;
0000            NRTS    EQU     0
001D            NSREG   EQU     00011101B       ; 8 bits; 2 stop; no parity; interrupt off
0020            NIE     EQU     00100000B       ; enable the interrupt mechanism
0001            DA      EQU     01H             ; Data received bit
0080            NTHRE   EQU     80H             ; Transmitter holding register empty
0080            RTSL    EQU     80H             ; Set Request to Send
                ;
0002            B0050   EQU     2               ;+
0003            B0075   EQU     3               ;+
000F            B0110   EQU     15              ;+
0004            B0134   EQU     4               ;+
000E            B0150   EQU     14              ;+
0005            B0200   EQU     5               ;+
000D            B0300   EQU     13              ;+ BAUD Rate Table
0006            B0600   EQU     6               ;+
000B            B1200   EQU     11              ;+
000A            B1800   EQU     10              ;+
0007            B2400   EQU     7               ;+
0009            B4800   EQU     9               ;+
0008            B9600   EQU     8               ;+
0001            B19200  EQU     1               ;+
                ;
                ;
                TRMDRV  MACRO   PRTBAS,TRMNBR,BDRATE
                ;
                ;
                T&TRMNBR&COLD:  ; Cold start entry point
                T&TRMNBR&RSET:  ; Reset entry point
                ;
                        MVI     A,NRTS
                        OUT     PRTBAS+2                ; get UART's attention
                        MVI     A,NSREG
                        OUT     PRTBAS+2                ; setup for data trans
                        MVI     A,RTSL+NSREG            ; and lock it up
                        OUT     PRTBAS+2
                        ;
                        ; now set the baud rate
                        ;
                        MVI     A,BDRATE
```

```
        OUT     PRTBAS+4                ; and thats all there is to it
        ;
        RET
        ;
        ;
T&TRMNBR&CONS:  ; Test console status
        ;
        IN      PRTBAS+3                ; read status register
        ANI     DA                      ; mask off data rcvd bit
        RZ
        MVI     A,1
        RET                             ; return 1 only if available
        ;
        ;
T&TRMNBR&CIN:   ; Get char from console
        ;
        IN      PRTBAS+3
        ANI     DA
        JZ      T&TRMNBR&CIN
        IN      PRTBAS+1                ; char ready - read it
        RET
        ;
        ;
        PAGE
T&TRMNBR&COUT:  ; Put one char to console
        ;
        IN      PRTBAS+3
        ANI     NTHRE
        CPI     NTHRE                   ; is transmitter empty
        JNZ     T&TRMNBR&COUT           ; brif not
        ;
        ; transmitter empty - send char
        ;
        MOV     A,C
        OUT     PRTBAS
        RET
        ;
        ;
T&TRMNBR&LIST:  ; list device entry point
T&TRMNBR&PCH:   ; punch device entry point
T&TRMNBR&RDR:   ; reader device entry point
        ;
        XRA     A                       ; zero the Accum.
        RET                             ; AH-HAH, a dummy routine
        ;
        ;
        ENDM                            ; THE END of the Macro
        ;
        ;
        PAGE
```

```
TRMINT  MACRO   PRTBAS,TRMNBR,BDRATE
        ;
T&TRMNBR&COLD:  ; Cold start entry point
T&TRMNBR&RSET:  ; Reset entry point
        ;
        MVI     A,NRTS
        OUT     PRTBAS+2                ; get UART's attention
        MVI     A,NSREG+NIE
        OUT     PRTBAS+2                ; setup for data trans
        MVI     A,RTSL+NSREG+NIE        ; and lock it up
        OUT     PRTBAS+2
        ;
        ; now set the baud rate
        ;
        MVI     A,BDRATE
        OUT     PRTBAS+4                ; and thats all there is to it
        ;
        ; setup the circular lists for receive and transmit
        ;
        XRA     A
        STA     T&TRMNBR&WRX            ; clear wait rcv flag
        STA     T&TRMNBR&WTX            ; and wait tx flag
        STA     T&TRMNBR&TXF            ; and transmitter full flag
        MVI     A,RXSIZ
        LXI     H,RX&TRMNBR&BUF         ; point to receiver buffer
        CALL    CLRST##
        MVI     A,TXSIZ
        LXI     H,TX&TRMNBR&BUF         ; point to transmit buffer
        CALL    CLRST##
        ;
        RET
        ;
        ;
T&TRMNBR&CONS:  ; Test console status
        ;
        LDA     RX&TRMNBR&BUF+1         ; number of chars in buffer
        ORA     A
        RZ                              ; none there - return 0
        MVI     A,1                     ; else return 1
        RET
        ;
        ;
        PAGE
T&TRMNBR&RDR:   ; reader device entry point
T&TRMNBR&CIN:   ; Get char from console
        ;
        LXI     H,RX&TRMNBR&BUF
        CALL    CLRTL##                 ; get char if any
```

```
        MOV     A,C
        JNZ     T&TRMNBR&GEX            ; got one - return it
        ;
        LDA     AMTN##                  ; who am i
        STA     T&TRMNBR&WRX            ; tell the receiver program
        LXI     B,0
        LXI     D,122                   ; 1 sec timeout
        CALL    WAITM##                 ; and wait it out
        ;
        JZ      T&TRMNBR&GER            ; timed out - return -1
        CALL    CLRTL##                 ; get the character
        MOV     A,C
        JNZ     T&TRMNBR&GEX
        ;
T&TRMNBR&GER:
        XRA     A
        STA     T&TRMNBR&WRX            ; i aint gonna wait no more
        DCR     A                       ; error - return -1
        ;
T&TRMNBR&GEX:
        EI
        RET
        ;
        ;
        PAGE
T&TRMNBR&PCH:   ; punch device entry point
T&TRMNBR&COUT:  ; Put one char to console
        ;
        DI
        LDA     T&TRMNBR&TXF
        ORA     A
        JZ      T&TRMNBR&PUTC           ; transmitter not full - send char
        ;
        LXI     H,TX&TRMNBR&BUF
        CALL    CLABL##                 ; add char to bottom of buffer
        JNZ     T&TRMNBR&CEX            ; exit if added ok
        ;
        LDA     AMTN
        STA     T&TRMNBR&WTX            ; say who to wake
        PUSH    B                       ; save the char
        LXI     B,0
        LXI     D,122                   ; wait for one second
        CALL    WAITM##
        POP     B                       ; recover the character
        JNZ     T&TRMNBR&COUT           ; ISP woke us - send char
        ;
        EI
        MVI     A,-1
        RET                             ; error return
        ;
```

```
T&TRMNBR&CEX:
        XRA     A                       ; clear A for return OK
        EI
        RET
        ;
T&TRMNBR&PUTC:  ; Send the Char in C to the UART
        ;
        IN      PRTBAS+3
        ANI     NTHRE
        CPI     NTHRE
        JNZ     T&TRMNBR&PUTC           ; wait for transmitter to empty
        ;
        MOV     A,C
        OUT     PRTBAS                  ; send char
        XRA     A
        DCR     A
        STA     T&TRMNBR&TXF            ; say TX full
        EI
        RET                             ; and go home
        ;
        ;
        PAGE
T&TRMNBR&ISP::  ; THIS IS A GLOBAL ENTRY POINT FOR INTERRUPT SERVICE
        ;
        CALL    INTSV##                 ; tell AMX about the interrupt
        ;
        IN      PRTBAS+3
        MOV     C,A
        ANI     NTHRE
        CPI     NTHRE                   ; check the transmitter flags
        JNZ     T&TRMNBR&RD             ; brif not TX
        ;
        ; transmitter is now empty - see if another char to send
        ;
        PUSH    B
        LXI     H,TX&TRMNBR&BUF
        CALL    CLRTL##                 ; get char if any
        JZ      T&TRMNBR&I1             ; brif none avail
        ;
        MOV     A,C                     ; get next char to A
        OUT     PRTBAS                  ; and send it
        POP     B
        JMP     T&TRMNBR&I2             ; see if any tasks waiting
        ;
T&TRMNBR&I1:
        POP     B
        XRA     A
        STA     T&TRMNBR&TXF            ; clear TX full flag
        ;
```

```
T&TRMNBR&I2:
        LXI     H,T&TRMNBR&WTX          ; point to wait flag
        MOV     A,M
        MVI     M,0                     ; read flag and clear it
        ORA     A
        CNZ     WAKE##                  ; wake task if neccessary
        ;
        ; fall through
        ;
T&TRMNBR&RD:    ; check for received char interrupt
        ;
        MOV     A,C                     ; get back status byte
        ANI     DA
        RZ                              ; return if no char rcvd
        ;
        IN      PRTBAS+1
        MOV     C,A
        LXI     H,RX&TRMNBR&BUF
        CALL    CLABL##                 ; add char to bottom of list
        LXI     H,T&TRMNBR&WRX
        MOV     A,M
        MVI     M,0                     ; read RX wait flag and clear
        ORA     A
        CNZ     WAKE                    ; wake em if needed
        RET                             ; and we're done
        ;
        ;
        PAGE
T&TRMNBR&LIST:  ; list device entry point
        ;
        XRA     A                       ; zero the Accum.
        RET                             ; AH-HAH, a dummy routine
        ;
        ;
        PAGE
        ;
        ; Declare RAM for this terminal driver to use
        ;
        DSEG
        ;
RX&TRMNBR&BUF:  DS      4+(RXSIZ*2)
TX&TRMNBR&BUF:  DS      4+(TXSIZ*2)
T&TRMNBR&WRX:   DS      1
T&TRMNBR&WTX:   DS      1
T&TRMNBR&TXF:   DS      1
        ;
        ;
        CSEG
        ENDM
```

```
                                        ;
                                        ;
                                BLDTBL  MACRO   TRMNBR
                                        ;
                                        ;
                                        JMP     T&TRMNBR&COLD
                                        JMP     T&TRMNBR&RSET
                                        JMP     T&TRMNBR&CONS
                                        JMP     T&TRMNBR&CIN
                                        JMP     T&TRMNBR&COUT
                                        JMP     T&TRMNBR&LIST
                                        JMP     T&TRMNBR&PCH
                                        JMP     T&TRMNBR&RDR
                                        ;
                                        ;
                                        ENDM
                                        ;
                                        PAGE
                                        ;
                                        ;*******************************
                                        ; Terminal I/O Block Table      *
                                        ;*******************************
                                        ;
0006'                           TIOBT:  ;
                                        ;
0000                            X       SET     0
                                        REPT    NTRM + NLOOPS
                                X       SET     X+1
                                        BLDTBL  %X
                                        ENDM
0006'   C3 0036'        +               JMP     T&1&COLD
0009'   C3 0036'        +               JMP     T&1&RSET
000C'   C3 0061'        +               JMP     T&1&CONS
000F'   C3 0069'        +               JMP     T&1&CIN
0012'   C3 0093'        +               JMP     T&1&COUT
0015'   C3 0117'        +               JMP     T&1&LIST
0018'   C3 0093'        +               JMP     T&1&PCH
001B'   C3 0069'        +               JMP     T&1&RDR
001E'   C3 0119'        +               JMP     T&2&COLD
0021'   C3 0119'        +               JMP     T&2&RSET
0024'   C3 0144'        +               JMP     T&2&CONS
0027'   C3 014C'        +               JMP     T&2&CIN
002A'   C3 0176'        +               JMP     T&2&COUT
002D'   C3 01FA'        +               JMP     T&2&LIST
0030'   C3 0176'        +               JMP     T&2&PCH
0033'   C3 014C'        +               JMP     T&2&RDR
                                        ;
                                        ;
                                        PAGE
```

```
                                ;*******************************
                                ; Terminal Drivers             *
                                ;*******************************
                                ;
                                ;
                                TRMINT  0C0H,1,B9600
0036'                   +   T&1&COLD:       ; Cold start entry point
0036'                   +   T&1&RSET:       ; Reset entry point
0036'   3E 00           +           MVI     A,NRTS
0038'   D3 C2           +           OUT     0C0H+2          ; get UART's attention
003A'   3E 3D           +           MVI     A,NSREG+NIE
003C'   D3 C2           +           OUT     0C0H+2          ; setup for data trans
003E'   3E BD           +           MVI     A,RTSL+NSREG+NIE        ; and lock it up
0040'   D3 C2           +           OUT     0C0H+2
0042'   3E 08           +           MVI     A,B9600
0044'   D3 C4           +           OUT     0C0H+4          ; and thats all there is to it
0046'   AF              +           XRA     A
0047'   32 0256"        +           STA     T&1&WRX         ; clear wait rcv flag
004A'   32 0257"        +           STA     T&1&WTX         ; and wait tx flag
004D'   32 0258"        +           STA     T&1&TXF         ; and transmitter full flag
0050'   3E 28           +           MVI     A,RXSIZ
0052'   21 0000"        +           LXI     H,RX&1&BUF              ; point to receiver buffer
0055'   CD 0000*        +           CALL    CLRST##
0058'   3E FF           +           MVI     A,TXSIZ
005A'   21 0054"        +           LXI     H,TX&1&BUF              ; point to transmit buffer
005D'   CD 0000*        +           CALL    CLRST##
0060'   C9              +           RET
0061'                   +   T&1&CONS:       ; Test console status
0061'   3A 0001"        +           LDA     RX&1&BUF+1              ; number of chars in buffer
0064'   B7              +           ORA     A
0065'   C8              +           RZ                              ; none there - return 0
0066'   3E 01           +           MVI     A,1                     ; else return 1
0068'   C9              +           RET
0069'                   +   T&1&RDR:        ; reader device entry point
0069'                   +   T&1&CIN:        ; Get char from console
0069'   21 0000"        +           LXI     H,RX&1&BUF
006C'   CD 0000*        +           CALL    CLRTL##                 ; get char if any
006F'   79              +           MOV     A,C
0070'   C2 0091'        +           JNZ     T&1&GEX         ; got one - return it
0073'   3A 0000*        +           LDA     AMTN##                  ; who am i
0076'   32 0256"        +           STA     T&1&WRX         ; tell the receiver program
0079'   01 0000         +           LXI     B,0
007C'   11 007A         +           LXI     D,122                   ; 1 sec timeout
007F'   CD 0000*        +           CALL    WAITM##                 ; and wait it out
0082'   CA 008C'        +           JZ      T&1&GER         ; timed out - return -1
0085'   CD 0000*        +           CALL    CLRTL##                 ; get the character
0088'   79              +           MOV     A,C
0089'   C2 0091'        +           JNZ     T&1&GEX
```

```
008C'                   +     T&l&GER:
008C'   AF              +             XRA     A
008D'   32 0256"        +             STA     T&l&WRX         ; i aint gonna wait no more
0090'   3D              +             DCR     A                       ; error - return -1
0091'                   +     T&l&GEX:
0091'   FB              +             EI
0092'   C9              +             RET
0093'                   +     T&l&PCH:        ; punch device entry point
0093'                   +     T&l&COUT:       ; Put one char to console
0093'   F3              +             DI
0094'   3A 0258"        +             LDA     T&l&TXF
0097'   B7              +             ORA     A
0098'   CA 00BF'        +             JZ      T&l&PUTC                ; transmitter not full - send char
009B'   21 0054"        +             LXI     H,TX&l&BUF
009E'   CD 0000*        +             CALL    CLABL##                 ; add char to bottom of buffer
00A1'   C2 00BC'        +             JNZ     T&l&CEX         ; exit if added ok
00A4'   3A 0000*        +             LDA     AMTN
00A7'   32 0257"        +             STA     T&l&WTX         ; say who to wake
00AA'   C5              +             PUSH    B                       ; save the char
00AB'   01 0000         +             LXI     B,0
00AE'   11 007A         +             LXI     D,122                   ; wait for one second
00B1'   CD 0000*        +             CALL    WAITM##
00B4'   C1              +             POP     B                       ; recover the character
00B5'   C2 0093'        +             JNZ     T&l&COUT                ; ISP woke us - send char
00B8'   FB              +             EI
00B9'   3E FF           +             MVI     A,-1
00BB'   C9              +             RET                             ; error return
00BC'                   +     T&l&CEX:
00BC'   AF              +             XRA     A                       ; clear A for return OK
00BD'   FB              +             EI
00BE'   C9              +             RET
00BF'                   +     T&l&PUTC:       ; Send the Char in C to the UART
00BF'   DB C3           +             IN      0C0H+3
00C1'   E6 80           +             ANI     NTHRE
00C3'   FE 80           +             CPI     NTHRE
00C5'   C2 00BF'        +             JNZ     T&l&PUTC                ; wait for transmitter to empty
00C8'   79              +             MOV     A,C
00C9'   D3 C0           +             OUT     0C0H                    ; send char
00CB'   AF              +             XRA     A
00CC'   3D              +             DCR     A
00CD'   32 0258"        +             STA     T&l&TXF         ; say TX full
00D0'   FB              +             EI
00D1'   C9              +             RET                             ; and go home
00D2'                   +     T&l&ISP::       ; THIS IS A GLOBAL ENTRY POINT FOR INTERRUPT SERVICE
00D2'   CD 0000*        +             CALL    INTSV##                 ; tell AMX about the interrupt
00D5'   DB C3           +             IN      0C0H+3
00D7'   4F              +             MOV     C,A
00D8'   E6 80           +             ANI     NTHRE
00DA'   FE 80           +             CPI     NTHRE                   ; check the transmitter flags
```

```
00DC'   C2 00FF'     +          JNZ     T&1&RD          ; brif not TX
00DF'   C5           +          PUSH    B
00E0'   21 0054"     +          LXI     H,TX&1&BUF
00E3'   CD 0000*     +          CALL    CLRTL##                 ; get char if any
00E6'   CA 00F0'     +          JZ      T&1&I1          ; brif none avail
00E9'   79           +          MOV     A,C                     ; get next char to A
00EA'   D3 C0        +          OUT     0C0H                    ; and send it
00EC'   C1           +          POP     B
00ED'   C3 00F5'     +          JMP     T&1&I2          ; see if any tasks waiting
00F0'                +     T&1&I1:
00F0'   C1           +          POP     B
00F1'   AF           +          XRA     A
00F2'   32 0258"     +          STA     T&1&TXF         ; clear TX full flag
00F5'                +     T&1&I2:
00F5'   21 0257"     +          LXI     H,T&1&WTX               ; point to wait flag
00F8'   7E           +          MOV     A,M
00F9'   36 00        +          MVI     M,0                     ; read flag and clear it
00FB'   B7           +          ORA     A
00FC'   C4 0000*     +          CNZ     WAKE##                  ; wake task if neccessary
00FF'                +     T&1&RD: ; check for received char interrupt
00FF'   79           +          MOV     A,C                     ; get back status byte
0100'   E6 01        +          ANI     DA
0102'   C8           +          RZ                              ; return if no char rcvd
0103'   DB C1        +          IN      0C0H+1
0105'   4F           +          MOV     C,A
0106'   21 0000"     +          LXI     H,RX&1&BUF
0109'   CD 0000*     +          CALL    CLABL##                 ; add char to bottom of list
010C'   21 0256"     +          LXI     H,T&1&WRX
010F'   7E           +          MOV     A,M
0110'   36 00        +          MVI     M,0                     ; read RX wait flag and clear
0112'   B7           +          ORA     A
0113'   C4 0000*     +          CNZ     WAKE                    ; wake em if needed
0116'   C9           +          RET                             ; and we're done
0117'                +     T&1&LIST:       ; list device entry point
0117'   AF           +          XRA     A                       ; zero the Accum.
0118'   C9           +          RET                             ; AH-HAH, a dummy routine
0119'                +          DSEG
0000"                +     RX&1&BUF:       DS      4+(RXSIZ*2)
0054"                +     TX&1&BUF:       DS      4+(TXSIZ*2)
0256"                +     T&1&WRX:        DS      1
0257"                +     T&1&WTX:        DS      1
0258"                +     T&1&TXF:        DS      1
0259"                +          CSEG
                             PAGE
                             TRMINT  00H,2,B2400
0119'                +     T&2&COLD:       ; Cold start entry point
0119'                +     T&2&RSET:       ; Reset entry point
0119'   3E 00        +          MVI     A,NRTS
011B'   D3 02        +          OUT     00H+2           ; get UART's attention
```

```
011D'   3E 3D          +            MVI     A,NSREG+NIE
011F'   D3 02          +            OUT     00H+2            ; setup for data trans
0121'   3E BD          +            MVI     A,RTSL+NSREG+NIE        ; and lock it up
0123'   D3 02          +            OUT     00H+2
0125'   3E 07          +            MVI     A,B2400
0127'   D3 04          +            OUT     00H+4            ; and thats all there is to it
0129'   AF             +            XRA     A
012A'   32 04AF"       +            STA     T&2&WRX          ; clear wait rcv flag
012D'   32 04B0"       +            STA     T&2&WTX          ; and wait tx flag
0130'   32 04B1"       +            STA     T&2&TXF          ; and transmitter full flag
0133'   3E 28          +            MVI     A,RXSIZ
0135'   21 0259"       +            LXI     H,RX&2&BUF               ; point to receiver buffer
0138'   CD 0000*       +            CALL    CLRST##
013B'   3E FF          +            MVI     A,TXSIZ
013D'   21 02AD"       +            LXI     H,TX&2&BUF               ; point to transmit buffer
0140'   CD 0000*       +            CALL    CLRST##
0143'   C9             +            RET
0144'                  +    T&2&CONS:       ; Test console status
0144'   3A 025A"       +            LDA     RX&2&BUF+1               ; number of chars in buffer
0147'   B7             +            ORA     A
0148'   C8             +            RZ                               ; none there - return 0
0149'   3E 01          +            MVI     A,1                      ; else return 1
014B'   C9             +            RET
014C'                  +    T&2&RDR:        ; reader device entry point
014C'                  +    T&2&CIN:        ; Get char from console
014C'   21 0259"       +            LXI     H,RX&2&BUF
014F'   CD 0000*       +            CALL    CLRTL##                  ; get char if any
0152'   79             +            MOV     A,C
0153'   C2 0174'       +            JNZ     T&2&GEX          ; got one - return it
0156'   3A 0000*       +            LDA     AMTN##                   ; who am i
0159'   32 04AF"       +            STA     T&2&WRX          ; tell the receiver program
015C'   01 0000        +            LXI     B,0
015F'   11 007A        +            LXI     D,122                    ; 1 sec timeout
0162'   CD 0000*       +            CALL    WAITM##                  ; and wait it out
0165'   CA 016F'       +            JZ      T&2&GER          ; timed out - return -1
0168'   CD 0000*       +            CALL    CLRTL##                  ; get the character
016B'   79             +            MOV     A,C
016C'   C2 0174'       +            JNZ     T&2&GEX
016F'                  +    T&2&GER:
016F'   AF             +            XRA     A
0170'   32 04AF"       +            STA     T&2&WRX          ; i aint gonna wait no more
0173'   3D             +            DCR     A                        ; error - return -1
0174'                  +    T&2&GEX:
0174'   FB             +            EI
0175'   C9             +            RET
0176'                  +    T&2&PCH:        ; punch device entry point
0176'                  +    T&2&COUT:       ; Put one char to console
0176'   F3             +            DI
0177'   3A 04B1"       +            LDA     T&2&TXF
```

```
017A'   B7              +          ORA     A
017B'   CA 01A2'        +          JZ      T&2&PUTC                ; transmitter not full - send char
017E'   21 02AD"        +          LXI     H,TX&2&BUF
0181'   CD 0000*        +          CALL    CLABL##                 ; add char to bottom of buffer
0184'   C2 019F'        +          JNZ     T&2&CEX         ; exit if added ok
0187'   3A 0000*        +          LDA     AMTN
018A'   32 04B0"        +          STA     T&2&WTX         ; say who to wake
018D'   C5              +          PUSH    B                       ; save the char
018E'   01 0000         +          LXI     B,0
0191'   11 007A         +          LXI     D,122                   ; wait for one second
0194'   CD 0000*        +          CALL    WAITM##
0197'   C1              +          POP     B                       ; recover the character
0198'   C2 0176'        +          JNZ     T&2&COUT                ; ISP woke us - send char
019B'   FB              +          EI
019C'   3E FF           +          MVI     A,-1
019E'   C9              +          RET                             ; error return
019F'                   +   T&2&CEX:
019F'   AF              +          XRA     A                       ; clear A for return OK
01A0'   FB              +          EI
01A1'   C9              +          RET
01A2'                   +   T&2&PUTC:      ; Send the Char in C to the UART
01A2'   DB 03           +          IN      00H+3
01A4'   E6 80           +          ANI     NTHRE
01A6'   FE 80           +          CPI     NTHRE
01A8'   C2 01A2'        +          JNZ     T&2&PUTC                ; wait for transmitter to empty
01AB'   79              +          MOV     A,C
01AC'   D3 00           +          OUT     00H                     ; send char
01AE'   AF              +          XRA     A
01AF'   3D              +          DCR     A
01B0'   32 04B1"        +          STA     T&2&TXF         ; say TX full
01B3'   FB              +          EI
01B4'   C9              +          RET                             ; and go home
01B5'                   +   T&2&ISP::      ; THIS IS A GLOBAL ENTRY POINT FOR INTERRUPT SERVICE
01B5'   CD 0000*        +          CALL    INTSV##                 ; tell AMX about the interrupt
01B8'   DB 03           +          IN      00H+3
01BA'   4F              +          MOV     C,A
01BB'   E6 80           +          ANI     NTHRE
01BD'   FE 80           +          CPI     NTHRE                   ; check the transmitter flags
01BF'   C2 01E2'        +          JNZ     T&2&RD          ; brif not TX
01C2'   C5              +          PUSH    B
01C3'   21 02AD"        +          LXI     H,TX&2&BUF
01C6'   CD 0000*        +          CALL    CLRTL##                 ; get char if any
01C9'   CA 01D3'        +          JZ      T&2&I1          ; brif none avail
01CC'   79              +          MOV     A,C                     ; get next char to A
01CD'   D3 00           +          OUT     00H                     ; and send it
01CF'   C1              +          POP     B
01D0'   C3 01D8'        +          JMP     T&2&I2          ; see if any tasks waiting
01D3'                   +   T&2&I1:
01D3'   C1              +          POP     B
```

```
01D4'   AF              +           XRA     A
01D5'   32 04B1"        +           STA     T&2&TXF         ; clear TX full flag
01D8'                   +   T&2&I2:
01D8'   21 04B0"        +           LXI     H,T&2&WTX               ; point to wait flag
01DB'   7E              +           MOV     A,M
01DC'   36 00           +           MVI     M,0                     ; read flag and clear it
01DE'   B7              +           ORA     A
01DF'   C4 0000*        +           CNZ     WAKE##                  ; wake task if neccessary
01E2'                   +   T&2&RD: ; check for received char interrupt
01E2'   79              +           MOV     A,C                     ; get back status byte
01E3'   E6 01           +           ANI     DA
01E5'   C8              +           RZ                              ; return if no char rcvd
01E6'   DB 01           +           IN      00H+1
01E8'   4F              +           MOV     C,A
01E9'   21 0259"        +           LXI     H,RX&2&BUF
01EC'   CD 0000*        +           CALL    CLABL##                 ; add char to bottom of list
01EF'   21 04AF"        +           LXI     H,T&2&WRX
01F2'   7E              +           MOV     A,M
01F3'   36 00           +           MVI     M,0                     ; read RX wait flag and clear
01F5'   B7              +           ORA     A
01F6'   C4 0000*        +           CNZ     WAKE                    ; wake em if needed
01F9'   C9              +           RET                             ; and we're done
01FA'                   +   T&2&LIST:       ; list device entry point
01FA'   AF              +           XRA     A                       ; zero the Accum.
01FB'   C9              +           RET                             ; AH-HAH, a dummy routine
01FC'                   +           DSEG
0259"                   +   RX&2&BUF:       DS      4+(RXSIZ*2)
02AD"                   +   TX&2&BUF:       DS      4+(TXSIZ*2)
04AF"                   +   T&2&WRX:        DS      1
04B0"                   +   T&2&WTX:        DS      1
04B1"                   +   T&2&TXF:        DS      1
04B2"                   +           CSEG
                                    PAGE

                                    ;
                                    ;*********************************
                                    ; Terminal Handler RAM area     *
                                    ;*********************************
                                    ;
01FC'                               DSEG
04B2"                       THRAM:  DS      8*NTRM
                                    ;
                                    ;
                                    END
```

```
Macros:
BLDTBL          TRMDRV          TRMINT

Symbols:
0188*   AMTN            0002    B0050           0003    B0075
000F    B0110           0004    B0134           000E    B0150
0005    B0200           000D    B0300           0006    B0600
000B    B1200           000A    B1800           0001    B19200
0007    B2400           0009    B4800           0008    B9600
01ED*   CLABL           0141*   CLRST           01C7*   CLRTL
0001    DA              01B6*   INTSV           0020    NIE
0001    NLOOPS          0000    NRTS            001D    NSREG
0080    NTHRE           0001    NTRM            0080    RTSL
0000"   RX1BUF          0259"   RX2BUF          0028    RXSIZ
00BC'   T1CEX           0069'   T1CIN           0036'   T1COLD
0061'   T1CONS          0093'   T1COUT          008C'   T1GER
0091'   T1GEX           00F0'   T1I1            00F5'   T1I2
00D2I'  T1ISP           0117'   T1LIST          0093'   T1PCH
00BF'   T1PUTC          00FF'   T1RD            0069'   T1RDR
0036'   T1RSET          0258"   T1TXF           0256"   T1WRX
0257"   T1WTX           019F'   T2CEX           014C'   T2CIN
0119'   T2COLD          0144'   T2CONS          0176'   T2COUT
016F'   T2GER           0174'   T2GEX           01D3'   T2I1
01D8'   T2I2            01B5I'  T2ISP           01FA'   T2LIST
0176'   T2PCH           01A2'   T2PUTC          01E2'   T2RD
014C'   T2RDR           0119'   T2RSET          04B1"   T2TXF
04AF"   T2WRX           04B0"   T2WTX           0002I'  THIOBT
0000I'  THNTRM          04B2"   THRAM           0004I'  THRAMA
0006'   TIOBT           0054"   TX1BUF          02AD"   TX2BUF
00FF    TXSIZ           0195*   WAITM           01F7*   WAKE
0002    X

No Fatal error(s)
```

```
TITLE TABLES Storage in BB-Ram for System Tables
SUBTTL Copyright (C) 1983 by Cypher Systems
;
;
;
;       This module defines the addresses of the tables used by
; the TAM-1010 software for tank descriptions. This is an
; ABSOLUTE data segment located within the Battery Backed RAM on
; board the CIM-802 CPU card. A formatted date is kept in the
; first 9 bytes as an 8 character string with null terminator.
;
;       If the data stored in the date area does not appear to be
; a valid date, the system forces setup. If the date appears valid,
; the user is given the option to setup completely or to modify
; only certain tanks.
;
;
```

```
                        ;       The tables defined here include the tank table, the group
                        ; table and the tank type table.
                        ;
                        ;
                        PAGE
                        ;
                        ;
0000'                   ASEG
                        ;
                        ; First the Date String Area
                        ;
                        ;
                        PUBLIC  DATDAT
F000            DATDAT  EQU     0F000H
                        ;
0009            DATDATLEN       EQU     9
                        ;
                        ;
                        ; Then the Tank Strapping Table
                        ;
                        ;
                        PUBLIC  TNKNOD
F009            TNKNOD  EQU     DATDAT + DATDATLEN
                        ;
0730            TNKNODLEN       EQU     1840
                        ;
                        ;
                        ; The System Wide Selection Map
                        ;
                        PUBLIC  SYSMAP
F739            SYSMAP  EQU     TNKNOD + TNKNODLEN
                        ;
0014            SYSMAPLEN       EQU     20
                        ;
                        ;
                        ; The End Of Table Value
                        ;
                        PUBLIC  EOTBL
F74D            EOTBL   EQU     SYSMAP + SYSMAPLEN
                        ;
                        ;
                        ; Next the Group Table
                        ;
                        ;
0000                    DSEG
                        PUBLIC  GRPNOD
                        ;
0015            GRPNODLEN       EQU     21
```

```
0000"                          GRPNOD: DS      GRPNODLEN
                                       ;
                                       ;
                                       ;
                                       ; Finally the Tank Type (Group Member) Table
                                       ;
                                       ;
                                       PUBLIC  TNKTYP
                                       ;
0014                           TNKTYPLEN       EQU     20
0015"                          TNKTYP: DS      TNKTYPLEN
                                       ;
                                       ;
                                       ;
                                       ;
                                       ;
                                       END
Macros:

Symbols:
F000I   DATDAT          0009    DATDATLEN       F74DI   EOTBL
0000I"  GRPNOD          0015    GRPNODLEN       F739I   SYSMAP
0014    SYSMAPLEN       F009I   TNKNOD          0730    TNKNODLEN
0015I"  TNKTYP          0014    TNKTYPLEN


No Fatal error(s)

                                       TITLE   UTIL32  32 BIT MATH ROUTINE CMAC INTERFACE
                                       SUBTTL  USES KADAK PRODUCTS LTD. 32 BIT MATH PACKAGE
                                       ;
                                       ;
                                       ; First we must declare the external modules to be used from the
                                       ;  Kadak Products LTD math package
                                       ;
                                       EXTRN   AALAD           ; (HL)=(HL)+(DE)
                                       EXTRN   AALSD           ; (HL)=(HL)-(DE)
                                       EXTRN   AAULM           ; (BC)=(HL)*(DE)
                                       EXTRN   AAULD           ; (BC)=(HL)/(DE) : (BC+4)=(HL)MOD(DE)
                                       ;
                                       ;
                                       PAGE
                                       ;
                                       ; add32(bufl,buf2)
                                       ;       char bufl[],buf2[];
                                       ;       {
                                       PUBLIC  ADD32
0000'                          ADD32:  ;
```

```
0000'   21 0002                 LXI     H,2
0003'   39                      DAD     SP
0004'   CD 0000*                CALL    CCGINT##        ; get pointer to buf2
0007'   E5                      PUSH    H
0008'   21 0006                 LXI     H,6
000B'   39                      DAD     SP
000C'   CD 0000*                CALL    CCGINT##        ; and pointer to bufl
000F'   D1                      POP     D               ; bufl in HL : buf2 in DE
0010'   CD 0000*                CALL    AALAD           ; do the math
                                ;
                                ; HL contains address of bufl, the result
                                ;
0013'   C9                      RET
                                ;       }
                                ;
                                PAGE
                                ;
                                ; sub32(bufl,buf2)
                                ;       char bufl[],buf2[];
                                ;       {
                                PUBLIC  SUB32
0014'                   SUB32:  ;
0014'   21 0002                 LXI     H,2
0017'   39                      DAD     SP
0018'   CD 0000*                CALL    CCGINT##        ; get pointer to buf2
001B'   E5                      PUSH    H
001C'   21 0006                 LXI     H,6
001F'   39                      DAD     SP
0020'   CD 0000*                CALL    CCGINT##        ; and pointer to bufl
0023'   D1                      POP     D               ; bufl in HL : buf2 in DE
0024'   CD 0000*                CALL    AALSD           ; do the math
                                ;
                                ; HL contains address of bufl, the result
                                ;
0027'   C9                      RET
                                ;       }
                                ;
                                PAGE
                                ;
                                ; mul32(bufl,buf2)
                                ;       char bufl[],buf2[];
                                ;       {
                                PUBLIC  MUL32
0028'                   MUL32:  ;
0028'   C5                      PUSH    B
0029'   C5                      PUSH    B               ; room on the stack for the result
002A'   21 0000                 LXI     H,0
002D'   39                      DAD     SP              ; pointer to temp work area
002E'   E5                      PUSH    H
002F'   21 0008                 LXI     H,8
```

```
0032'   39                          DAD     SP
0033'   CD 0000*                    CALL    CCGINT##        ; pointer to buf2
0036'   E5                          PUSH    H
0037'   21 000C                     LXI     H,12
003A'   39                          DAD     SP
003B'   CD 0000*                    CALL    CCGINT##        ; pointer to buf1
003E'   D1                          POP     D               ; recover pointer to buf2
003F'   C1                          POP     B               ; and pointer to temp work area
0040'   CD 0000*                    CALL    AAULM           ; then do the multiply
                                    ;
                                    ; now we must copy the result to the buffer at HL
                                    ;
0043'   E5                          PUSH    H               ; save the destination pointer
0044'   EB                          XCHG                    ; move destination pointer to DE
0045'   69                          MOV     L,C
0046'   60                          MOV     H,B             ; move the source pointer to HL
0047'   01 0004                     LXI     B,4             ; number of bytes to move
                                    .Z80
004A'   ED B0                       LDIR                    ; a Z-80 move and repeat instruction
                                    .8080
                                    ;
                                    ; The result is now in the proper place - cleanup and quit
                                    ;
004C'   E1                          POP     H               ; recover pointer for proper return
004D'   C1                          POP     B
004E'   C1                          POP     B               ; and cleanup stack
004F'   C9                          RET
                                    ;       }
                                    ;
                                    PAGE
                                    ;
                                    ; div32(buf1,buf2)
                                    ;       char buf1[],buf2[];
                                    ;       {
                                    PUBLIC  DIV32
0050'                       DIV32:  ;
0050'   C5                          PUSH    B
0051'   C5                          PUSH    B
0052'   C5                          PUSH    B
0053'   C5                          PUSH    B               ; room on the stack for the result
0054'   21 0000                     LXI     H,0
0057'   39                          DAD     SP              ; pointer to temp work area
0058'   E5                          PUSH    H
0059'   21 000C                     LXI     H,12
005C'   39                          DAD     SP
005D'   CD 0000*                    CALL    CCGINT##        ; pointer to buf2
0060'   E5                          PUSH    H
0061'   21 0010                     LXI     H,16
0064'   39                          DAD     SP
0065'   CD 0000*                    CALL    CCGINT##        ; pointer to buf1
```

```
0068'   D1                      POP     D               ; recover pointer to buf2
0069'   C1                      POP     B               ; and pointer to temp work area
006A'   CD 0000*                CALL    AAULD           ; then do the division
                                ;
                                ; now we must copy the result to the buffer at HL
                                ;
006D'   E5                      PUSH    H               ; save the destination pointer
006E'   EB                      XCHG                    ; move destination pointer to DE
006F'   69                      MOV     L,C
0070'   60                      MOV     H,B             ; move the source pointer to HL
0071'   01 0004                 LXI     B,4             ; number of bytes to move
                                .Z80
0074'   ED B0                   LDIR                    ; a Z-80 move and repeat instruction
                                .8080
                                ;
                                ; The result is now in the proper place - cleanup and quit
                                ;
0076'   E1                      POP     H               ; recover pointer for proper return
0077'   C1                      POP     B
0078'   C1                      POP     B
0079'   C1                      POP     B
007A'   C1                      POP     B               ; and cleanup stack
007B'   C9                      RET
                                ;       }
                                ;
                                PAGE
                                ;
                                ; mod32(buf1,buf2)
                                ;       char buf1[],buf2[];
                                ;       {
                                PUBLIC  MOD32
007C'                   MOD32:  ;
007C'   C5                      PUSH    B
007D'   C5                      PUSH    B
007E'   C5                      PUSH    B
007F'   C5                      PUSH    B               ; room on the stack for the result
0080'   21 0000                 LXI     H,0
0083'   39                      DAD     SP              ; pointer to temp work area
0084'   E5                      PUSH    H
0085'   21 000C                 LXI     H,12
0088'   39                      DAD     SP
0089'   CD 0000*                CALL    CCGINT##        ; pointer to buf2
008C'   E5                      PUSH    H
008D'   21 0010                 LXI     H,16
0090'   39                      DAD     SP
0091'   CD 0000*                CALL    CCGINT##        ; pointer to buf1
0094'   D1                      POP     D               ; recover pointer to buf2
0095'   C1                      POP     B               ; and pointer to temp work area
0096'   CD 0000*                CALL    AAULD           ; then do the division
                                ;
```

```
                                ; now we must copy the result to the buffer at HL
                                ;
0099'   E5                      PUSH    H               ; save the destination pointer
009A'   EB                      XCHG                    ; move destination pointer to DE
009B'   21 0004                 LXI     H,4
009E'   09                      DAD     B               ; source point to MOD result
009F'   01 0004                 LXI     B,4             ; number of bytes to move
                                .Z80
00A2'   ED B0                   LDIR                    ; a Z-80 move and repeat instruction
                                .8080
                                ;
                                ; The result is now in the proper place - cleanup and quit
                                ;
00A4'   E1                      POP     H               ; recover pointer for proper return
00A5'   C1                      POP     B
00A6'   C1                      POP     B
00A7'   C1                      POP     B
00A8'   C1                      POP     B               ; and cleanup stack
00A9'   C9                      RET
                                ;       }
                                ;
                                PAGE
                                ;
                                ; dblcpy(bufl,buf2)
                                ;       char bufl[],buf2[];
                                ;       {
                                PUBLIC  DBLCPY
00AA'                   DBLCPY: ;
00AA'   21 0004                 LXI     H,4
00AD'   39                      DAD     SP
00AE'   CD 0000*                CALL    CCGINT##        ; get bufl
00B1'   E5                      PUSH    H
00B2'   21 0004                 LXI     H,4
00B5'   39                      DAD     SP
00B6'   CD 0000*                CALL    CCGINT##        ; then buf2 into HL
00B9'   D1                      POP     D               ; retrieve bufl into DE
00BA'   01 0004                 LXI     B,4             ; gonna copy four bytes
                                .Z80
00BD'   ED B0                   LDIR                    ; and do it
                                .8080
                                ;
00BF'   21 0004                 LXI     H,4
00C2'   39                      DAD     SP
00C3'   CD 0000*                CALL    CCGINT##        ; get bufl again for return
00C6'   C9                      RET
                                ;       }
                                ;
                                PAGE
```

```
                                ;
                                ; single(buf)
                                ;       char buf[];
                                ;       {
                                PUBLIC  SINGLE
00C7'                   SINGLE: ;
00C7'   21 0002                 LXI     H,2
00CA'   39                      DAD     SP
00CB'   CD 0000*                CALL    CCGINT##        ; get pointer to 32-bit buffer
00CE'   23                      INX     H
00CF'   23                      INX     H               ; point to lower two bytes
00D0'   CD 0000*                CALL    CCGINT##        ; and retrieve word there
00D3'   7D                      MOV     A,L
00D4'   6C                      MOV     L,H
00D5'   67                      MOV     H,A             ; swap bytes around to LSB first
00D6'   C9                      RET
                                ;       }
                                ;
                                ; double(buf,i)
                                ;       char buf[];
                                ;       int i;
                                ;       {
                                PUBLIC  DOUBLE
00D7'                   DOUBLE: ;
00D7'   21 0004                 LXI     H,4
00DA'   39                      DAD     SP
00DB'   CD 0000*                CALL    CCGINT##        ; get pointer to 32-bit buffer
00DE'   EB                      XCHG                    ; move it to DE
00DF'   21 0000                 LXI     H,0
00E2'   D5                      PUSH    D
00E3'   CD 0000*                CALL    CCPINT##        ; store 0 in upper word
00E6'   21 0004                 LXI     H,4
00E9'   39                      DAD     SP
00EA'   CD 0000*                CALL    CCGINT##        ; get integer to store in lower word
00ED'   7D                      MOV     A,L
00EE'   6C                      MOV     L,H
00EF'   67                      MOV     H,A             ; swap bytes around to MSB first
00F0'   D1                      POP     D
00F1'   13                      INX     D
00F2'   13                      INX     D               ; recover pointer and increment to lower word
00F3'   CD 0000*                CALL    CCPINT##        ; then store integer there
                                ;
00F6'   21 0004                 LXI     H,4
00F9'   39                      DAD     SP
00FA'   CD 0000*                CALL    CCGINT##        ; get buf for return
00FD'   C9                      RET
                                ;       }
                                ;
                                END
```

```
Macros:

Symbols:
0011*   AALAD        0025*   AALSD        0097*   AAULD
0041*   AAULM        0000I'  ADD32        00FB*   CCGINT
00F4*   CCPINT       00AAI'  DBLCPY       0050I'  DIV32
00D7I'  DOUBLE       007CI'  MOD32        0028I'  MUL32
00C7I'  SINGLE       0014I'  SUB32

No Fatal error(s)

LOC  OBJ                LINE    SOURCE

                          1     NAME AVERAGE_VARIABLES
                          2     ;
                          3     ; THIS ROUTINE SUBTRACTS THE HIGH AND LOW VALUE
                          4     ; FROM THE OVERALL COUNT AND DIVIDES THE RESULT BY 4
                          5     ;
                          6     AVERAGE_VARIABLES SEGMENT CODE
----                      7     RSEG AVERAGE_VARIABLES
                          8     ;
                          9     PUBLIC AVER_AGE
                         10     EXTRN DATA(BUFF_VALUE,TEMP_VALUE)
                         11     ;
                         12     AVER_AGE:
                         13     ;
0000 C3                  14             CLR     C
0001 E500       F        15             MOV     A,BUFF_VALUE          ;LSB OF T0 COUNT
0003 9500       F        16             SUBB    A,TEMP_VALUE          ;LSB OF MAX
0005 F500       F        17             MOV     BUFF_VALUE,A
0007 E500       F        18             MOV     A,BUFF_VALUE+1        ;SECON BYTE
0009 9500       F        19             SUBB    A,TEMP_VALUE+1        ;MSB OF MAX
000B F500       F        20             MOV     BUFF_VALUE+1,A
000D E500       F        21             MOV     A,BUFF_VALUE+2
000F 9400                22             SUBB    A,#0                  ;THIRD BYTE
0011 F500       F        23             MOV     BUFF_VALUE+2,A
0013 C3                  24             CLR     C
0014 E500       F        25             MOV     A,BUFF_VALUE          ;BACK TO LSB OF T0 COUNT
0016 9500       F        26             SUBB    A,TEMP_VALUE+2        ;LSB OF MIN
0018 F500       F        27             MOV     BUFF_VALUE,A
001A E500       F        28             MOV     A,BUFF_VALUE+1
001C 9500       F        29             SUBB    A,TEMP_VALUE+3
001E F500       F        30             MOV     BUFF_VALUE+1,A
0020 E500       F        31             MOV     A,BUFF_VALUE+2
0022 9400                32             SUBB    A,#0
0024 F500       F        33             MOV     BUFF_VALUE+2,A
```

```
LOC  OBJ            LINE     SOURCE
                     34      ; NOW THE VALUE IN BUFF_VALUE =BUFF_VALUE-MIN AND MAX
                     35      ;
                     36      ; NOW DIVIDE BUFF_VALUE+0,+1,+2 / 4
0026 7902            37              MOV     R1,#2           ;TWO TIMES
                     38      VAL_DIV:
0028 C3              39              CLR     C
0029 E500      F     40              MOV     A,BUFF_VALUE+2
002B 13              41              RRC     A
002C F500      F     42              MOV     BUFF_VALUE+2,A
002E E500      F     43              MOV     A,BUFF_VALUE+1
0030 13              44              RRC     A
0031 F500      F     45              MOV     BUFF_VALUE+1,A          ;ROTATED TO SECOND
0033 E500      F     46              MOV     A,BUFF_VALUE
0035 13              47              RRC     A                       ;LAST BYTE DIVIDED BY TWO
0036 F500      F     48              MOV     BUFF_VALUE,A
0038 D9EE            49              DJNZ    R1,VAL_DIV              ;DO IT TWICE
                     50      ; NOW A VALID SUM =FOUR VALUES OF THE T0 COUNT
                     51      ;
003A 22              52              RET
                     53      END
```

SYMBOL TABLE LISTING
------ ----- -------

```
N A M E             T Y P E   V A L U E      A T T R I B U T E S

AVER_AGE. . . . .   C ADDR    0000H   R PUB   SEG=AVERAGE_VARIABLES
AVERAGE_VARIABLES   C SEG     003BH           REL=UNIT
BUFF_VALUE. . . .   D ADDR    ----      EXT
TEMP_VALUE. . . .   D ADDR    ----      EXT
VAL_DIV . . . . .   C ADDR    0028H   R       SEG=AVERAGE_VARIABLES
```

REGISTER BANK(S) USED: 0, TARGET MACHINE(S): 8051

ASSEMBLY COMPLETE, NO ERRORS FOUND

```
ISIS-II MCS-51 MACRO ASSEMBLER V2.0
OBJECT MODULE PLACED IN :F1:BEGCOD.OBJ
ASSEMBLER INVOKED BY:  ASM51 :F1:BEGCOD.A51 DB PL(50)

LOC  OBJ            LINE     SOURCE

                      1      NAME BEGIN_CODE
                      2      BEGIN_CODE SEGMENT CODE
----                  3              RSEG    BEGIN_CODE
                      4      ;THIS IS THE ENTRY POINT AFTER A RESET OR THE
                      5      ;PROCESSOR IS POWER UP.
                      6      ;
                      7      ;IT INITIALIZES THE SERIAL PORT FOR AN INTERRRUPT AND GOS TO SLEEP
                      8      ; THROUGH THE TASK_MANAGER
                      9      ;
                     10      ; EXTERNAL MODULES USED
                     11      ; SERIAL.A51,CHKBUS.A51,MEMTST.A51
                     12      ;
                     13      ; ENTERS FROM BEGCOD.A51 MODULE
                     14      ;
                     15      PUBLIC  POWER_UP,POWER_BACK
                     16      EXTRN   CODE(GET_MSG,SERSET,DIAGNO,MEM_TEST,CHKSUM)
                     17      EXTRN   CODE(DELAY)
                     18      EXTRN   DATA(STACK,TIME_OUT2)
                     19      EXTRN   BIT(CHK_ERROR)
                     20      ;
                     21      ;
                     22      POWER_UP:
0000 759070          23              MOV     P1,#01110000B           ;LOWER ALL GATES AND POWER
0003 758100    F     24              MOV     SP,#STACK               ;INIT STACK
0006 758380          25              MOV     DPH,#80H
0009 C295            26              CLR     P1.5
000B E4              27              CLR     A
000C F0              28              MOVX    @DPTR,A
000D D295            29              SETB    P1.5
000F 020000    F     30              JMP     MEM_TEST                ;INITIALIZE ALL MEMORY
                     31      POWER_BACK:
0012 404C            32              JC      EXIT_ERROR
                     33      ;
0014 7BFF            34              MOV     R3,#0FFH
0016 7C07            35              MOV     R4,#07H                 ;MSB OF PROM LENGTH
0018 120000    F     36              CALL    CHKSUM
001B 4043            37              JC      EXIT_ERROR
                     38      ;
001D 120000    F     39              CALL    SERSET
                     40      ;
```

```
LOC  OBJ            LINE     SOURCE

                     41      ; PLAY WITH LIGHTS FOR BART
                     42      LIGHT_AGAIN:
0020 7583FF          43              MOV     DPH,#0FFH
0023 C295            44              CLR     P1.5
0025 E0              45              MOVX    A,@DPTR
0026 D295            46              SETB    P1.5
0028 F4              47              CPL     A                       ; SWITCH SETTING
0029 B40003          48              CJNE    A,#00,LIGHT
002C 020000    F     49              JMP     CONTU
                     50      LIGHT:
002F 758380          51              MOV     DPH,#80H                ; LED'S
0032 C295            52              CLR     P1.5
0034 7401            53              MOV     A,#1
0036 F0              54              MOVX    @DPTR,A                 ; LIGHT #1
0037 7500E0    F     55              MOV     TIME_OUT2,#0E0H
                     56      DEL1:
003A 120000    F     57              CALL    DELAY
                     58      ;
003D 7402            59              MOV     A,#2
003F F0              60              MOVX    @DPTR,A
0040 7500C0    F     61              MOV     TIME_OUT2,#0C0H
                     62      DEL2:
0043 120000    F     63              CALL    DELAY
                     64      ;
0046 7404            65              MOV     A,#4
0048 F0              66              MOVX    @DPTR,A
0049 750080    F     67              MOV     TIME_OUT2,#080H
                     68
                     69      DEL3:
004C 120000    F     70              CALL    DELAY
                     71      ;
004F 7408            72              MOV     A,#8
0051 F0              73              MOVX    @DPTR,A
0052 750060    F     74              MOV     TIME_OUT2,#60H
                     75      DEL4:
0055 120000    F     76              CALL    DELAY
0058 7400            77              MOV     A,#0
005A F0              78              MOVX    @DPTR,A
005B 80C3            79              JMP     LIGHT_AGAIN
                     80      CONTU:
005D 020000    F     81              JMP     GET_MSG
                     82      ;
                     83      EXIT_ERROR:
0060 020000    F     84              JMP     DIAGNO
                     85      END
```

SYMBOL TABLE LISTING
------ ----- -------

| NAME | TYPE | VALUE | | | ATTRIBUTES |
|---|---|---|---|---|---|
| BEGIN_CODE. | C SEG | 0063H | | | REL=UNIT |
| CHK_ERROR . | B ADDR | ---- | | EXT | |
| CHKSUM. . . | C ADDR | ---- | | EXT | |
| CONTU . . . | C ADDR | 005DH | R | | SEG=BEGIN_CODE |
| DEL1. . . . | C ADDR | 003AH | R | | SEG=BEGIN_CODE |
| DEL2. . . . | C ADDR | 0043H | R | | SEG=BEGIN_CODE |
| DEL3. . . . | C ADDR | 004CH | R | | SEG=BEGIN_CODE |
| DEL4. . . . | C ADDR | 0055H | R | | SEG=BEGIN_CODE |
| DELAY . . . | C ADDR | ---- | | EXT | |
| DIAGNO. . . | C ADDR | ---- | | EXT | |
| DPH . . . . | D ADDR | 0083H | A | | |
| EXIT_ERROR. | C ADDR | 0060H | R | | SEG=BEGIN_CODE |
| GET_MSG . . | C ADDR | ---- | | EXT | |
| LIGHT_AGAIN | C ADDR | 0020H | R | | SEG=BEGIN_CODE |
| LIGHT . . . | C ADDR | 002FH | R | | SEG=BEGIN_CODE |
| MEM_TEST. . | C ADDR | ---- | | EXT | |
| P1. . . . . | D ADDR | 0090H | A | | |
| POWER_BACK. | C ADDR | 0012H | R | PUB | SEG=BEGIN_CODE |
| POWER_UP. . | C ADDR | 0000H | R | PUB | SEG=BEGIN_CODE |
| SERSET. . . | C ADDR | ---- | | EXT | |
| SP. . . . . | D ADDR | 0081H | A | | |
| STACK . . . | D ADDR | ---- | | EXT | |
| TIME_OUT2 . | D ADDR | ---- | | EXT | |

REGISTER BANK(S) USED: 0, TARGET MACHINE(S): 8051

ASSEMBLY COMPLETE, NO ERRORS FOUND

ISIS-II MCS-51 MACRO ASSEMBLER V2.0
OBJECT MODULE PLACED IN :F1:CHKBUS.OBJ
ASSEMBLER INVOKED BY: ASM51 :F1:CHKBUS.A51 DB PL(50)

```
LOC  OBJ            LINE     SOURCE

                       1     NAME BUS_POWERCHECK
                       2     ; ENTERS FROM A CALL
                       3     ; EXITS WITH C=0 IF POWER IS OK
                       4     ; OR C=1 IF POWER IS BAD
                       5     ;
                       6     ; EXTRN MODULES USED- NONE
                       7     ; ENTERS FROM SLFTST.A51,RANGE.A51
                       8     ;
```

```
LOC  OBJ              LINE     SOURCE
                         9     BUS_POWERCHECK SEGMENT CODE
----                    10     RSEG    BUS_POWERCHECK
                        11     ;
                        12     PUBLIC BUS_POWER
                        13     EXTRN BIT(NO_POWER)
                        14     EXTRN DATA(TIME_OUT1,TIME_OUT2)
                        15     EXTRN CODE(DELAY)
                        16     ;
----                    17     RSEG BUS_POWERCHECK
                        18     ;
                        19     BUS_POWER:
0000 C295               20             CLR     P1.5                    ;MAKE SURE ALL TEMP SENSOR POWER
0002 90FFFF             21             MOV     DPTR,#0FFFFH
0005 E4                 22             CLR     A                       ;WRITE 00 TO ALL POWER AND LED'S
0006 F0                 23             MOVX    @DPTR,A
0007 D296               24             SETB    P1.6
0009 D297               25             SETB    P1.7                    ;BRING POWER CONTROL BIT HIGH
000B 7500FF    F        26             MOV     TIME_OUT1,#0FFH
000E 7500FF    F        27             MOV     TIME_OUT2,#0FFH
0011 120000    F        28             CALL    DELAY
0014 309602             29             JNB     P1.6,PERR               ;IF P2.7 NOT SET THEN POWER ERROR
0017 C3                 30             CLR     C                       ;CLEAR CARRY NO ERROR
0018 22                 31             RET
0019 D200      F        32     PERR:   SETB    NO_POWER
001B D3                 33             SETB    C                       ;SET CARRY BIT FOR ERROR
001C 22                 34             RET
                        35     END
```

SYMBOL TABLE LISTING
------ ----- -------

```
N A M E          T Y P E   V A L U E       A T T R I B U T E S

BUS_POWER. . .   C ADDR    0000H   R PUB   SEG=BUS_POWERCHECK
BUS_POWERCHECK   C SEG     001DH           REL=UNIT
DELAY. . . . .   C ADDR    ----      EXT
NO_POWER . . .   B ADDR    ----      EXT
P1 . . . . . .   D ADDR    0090H   A
PERR . . . . .   C ADDR    0019H   R       SEG=BUS_POWERCHECK
TIME_OUT1. . .   D ADDR    ----      EXT
TIME_OUT2. . .   D ADDR    ----      EXT
```

REGISTER BANK(S) USED: 0, TARGET MACHINE(S): 8051

ASSEMBLY COMPLETE, NO ERRORS FOUND

```
ISIS-II MCS-51 MACRO ASSEMBLER V2.0
OBJECT MODULE PLACED IN :F1:CHKSUM.OBJ
ASSEMBLER INVOKED BY:  ASM51 :F1:CHKSUM.A51 DB PL(50)

LOC  OBJ            LINE     SOURCE

                     1       NAME CHECKSUM_CALCULATOR
                     2       ; ENTERS WITH DPTR POINTING AT THE FIRST CODE LOCATION
                     3       ; AND R3=LSB OF LENGTH, R4=MSB OF LENGTH
                     4       ;
                     5       ; USES THE FOLLOWING REGISTERS
                     6       ; ACC IS USED AS OFFSET AND ADDER
                     7       ; R3=LSB OF LENGTH
                     8       ; R4=MSB OF LENGTH
                     9       ; R5=TEMPORARY STORAGE-FINAL RESULT
                    10       ; DPTR=POINTER INTO PROM SPACE
                    11       ;
                    12       ; EXITS WITH CARRY FLAG SET IF AN ERROR HAS OCCURRED
                    13       ; THE ROUTINE COMPARES THE RESULT OF THE ADDITION TO
                    14       ; THE LAST BYTE IN THE INDICATED LENGTH
                    15       ;
                    16       ; EXTRN MODULES USED- NONE
                    17       ; ENTERS FROM SLFTST.A51 MODULE
                    18       ;
                    19       CHECKSUM_CALCULATOR SEGMENT CODE
----                20       RSEG    CHECKSUM_CALCULATOR
                    21       ;
                    22       EXTRN BIT(CHK_ERROR)
                    23       ;
                    24       PUBLIC CHKSUM
                    25       ;
0000 C3             26       CHKSUM: CLR     C               ;CLEAR CARRY
0001 900000         27               MOV     DPTR,#0         ;INIT DATA POINTER
0004 7D00           28               MOV     R5,#00          ;CLEAR R5 TEMP
0006 1B             29               DEC     R3              ;DONT WANT TO PROCESS LAST BYTE
0007 0C             30               INC     R4              ;TO CALCULATE ALL LOCATIONS
0008 E4             31       NBYTE:  CLR     A               ;CLEAR ACC
0009 93             32               MOVC    A,@A+DPTR       ;GET BYTE
000A 2D             33               ADD     A,R5            ;ADD BYTE TO R5
000B FD             34               MOV     R5,A            ;AND STORE IN R5
000C A3             35               INC     DPTR            ;BUMP POINTER
000D DBF9           36               DJNZ    R3,NBYTE        ;DEC LSB AND JMP NOT ZERO
000F DCF7           37               DJNZ    R4,NBYTE        ;AND DEC MSB OF COUNT
0011 C3             38               CLR     C               ;CLEAR CARRY IS SET
0012 A3             39               INC     DPTR            ;TO LAST PROM LOCATION
0013 E4             40               CLR     A               ;CLEAR ACC
```

```
LOC  OBJ            LINE     SOURCE

0014 93               41     BKP1:   MOVC    A,@A+DPTR        ;GET LAST BYTE OF PROM SPACE
0015 9D               42             SUBB    A,R5             ;SUBTRACT ACTUAL - CALCULATED
0016 6004             43             JZ      EXIT             ;IF ZERO EXIT
0018 D200      F      44             SETB    CHK_ERROR
001A D3               45             SETB    C                ;ELSE SET CARRY BIT FOR ERROR
001B 22               46             RET                      ;AND RETURN TO CALLER
001C C3               47     EXIT:   CLR     C                ;CLEAR CARRY JUST INCASE
001D 22               48             RET                      ;AND RETURN
                      49     END

SYMBOL TABLE LISTING
------ ----- -------

N A M E              T Y P E   V A L U E       A T T R I B U T E S

BKP1. . . . . . . .  C ADDR    0014H   R        SEG=CHECKSUM_CALCULATOR
CHECKSUM_CALCULATOR  C SEG     001EH            REL=UNIT
CHK_ERROR . . . . .  B ADDR    ----      EXT
CHKSUM. . . . . . .  C ADDR    0000H   R PUB    SEG=CHECKSUM_CALCULATOR
EXIT. . . . . . . .  C ADDR    001CH   R        SEG=CHECKSUM_CALCULATOR
NBYTE . . . . . . .  C ADDR    0008H   R        SEG=CHECKSUM_CALCULATOR

REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:DIAG.OBJ
ASSEMBLER INVOKED BY:  ASM51 :F1:DIAG.A51 DB PL(50)


LOC  OBJ            LINE     SOURCE

                      1      NAME DIAGNO_ANALSIS
                      2      ;
                      3      ; THIS ROUTINE TRYS TO DETERMINE THE NATURE OF A FAILURE
                      4      ;
                      5      ; ENTERS WITH THE FOLLOWING ERROR CONDITIONS
                      6      ;
                      7      ; ERROR_BYTE
                      8      ;       BIT0 = CHECKSUM ERROR (FATAL)
                      9      ;       BIT1 = RAM ERROR
                     10      ;              RAM_GOOD=GOOD DATA
                     11      ;              RAM_BAD=BAD DATA
                     12      ;              RAM_ADDRESS=BAD ADDRESS
```

```
LOC  OBJ              LINE     SOURCE
                       13      ;        BIT2 = COMMUNICATIONS PROBLEMS
                       14      ;        COMA_ERROR =
                       15      ;                BIT0=NO ACK/NAK RECIEVED
                       16      ;                BIT1=UNKNOWN BYTE RECIEVED FOR ACK/NAK
                       17      ;                BIT2=FAILURE AFTER THREE TRYS(TRANSMITING)
                       18      ;                BIT3=BAD UNIT #
                       19      ;                BIT4=TIME_OUT CONDITION
                       20      ;                BIT5=CRC ERROR
                       21      ;                BIT6=MESSAGE LENGTH ERROR
                       22      ;                BIT7=FAILURE AFTER THREE TRYS(RECIEVING)
                       23      ;        BIT3 = NO MODULE POWER (FATAL)
                       24      ;        BIT4 = RANGING MODULE ERROR
                       25      ;        ERROR_RANGING
                       26      ;                BIT0=OIL TO CLOSE
                       27      ;                BIT1=TO MANY ECHOS RECIEVED
                       28      ;                BIT2=MAX WINDOW TIMEOUT
                       29      ;                BIT3=DEAD ZONE ONE
                       30      ;                BIT4=DEAD ZONE TWO
                       31      ;                BIT5=TIMER NOT WORKING
                       32      ;                BIT6=RESULTS INCONSISTANT
                       33      ;                BIT7=UNKNOWN VALUES
                       34      ;        BIT6 = RESERVED
                       35      ;        BIT7 = RESERVED
                       36      ;
                       37      ;
                       38      DIAGNO_ANALSIS SEGMENT CODE
----                   39      RSEG DIAGNO_ANALSIS
                       40      ;
                       41      PUBLIC DIAGNO
                       42      EXTRN CODE(GET_CHAR,SEND_CHAR)
                       43      ;
                       44      DIAGNO:
0000 C295              45              CLR     P1.5
0002 758380            46              MOV     DPH,#80H                ;ADDRESS LED'S
0005 7403              47              MOV     A,#03H                  ;2 LEDS AND NO UPSTREAM
0007 F0                48              MOVX    @DPTR,A
0008 D295              49              SETB    P1.5
                       50      ;
                       51      FATAL_END:
000A 120000    F       52              CALL    GET_CHAR                ;GET ADDRESS
000D B4FF03            53              CJNE    A,#0FFH,SEND_IT
0010 020000            54              JMP     0
                       55      SEND_IT:
0013 74FF              56              MOV     A,#0FFH
0015 120000    F       57              CALL    SEND_CHAR
0018 120000    F       58              CALL    SEND_CHAR
001B 120000    F       59              CALL    SEND_CHAR
001E 120000    F       60              CALL    SEND_CHAR
```

```
LOC  OBJ            LINE     SOURCE

0021 120000   F       61              CALL    GET_CHAR
0024 C2AF             62              CLR     EA                      ;DISABLE INTERRUPTS
0026 80FE             63              SJMP    $                       ;STOP HERE
                      64     END
SYMBOL TABLE LISTING
------ ----- -------


N A M E          T Y P E   V A L U E       A T T R I B U T E S

DIAGNO_ANALSIS   C SEG     0028H           REL=UNIT
DIAGNO . . . .   C ADDR    0000H   R PUB   SEG=DIAGNO_ANALSIS
DPH. . . . . .   D ADDR    0083H   A
EA . . . . . .   B ADDR    00A8H.7 A
FATAL_END. . .   C ADDR    000AH   R       SEG=DIAGNO_ANALSIS
GET_CHAR . . .   C ADDR    ----      EXT
P1 . . . . . .   D ADDR    0090H   A
SEND_CHAR. . .   C ADDR    ----      EXT
SEND_IT. . . .   C ADDR    0013H   R       SEG=DIAGNO_ANALSIS

REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:FINDIT.OBJ
ASSEMBLER INVOKED BY:  ASM51 :F1:FINDIT.A51 DB PL(50)

LOC  OBJ            LINE     SOURCE

                      1      NAME TIMEOUT_NOFIND_OIL
                      2      ;
                      3      ; THIS ROUTINE IS HIT WHEN T2 TIMES OUT CAUSING AN INT1/
                      4      ;       IT LOAD 0000 INTO THE READING AND CONTINUES
                      5      ;
                      6      PUBLIC TIME_OUT_ERROR
                      7      EXTRN DATA(BUFF_VALUE)
                      8      EXTRN BIT(ERROR_RANGING,MAX_WINDOW_TIMEOUT)
                      9      ;
                     10      SECOND_FIND_OIL SEGMENT CODE
----                 11      RSEG SECOND_FIND_OIL
                     12      ;
                     13      ;
                     14      TIME_OUT_ERROR:
```

```
LOC  OBJ            LINE     SOURCE
0000 750000   F       15              MOV     BUFF_VALUE,#0
0003 750000   F       16              MOV     BUFF_VALUE+1,#0
0006 D2D1             17              SETB    PSW.1
0008 D200     F       18              SETB    ERROR_RANGING
000A D200     F       19              SETB    MAX_WINDOW_TIMEOUT
000C 32               20              RETI
                      21      END

SYMBOL TABLE LISTING
------ ----- -------


N A M E             T Y P E   V A L U E      A T T R I B U T E S

BUFF_VALUE . . . .  D ADDR    ----      EXT
ERROR_RANGING. . .  B ADDR    ----      EXT
MAX_WINDOW_TIMEOUT  B ADDR    ----      EXT
PSW. . . . . . . .  D ADDR    00D0H   A
SECOND_FIND_OIL. .  C SEG     000DH           REL=UNIT
TIME_OUT_ERROR . .  C ADDR    0000H   R PUB   SEG=SECOND_FIND_OIL
TIMEOUT_NOFIND_OIL    ----    ----


REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:GETMSG.OBJ
ASSEMBLER INVOKED BY:  ASM51 :F1:GETMSG.A51 DB PL(50)


LOC  OBJ            LINE     SOURCE

                       1     NAME GET_MESSAGE_COMMAND
                       2     ;
                       3     ;
                       4     PUBLIC GET_MSG,SEND_RESULTS,GET_CHAR
                       5     ;
                       6     EXTRN CODE(SEND_BUFFER,SEND_REVISION,TASK_RANGING)
                       7     EXTRN DATA(MSG_BUFFER,NODE_ADDRESS)
                       8     ;
                       9     GET_MESSAGE_COMMAND SEGMENT CODE
----                  10     RSEG GET_MESSAGE_COMMAND
                      11     ;
                      12     GET_MSG:
0000 750000   F       13             MOV     NODE_ADDRESS,#0                ;INIT TO ZERO
```

```
LOC  OBJ            LINE     SOURCE

0003 120000   F      14              CALL    GET_CHAR                        ;GET THE ADDRESS
0006 F500     F      15              MOV     NODE_ADDRESS,A
0008 B4FF03          16              CJNE    A,#0FFH,OK_CONT
000B 020000          17              JMP     0
                     18      OK_CONT:
000E 120000   F      19              CALL    SEND_REVISION
0011 120000   F      20              CALL    GET_CHAR                        ;GET RESPONSE
0014 B5000D   F      21              CJNE    A,NODE_ADDRESS,ERROR            ;IS IT ME?
0017 7411            22              MOV     A,#11H                          ;LIGHT 1 LED AND ENABLE UPSTREAM
                     23      GO_AHEAD:
0019 758380          24              MOV     DPH,#80H                        ;LED ADDRESS
001C C295            25              CLR     P1.5
001E F0              26              MOVX    @DPTR,A
001F D295            27              SETB    P1.5
0021 020000   F      28              JMP     TASK_RANGING
                     29      ;
                     30      ERROR:
0024 741F            31              MOV     A,#01FH                         ;ALL LED AND UPSTREAM
0026 80F1            32              SJMP    GO_AHEAD
                     33      ;
                     34      SEND_RESULTS:
0028 120000   F      35              CALL    GET_CHAR
002B B4FF03          36              CJNE    A,#0FFH,TRY_ME
002E 020000          37              JMP     0
                     38      TRY_ME:
0031 B500F4   F      39              CJNE    A,NODE_ADDRESS,SEND_RESULTS
0034 020000   F      40              JMP     SEND_BUFFER
                     41      ;
                     42      GET_CHAR:
0037 3098FD          43              JNB     RI,$
003A C298            44              CLR     RI
003C E599            45              MOV     A,SBUF
003E 22              46              RET
                     47      ;
                     48      END
```

SYMBOL TABLE LISTING
------ ----- -------

| N A M E | T Y P E | V A L U E | | A T T R I B U T E S |
|---|---|---|---|---|
| DPH . . . . . . . . | D ADDR | 0083H | A | |
| ERROR . . . . . . . | C ADDR | 0024H | R | SEG=GET_MESSAGE_COMMAND |
| GET_CHAR. . . . . . | C ADDR | 0037H | R PUB | SEG=GET_MESSAGE_COMMAND |
| GET_MESSAGE_COMMAND | C SEG | 003FH | | REL=UNIT |
| GET_MSG . . . . . . | C ADDR | 0000H | R PUB | SEG=GET_MESSAGE_COMMAND |
| GO_AHEAD. . . . . . | C ADDR | 0019H | R | SEG=GET_MESSAGE_COMMAND |

```
MSG_BUFFER. . . . .  D ADDR    ----       EXT
NODE_ADDRESS. . . .  D ADDR    ----       EXT
OK_CONT . . . . . .  C ADDR    000EH   R        SEG=GET_MESSAGE_COMMAND
P1. . . . . . . . .  D ADDR    0090H   A
RI. . . . . . . . .  B ADDR    0098H.0 A
SBUF. . . . . . . .  D ADDR    0099H   A
SEND_BUFFER . . . .  C ADDR    ----       EXT
SEND_RESULTS. . . .  C ADDR    0028H   R PUB    SEG=GET_MESSAGE_COMMAND
SEND_REVISION . . .  C ADDR    ----       EXT
TASK_RANGING. . . .  C ADDR    ----       EXT
TRY_ME. . . . . . .  C ADDR    0031H   R        SEG=GET_MESSAGE_COMMAND

REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:INTVEC.OBJ
ASSEMBLER INVOKED BY:  ASM51 :F1:INTVEC.A51 DB PL(50)

LOC  OBJ            LINE     SOURCE

                       1     NAME INTERRUPT_VECTORS
                       2     ;
                       3     ; ENTERS FROM POWERUP, INT0, INT1, TIMER0 TIMEOUT
                       4     ; EXITS TO    BEGCOD, RANGE,FINDIT,SLEEP (MODULES CALLED)
                       5     ;
                       6             EXTRN CODE(POWER_UP,OIL_FOUND,TIME_OUT_ERROR)
----                   7     CSEG
0000                   8             ORG     0
                       9     START:
0000 020000    F      10         *   JMP     POWER_UP
0003                  11             ORG     EXTI0                    ;3
0003 020000    F      12             JMP     OIL_FOUND                ;ECHO RECIEVED ADJUST COUNT
0013                  13             ORG     EXTI1                    ;13H
0013 020000    F      14             JMP     TIME_OUT_ERROR           ;T2 TIMED OUT
                      15     ;
                      16             END

SYMBOL TABLE LISTING
------ ----- -------

N A M E            T Y P E   V A L U E      A T T R I B U T E S

EXTI0 . . . . . .  C ADDR    0003H   A
EXTI1 . . . . . .  C ADDR    0013H   A
```

```
INTERRUPT_VECTORS     ----     ----
OIL_FOUND . . . .   C ADDR     ----       EXT
POWER_UP. . . . .   C ADDR     ----       EXT
START . . . . . .   C ADDR     0000H   A
TIME_OUT_ERROR. .   C ADDR     ----       EXT

REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:LSUDAT.OBJ
ASSEMBLER INVOKED BY:  ASM51 :F1:LSUDAT.A51 DB PL(50)


LOC  OBJ            LINE     SOURCE

                      1      NAME LSU_CONSTANTS_VARIABLES
                      2      ;
                      3      ; THIS MODULE CONTAINS ALL THE DECLARATIONS FOR
                      4      ; BIT ASSIGNMENTS AND MEMORY LOCATIONS FOR VARIABLE
                      5      ; STORAGE
                      6      ;
                      7      PUBLIC STACK,MSG_BUFFER,CHK_ERROR,RAM_ERROR,RAM_GOOD,RAM_BAD
                      8      PUBLIC RAM_ADDRESS,COMMUN_ICATIONS,COMA_RESPONSE,COMA_QUESTION
                      9      PUBLIC COMA_TRANS,COMA_UNIT,COMA_TIMEOUT,COMA_CRC,COMA_LENGTH,COMA_RECIEVE
                     10      PUBLIC NO_POWER,CHK_8031,COMA_ERROR
                     11      PUBLIC MAX_WINDOW_TIMEOUT
                     12      PUBLIC MSG_READY,NODE_ADDRESS
                     13      PUBLIC CWT0,CWT1,CWT2
                     14      PUBLIC ERROR_BYTE,PCON
                     15      PUBLIC SIX_PULSES
                     16      PUBLIC TIME_OUT1,TIME_OUT2
                     17      PUBLIC TEMP_VALUE
                     18      PUBLIC BUFF_VALUE
                     19      PUBLIC RANGE_ERROR,ERROR_RANGING
                     20      PUBLIC TIMER_ERROR,RESULT_INCONSIS
                     21      PUBLIC EXIT_WHICH,UNKNON_VALUE
                     22      ;
                     23      LSU_CONSTANTS SEGMENT BIT
----                 24      RSEG    LSU_CONSTANTS
                     25      ;
0000                 26      CHK_ERROR:      DBIT    1       ;BIT ID FOR CHECKSUM ERROR
0001                 27      RAM_ERROR:      DBIT    1       ;RAM ERROR
0002                 28      COMMUN_ICATIONS:        DBIT    1       ;BIT FOR COMMUNICATION PROBLEM
0003                 29      NO_POWER:       DBIT    1       ;NO MODULE (SENSOR) POWER
0004                 30      RANGE_ERROR:    DBIT    1       ;RANGING MODULE ERROR
```

```
LOC  OBJ          LINE    SOURCE

0005               31     XX1:              DBIT    3        ;RESERVED FOR OTHER ERRORS
                   32     ;
                   33     ; COMA_ERROR
                   34     ;
0008               35     COMA_RESPONSE:    DBIT    1        ;NO ACK/NAK RECIEVED
0009               36     COMA_QUESTION:    DBIT    1        ;SOMETHING OTHER THAN ACK/NAK
000A               37     COMA_TRANS:       DBIT    1        ;FAILED AFTER THREE TRYS
000B               38     COMA_UNIT:        DBIT    1        ;BAD UNIT NUMBER
000C               39     COMA_TIMEOUT:     DBIT    1        ;TIMEOUT ERROR
000D               40     COMA_CRC:         DBIT    1        ;CRC ERROR DETECTED
000E               41     COMA_LENGTH:      DBIT    1        ;MESSAGE LENGTH ERROR
000F               42     COMA_RECIEVE:     DBIT    1        ;FAILED TO RECIEVE AFTER 3 TRYS
                   43     ;
                   44     ; ERROR_RANGING
                   45     ;
0010               46     TIMER_ERROR:      DBIT    1        ;8253 NOT WORKING
0011               47     RESULT_INCONSIS:          DBIT    1        ;CANT GIVE GOOD RESULT
0012               48     UNKNON_VALUE:     DBIT    1        ; BAD VALUES IN TSKRAN
0013               49     MAX_WINDOW_TIMEOUT: DBIT 1
0014               50     XX2:              DBIT    4
                   51     ;
                   52     LSU_VARIABLES SEGMENT DATA
----               53     RSEG LSU_VARIABLES
                   54     ;
0000               55     RAM_GOOD:         DS      1        ;GOOD DATA
0001               56     RAM_BAD:          DS      1        ;BAD RAM DATA
0002               57     RAM_ADDRESS:      DS      1        ;BAD RAM ADDRESS
0003               58     NODE_ADDRESS:     DS      1        ;STOREAGE FOR ADDRESS
0004               59     MSG_READY:        DS      1        ;IDEAL TIME FOR ECHO WITHIN WINDOW
0005               60     STACK:            DS      20       ;STACK SIZE
0019               61     SIX_PULSES:       DS      1        ;FOR SIX PULSES
001A               62     MSG_BUFFER:       DS      30       ;MESSAGE BUFFER SIZE
0038               63     TEMP_VALUE:       DS      10
0042               64     TIME_OUT1:        DS      1        ;VALUE FOR DELAYS TO USE
0043               65     TIME_OUT2:        DS      1        ;
                   66     ;
  0087             67     PCON              EQU     87H
  0020             68     ERROR_BYTE        EQU     20H
  0021             69     COMA_ERROR        EQU     21H
  0022             70     ERROR_RANGING     EQU     22H      ;RANGING ERROR BYTE LOCATION
  0030             71     CWT0              EQU     30H      ;CONTROL WORD FOR TIMER T0
  0070             72     CWT1              EQU     70H      ;CONTROL T1 MODE 0 LEVEL
  00B0             73     CWT2              EQU     0B0H     ;CONTROL T2 MODE 0 LEVEL
  0033             74     BUFF_VALUE        EQU     MSG_BUFFER+25
                   75     ;
                   76     END
```

SYMBOL TABLE LISTING
------ ----- -------

| NAME | TYPE | VALUE | | | ATTRIBUTES |
|---|---|---|---|---|---|
| BUFF_VALUE. . . . . | D ADDR | 0033H | R | PUB | SEG=LSU_VARIABLES |
| CHK_8031. . . . . | ---- | ---- | | PUB | |
| CHK_ERROR . . . . . | B ADDR | 0000H.0 | R | PUB | SEG=LSU_CONSTANTS |
| COMA_CRC. . . . . | B ADDR | 0001H.5 | R | PUB | SEG=LSU_CONSTANTS |
| COMA_ERROR. . . . . | NUMB | 0021H | A | PUB | |
| COMA_LENGTH . . . . . | B ADDR | 0001H.6 | R | PUB | SEG=LSU_CONSTANTS |
| COMA_QUESTION . . . . . | B ADDR | 0001H.1 | R | PUB | SEG=LSU_CONSTANTS |
| COMA_RECIEVE. . . . . | B ADDR | 0001H.7 | R | PUB | SEG=LSU_CONSTANTS |
| COMA_RESPONSE . . . . . | B ADDR | 0001H.0 | R | PUB | SEG=LSU_CONSTANTS |
| COMA_TIMEOUT. . . . . | B ADDR | 0001H.4 | R | PUB | SEG=LSU_CONSTANTS |
| COMA_TRANS. . . . . | B ADDR | 0001H.2 | R | PUB | SEG=LSU_CONSTANTS |
| COMA_UNIT . . . . . | B ADDR | 0001H.3 | R | PUB | SEG=LSU_CONSTANTS |
| COMMUN_ICATIONS . . . . | B ADDR | 0000H.2 | R | PUB | SEG=LSU_CONSTANTS |
| CWT0. . . . . | NUMB | 0030H | A | PUB | |
| CWT1. . . . . | NUMB | 0070H | A | PUB | |
| CWT2. . . . . | NUMB | 00B0H | A | PUB | |
| ERROR_BYTE. . . . . | NUMB | 0020H | A | PUB | |
| ERROR_RANGING . . . . . | NUMB | 0022H | A | PUB | |
| EXIT_WHICH. . . . . | ---- | ---- | | PUB | |
| LSU_CONSTANTS_VARIABLES | ---- | ---- | | | |
| LSU_CONSTANTS . . . . . | B SEG | 0018H | | | REL=UNIT |
| LSU_VARIABLES . . . . . | D SEG | 0044H | | | REL=UNIT |
| MAX_WINDOW_TIMEOUT. . . | B ADDR | 0002H.3 | R | PUB | SEG=LSU_CONSTANTS |
| MSG_BUFFER. . . . . | D ADDR | 001AH | R | PUB | SEG=LSU_VARIABLES |
| MSG_READY . . . . . | D ADDR | 0004H | R | PUB | SEG=LSU_VARIABLES |
| NO_POWER. . . . . | B ADDR | 0000H.3 | R | PUB | SEG=LSU_CONSTANTS |
| NODE_ADDRESS. . . . . | D ADDR | 0003H | R | PUB | SEG=LSU_VARIABLES |
| PCON. . . . . | NUMB | 0087H | A | PUB | |
| RAM_ADDRESS . . . . . | D ADDR | 0002H | R | PUB | SEG=LSU_VARIABLES |
| RAM_BAD . . . . . | D ADDR | 0001H | R | PUB | SEG=LSU_VARIABLES |
| RAM_ERROR . . . . . | B ADDR | 0000H.1 | R | PUB | SEG=LSU_CONSTANTS |
| RAM_GOOD. . . . . | D ADDR | 0000H | R | PUB | SEG=LSU_VARIABLES |
| RANGE_ERROR . . . . . | B ADDR | 0000H.4 | R | PUB | SEG=LSU_CONSTANTS |
| RESULT_INCONSIS . . . . | B ADDR | 0002H.1 | R | PUB | SEG=LSU_CONSTANTS |
| SIX_PULSES. . . . . | D ADDR | 0019H | R | PUB | SEG=LSU_VARIABLES |
| STACK . . . . . | D ADDR | 0005H | R | PUB | SEG=LSU_VARIABLES |
| TEMP_VALUE. . . . . | D ADDR | 0038H | R | PUB | SEG=LSU_VARIABLES |
| TIME_OUT1 . . . . . | D ADDR | 0042H | R | PUB | SEG=LSU_VARIABLES |
| TIME_OUT2 . . . . . | D ADDR | 0043H | R | PUB | SEG=LSU_VARIABLES |
| TIMER_ERROR . . . . . | B ADDR | 0002H.0 | R | PUB | SEG=LSU_CONSTANTS |
| UNKNON_VALUE. . . . . | B ADDR | 0002H.2 | R | PUB | SEG=LSU_CONSTANTS |
| XX1 . . . . . | B ADDR | 0000H.5 | R | | SEG=LSU_CONSTANTS |
| XX2 . . . . . | B ADDR | 0002H.4 | R | | SEG=LSU_CONSTANTS |

REGISTER BANK(S) USED: 0, TARGET MACHINE(S): 8051
ASSEMBLY COMPLETE, NO ERRORS FOUND

```
ISIS-II MCS-51 MACRO ASSEMBLER V2.0
OBJECT MODULE PLACED IN :F1:OILFND.OBJ
ASSEMBLER INVOKED BY:  ASM51 :F1:OILFND.A51 DB PL(50)

LOC  OBJ              LINE     SOURCE

                         1     NAME FOUND_OIL
                         2     ;
                         3     ;
                         4     ;
                         5     PUBLIC OIL_FOUND
                         6     EXTRN DATA(MSG_BUFFER)
                         7     ;
                         8     FOUND_OIL SEGMENT CODE
----                     9     RSEG FOUND_OIL
                        10     ;
                        11     OIL_FOUND:
0000 7590D0             12             MOV     P1,#0D0H              ;LOWER ALL GATES DISABLE TIMERS
0003 C2AF               13             CLR     EA                    ;DISABLE INTERRUPTS
0005 758320             14             MOV     DPH,#20H              ;TO DATA PORT
0008 E0                 15             MOVX    A,@DPTR               ;READ LOW BYTE
0009 FA                 16             MOV     R2,A
000A E0                 17             MOVX    A,@DPTR               ;READ HIGH BYTE
000B F9                 18             MOV     R1,A
                        19     ;THE COUNTER CONTENTS HAVE BEEN READ AT THIS POINT
                        20     ;
000C E9                 21             MOV     A,R1
000D F4                 22             CPL     A
000E F500      F        23             MOV     MSG_BUFFER+6,A        ;STORE HIGH BYTE
0010 EA                 24             MOV     A,R2
0011 F4                 25             CPL     A
0012 F500      F        26             MOV     MSG_BUFFER+5,A
0014 D2D1               27             SETB    PSW.1                 ;INDICATE INTERRUPT RECIEVED
0016 32                 28             RETI
                        29     ;
                        30     ;
                        31     END
SYMBOL TABLE LISTING
------ ----- -------
N A M E     T Y P E   V A L U E       A T T R I B U T E S

DPH. . . .  D ADDR    0083H   A
EA . . . .  B ADDR    00A8H.7 A
FOUND_OIL.  C SEG     0017H           REL=UNIT
MSG_BUFFER  D ADDR    ----    . EXT
OIL_FOUND.  C ADDR    0000H   R PUB   SEG=FOUND_OIL
P1 . . . .  D ADDR    0090H   A
PSW. . . .  D ADDR    00D0H   A
REGISTER BANK(S) USED: 0, TARGET MACHINE(S): 8051
ASSEMBLY COMPLETE, NO ERRORS FOUND
```

```
ISIS-II MCS-51 MACRO ASSEMBLER V2.0
OBJECT MODULE PLACED IN :F1:RANGE.OBJ
ASSEMBLER INVOKED BY:  ASM51 :F1:RANGE.A51 DB PL(50)

LOC  OBJ            LINE     SOURCE

                      1      NAME RANGE_TASK_START
                      2      ; THIS ROUTINE INITIALIZES THE COUNTERS AND VARIABLE
                      3      ; MEMORY TO START A RANGING PROCESS
                      4      ; ENTERS FROM THE TASK_RANGING AND  FIRES THE SENSOR
                      5      ;
                      6      ;
                      7      ; EXTRN MODULES USED- NONE
                      8      ; ENTERS FROM TSKRAN.A51
                      9      ;
                     10      PUBLIC TASK_START
                     11      ;
                     12      EXTRN CODE(TASK_RANGING)
                     13      EXTRN DATA(CWT0,CWT1,CWT2)
                     14      EXTRN DATA(TIME_OUT1)
                     15      ;
                     16      RANGE_TASK_START SEGMENT CODE
----                 17      RSEG RANGE_TASK_START
                     18      ;
                     19      TASK_START:
                     20      ; THIS SECTION LOAD THE VALUES IN MEMORY INTO THE COUNTERS
                     21      ; EITHER THE STANDARD VALUES OR MODIFIED VALUES DURING SECOND PASS
0000 C2AF            22              CLR     EA                      ;DISABLE INTERRUPTS
0002 7590D0          23              MOV     P1,#0D0H
0005 758323          24              MOV     DPH,#023H               ;CONTROL PORT
0008 7400      F     25              MOV     A,#CWT2                 ;SINGLE BYTE MODE
000A F0              26              MOVX    @DPTR,A
000B 758322          27              MOV     DPH,#022H               ;DATA PORT T2
000E 74FF            28              MOV     A,#0FFH                 ;LOW BYTE
0010 F0              29              MOVX    @DPTR,A                 ;AND STORE IT
0011 74FF            30              MOV     A,#0FFH         ;WINDOW TIME
0013 F0              31              MOVX    @DPTR,A                 ;HIGH BYTE
                     32      FIND_MODE:
0014 7400      F     33              MOV     A,#CWT0                 ;GET T0 CONTROL WORD
0016 758323          34              MOV     DPH,#023H               ;ADDRESS OF CONTROL PORT
0019 F0              35              MOVX    @DPTR,A                 ;STORE CONTROL WORD
001A 758320          36              MOV     DPH,#20H                ;DATA PORT ADDRESS FOR T0
001D 74FF            37              MOV     A,#0FFH                 ;START WITH MAX COUNT
001F F0              38              MOVX    @DPTR,A
0020 F0              39              MOVX    @DPTR,A                 ;LOAD 16BITS OF FFFFH
0021 758323          40              MOV     DPH,#023H               ;BACK TO CONTROL PORT
```

```
LOC  OBJ            LINE     SOURCE

0024 7400      F      41            MOV     A,#CWT1                 ;PORT 1 CONTROL WORD
0026 F0               42            MOVX    @DPTR,A
0027 758321           43            MOV     DPH,#021H               ;DATA PORT T1
002A 74FF             44            MOV     A,#0FFH                 ;DATA VALUE FOR T1 LSB??????
002C F0               45            MOVX    @DPTR,A
002D 7400             46            MOV     A,#0                    ;MSB OF BLANKING
002F F0               47            MOVX    @DPTR,A
                      48     ; AT THIS POINT ALL COUNTER ARE INITIALIZED FOR THE TASK AT HAND
0030 C2BC             49            CLR     PS                      ;SERIAL NOT HIGEST PRIORITY
0032 C2AC             50            CLR     ES                      ;NO SERIAL INTERRRUPT
0034 D2A8             51            SETB    EX0                     ;ENABLE INT0/
0036 D2AA             52            SETB    EX1                     ;ENABLE INT1/
0038 D2B8             53            SETB    PX0                     ;MAKE INT0/ HIGHEST PRIORITY
003A 7590D3           54            MOV     P1,#11010011B           ;RAISE INIT
                      55     ;DELAY 350 MICRO SECONDS FOR THE TIME IT TAKES TO FIRE THE
                      56     ;16 PULSES IN FIRING OF THE SONAR BOARD
003D D2AF             57            SETB    EA                      ;ENABLE INTERRUPTS
003F 75005B    F      58            MOV     TIME_OUT1,#5BH                  ;350 MICRO SEC
0042 D500FD    F      59            DJNZ    TIME_OUT1,$                     ;DELAY INITIAL BLANKING TIME
                      60     EXIT_TSK:
0045 7590DF           61            MOV     P1,#11011111B           ;START T1 BLANKING TIME TIMER
0048 C2D1             62            CLR     PSW.1
                      63     ;
004A 30D1FD           64            JNB     PSW.1,$                 ;WAIT FOR ECHO
004D 020000    F      65            JMP     TASK_RANGING
                      66     END
```

SYMBOL TABLE LISTING
------ ----- -------

```
N A M E            T Y P E   V A L U E       A T T R I B U T E S

CWT0 . . . . . .   D ADDR    ----      EXT
CWT1 . . . . . .   D ADDR    ----      EXT
CWT2 . . . . . .   D ADDR    ----      EXT
DPH. . . . . . .   D ADDR    0083H   A
EA . . . . . . .   B ADDR    00A8H.7 A
ES . . . . . . .   B ADDR    00A8H.4 A
EX0. . . . . . .   B ADDR    00A8H.0 A
EX1. . . . . . .   B ADDR    00A8H.2 A
EXIT_TSK . . . .   C ADDR    0045H   R       SEG=RANGE_TASK_START
FIND_MODE. . . .   C ADDR    0014H   R       SEG=RANGE_TASK_START
P1 . . . . . . .   D ADDR    0090H   A
PS . . . . . . .   B ADDR    00B8H.4 A
PSW. . . . . . .   D ADDR    00D0H   A
PX0. . . . . . .   B ADDR    00B8H.0 A
RANGE_TASK_START   C SEG     0050H           REL=UNIT
```

```
N A M E                  T Y P E   V A L U E      A T T R I B U T E S

TASK_RANGING . .  C ADDR    ----       EXT
TASK_START . . .  C ADDR    0000H    R PUB    SEG=RANGE_TASK_START
TIME_OUT1. . . .  D ADDR    ----       EXT


REGISTER BANK(S) USED: 0, TARGET MACHINE(S): 8051

ASSEMBLY COMPLETE, NO ERRORS FOUND

 ISIS-II MCS-51 MACRO ASSEMBLER V2.0
 OBJECT MODULE PLACED IN :F1:SENDMS.OBJ
 ASSEMBLER INVOKED BY:  ASM51 :F1:SENDMS.A51 DB PL(50)


 LOC  OBJ              LINE     SOURCE

                         1      NAME SEND_MESSAGE_RESULTS
                         2      ;
                         3      ; THIS MODULE SEND A MESSAGE TO THE LTD
                         4      ; IT ASSUMES THAT THE MESSAGE HAS ALREADY BEEN
                         5      ; BUILT
                         6      ;
                         7      SEND_MESSAGE_RESULTS SEGMENT CODE
 ----                    8      RSEG SEND_MESSAGE_RESULTS
                         9      ;
                        10      PUBLIC  SEND_BUFFER,SEND_REVISION,SEND_CHAR
                        11      ;
                        12      EXTRN DATA(MSG_BUFFER,NODE_ADDRESS)
                        13      EXTRN CODE(TASK_RANGING)
                        14      ;
                        15      ;
                        16      SEND_BUFFER:
 0000 C294              17              CLR     P1.4
 0002 E500      F       18              MOV     A,MSG_BUFFER
 0004 120000    F       19              CALL    SEND_CHAR
 0007 E500      F       20              MOV     A,MSG_BUFFER+1
 0009 120000    F       21              CALL    SEND_CHAR
 000C E500      F       22              MOV     A,MSG_BUFFER+2
 000E 120000    F       23              CALL    SEND_CHAR
 0011 E500      F       24              MOV     A,MSG_BUFFER+3
 0013 120000    F       25              CALL    SEND_CHAR
 0016 D294              26              SETB    P1.4
 0018 020000    F       27              JMP     TASK_RANGING            ;TAKE A READING
                        28      ;
                        29      SEND_REVISION:
 001B C294              30              CLR     P1.4                    ;ENABLE TRANSMITTER
 001D E500      F       31              MOV     A,NODE_ADDRESS
 001F 120000    F       32              CALL    SEND_CHAR
```

```
LOC  OBJ            LINE     SOURCE

0022 7410             33              MOV     A,#10H                  ;TYPE
0024 120000    F      34              CALL    SEND_CHAR
0027 7402             35              MOV     A,#02                   ;REVISION
0029 120000    F      36              CALL    SEND_CHAR
002C E500      F      37              MOV     A,NODE_ADDRESS
002E 2412             38              ADD     A,#12H
0030 F4               39              CPL     A
0031 04               40              INC     A
0032 120000    F      41              CALL    SEND_CHAR
0035 D294             42              SETB    P1.4                    ;DISABLE TRANSMITTER
0037 22               43              RET
                      44      ;
                      45      SEND_CHAR:
0038 F599             46              MOV     SBUF,A
003A 3099FD           47              JNB     TI,$
003D C299             48              CLR     TI
003F 22               49              RET
                      50      ;
                      51      END

SYMBOL TABLE LISTING
------ ----- -------

N A M E                 T Y P E   V A L U E       A T T R I B U T E S

MSG_BUFFER . . . . .    D ADDR    ----       EXT
NODE_ADDRESS . . . .    D ADDR    ----       EXT
P1 . . . . . . . . .    D ADDR    0090H   A
SBUF . . . . . . . .    D ADDR    0099H   A
SEND_BUFFER. . . . .    C ADDR    0000H   R PUB   SEG=SEND_MESSAGE_RESULTS
SEND_CHAR. . . . . .    C ADDR    0038H   R PUB   SEG=SEND_MESSAGE_RESULTS
SEND_MESSAGE_RESULTS    C SEG     0040H           REL=UNIT
SEND_REVISION. . . .    C ADDR    001BH   R PUB   SEG=SEND_MESSAGE_RESULTS
TASK_RANGING . . . .    C ADDR    ----       EXT
TI . . . . . . . . .    B ADDR    0098H.1 A
REGISTER BANK(S) USED: 0, TARGET MACHINE(S): 8051
ASSEMBLY COMPLETE, NO ERRORS FOUND

ISIS-II MCS-51 MACRO ASSEMBLER V2.0
OBJECT MODULE PLACED IN :F1:SERIAL.OBJ
ASSEMBLER INVOKED BY:  ASM51 :F1:SERIAL.A51 DB PL(50)

LOC  OBJ            LINE     SOURCE

                       1      NAME SERIAL_SETUP
                       2      ;
                       3      ; EXTRN MODULES USED- NONE
                       4      ; ENTERS FROM BEGCOD.A51,SLEEP.A51
                       5      ;
```

```
LOC  OBJ            LINE     SOURCE

                      6      SERIAL_SETUP SEGMENT CODE
----                  7              RSEG    SERIAL_SETUP
                      8      ;THIS ROUTINE SETS UP THE SERIAL PORT FOR
                      9      ;MODE 2 10BIT WORD,
                     10      ;       1 START BIT
                     11      ;       8 DATA
                     12      ;       1 STOP BIT          NO PARITY
                     13      PUBLIC SERSET
                     14      EXTRN DATA(PCON)
                     15
                     16      SERSET:
                     17      ;FIRST INITIALIZE TIMER 1 FOR AUTO RELOAD
                     18      ;AND START IT COUNTING FOR THE DESIRED BAUD RATE
                     19      ; THE FOLLOWING ARE THE VALUES TO LOAD
                     20      ; INTO TH1 FOR THE DESIRED RATE
0000 758920          21              MOV     TMOD,#00100000B
0003 758DF9          22              MOV     TH1,#(-7)               ;2400 BAUD @6.4MHz
0006 759850          23              MOV     SCON,#01010000B         ;PREPARE SERIAL PORT
0009 D28E            24              SETB    TR1                     ;START COUNTER
000B 22              25              RET
                     26              END
```

SYMBOL TABLE LISTING
------ ----- -------

```
N A M E        T Y P E   V A L U E       A T T R I B U T E S

PCON . . . .   D ADDR    ----      EXT
SCON . . . .   D ADDR    0098H   A
SERIAL_SETUP   C SEG     000CH           REL=UNIT
SERSET . . .   C ADDR    0000H   R PUB   SEG=SERIAL_SETUP
TH1. . . . .   D ADDR    008DH   A
TMOD . . . .   D ADDR    0089H   A
TR1. . . . .   B ADDR    0088H.6 A
```

REGISTER BANK(S) USED: 0, TARGET MACHINE(S): 8051

ASSEMBLY COMPLETE, NO ERRORS FOUND

```
ISIS-II MCS-51 MACRO ASSEMBLER V2.0
OBJECT MODULE PLACED IN :F1:SLFTST.OBJ
ASSEMBLER INVOKED BY:  ASM51 :F1:SLFTST.A51 DB PL(50)

LOC  OBJ              LINE     SOURCE

                        1      NAME SELF_TEST
                        2      ;
                        3      SELF_TEST SEGMENT CODE
----                    4              RSEG    SELF_TEST
                        5      ; THIS ROUTINE IS FOR CHECKING THE INTERNAL WORKINGS OF THE
                        6      ; LSU MODULE FOR CHECKSUM ON THE PROM AND THE INTERNAL RAM
                        7      ; SPACE OF THE 8031
                        8      ;
                        9      ; EXTRN MODULES USED CHKBUS.A51,TMEMOR.A51,CHKSUM.A51,TSKMAN.A51
                       10      ; ENTERS FROM TSKMAN.A51
                       11      ; EXITS TO TSKMAN.A51
                       12      ;
                       13      PUBLIC  TEST_TIMER
                       14      EXTRN   DATA(ERROR_BYTE,CWT0,CWT1,CWT2,TIME_OUT1,TIME_OUT2)
                       15      EXTRN   BIT(CHK_ERROR,RAM_ERROR,TIMER_ERROR,RANGE_ERROR)
                       16      EXTRN   CODE(DELAY)
                       17      ;
                       18      ;
                       19      ; THIS IS THE TIMER TEST IT LOADS MAX VALUES
                       20      ; DELAYS FOR A WHILE AND CHECKS THE COUNT FOR
                       21      ; A NUMBER BETWEEN A RANGE
                       22      ;
                       23      TEST_TIMER:
0000 7590D0            24              MOV     P1,#0D0H
0003 7800      F       25              MOV     R0,#CWT0                ;CONTROL BYTE FOR T0
0005 7920              26              MOV     R1,#20H                 ;DATA PORT ADDRESS
0007 758323            27              MOV     DPH,#23H                ;CONTROL PORT ADDRESS
000A 120000    F       28              CALL    LOAD_TIMER
000D 7500FF    F       29              MOV     TIME_OUT1,#0FFH
0010 750001    F       30              MOV     TIME_OUT2,#01
0013 D291              31              SETB    P1.1                    ;ENABLE IT FOR COUNTING
0015 120000    F       32              CALL    DELAY
0018 C291              33              CLR     P1.1                    ;STOP THE COUNTING
001A 120000    F       34              CALL    CHECK_COUNT
001D 4050              35              JC      EXIT_ERROR
001F 7800      F       36              MOV     R0,#CWT1
0021 7921              37              MOV     R1,#21H                 ;DATA PORT FOR T1
0023 758323            38              MOV     DPH,#23H
0026 120000    F       39              CALL    LOAD_TIMER
0029 7500FF    F       40              MOV     TIME_OUT1,#0FFH
```

```
LOC  OBJ            LINE     SOURCE

002C 750001   F       41            MOV     TIME_OUT2,#1
002F D292             42            SETB    P1.2
0031 120000   F       43            CALL    DELAY
0034 C292             44            CLR     P1.2
0036 120000   F       45            CALL    CHECK_COUNT
0039 4034             46            JC      EXIT_ERROR
003B 758323           47            MOV     DPH,#23H                ;CONTROL PORT
003E 7400     F       48            MOV     A,#CWT1
0040 F0               49            MOVX    @DPTR,A
0041 758321           50            MOV     DPH,#21H                ;DATA PORT
0044 7410             51            MOV     A,#10H
0046 F0               52            MOVX    @DPTR,A
0047 E4               53            CLR     A
0048 F0               54            MOVX    @DPTR,A                 ;MIN COUNT FOR T1
0049 758323           55            MOV     DPH,#23H
004C 7400     F       56            MOV     A,#CWT2
004E F0               57            MOVX    @DPTR,A
004F 758322           58            MOV     DPH,#22H                ;DATA PORT T2
0052 74EF             59            MOV     A,#0EFH                 ;MAX - 10H
0054 F0               60            MOVX    @DPTR,A
0055 74FF             61            MOV     A,#0FFH
0057 F0               62            MOVX    @DPTR,A
0058 7500FF   F       63            MOV     TIME_OUT1,#0FFH
005B 750001   F       64            MOV     TIME_OUT2,#1
005E D292             65            SETB    P1.2
0060 D293             66            SETB    P1.3
0062 120000   F       67            CALL    DELAY
0065 C293             68            CLR     P1.3                    ;STOP IT
0067 7922             69            MOV     R1,#22H
0069 120000   F       70            CALL    CHECK_COUNT
006C 4001             71            JC      EXIT_ERROR
006E 22               72            RET
                      73     EXIT_ERROR:
006F D200     F       74            SETB    TIMER_ERROR
0071 D200     F       75            SETB    RANGE_ERROR
0073 D3               76            SETB    C
0074 22               77            RET
                      78     LOAD_TIMER:
0075 E8               79            MOV     A,R0            ;GET CONTROL WORD
0076 F0               80            MOVX    @DPTR,A         ;STORE CONTROL WORD
0077 8983             81            MOV     DPH,R1          ;DATA PORT ADDRESS
0079 74FF             82            MOV     A,#0FFH         ;MAX COUNT
007B F0               83            MOVX    @DPTR,A
007C F0               84            MOVX    @DPTR,A         ;STORE COUNT
007D 22               85            RET
```

```
LOC  OBJ            LINE     SOURCE

                     86      CHECK_COUNT:
007E E9              87              MOV     A,R1            ;GET LAST DATA PORT ADDRESS
                     88      ;
                     89      ONE_TWO:
007F F583            90              MOV     DPH,A           ;RESTORE ADDRESS
0081 E0              91              MOVX    A,@DPTR
0082 F8              92              MOV     R0,A
0083 E0              93              MOVX    A,@DPTR
0084 F9              94              MOV     R1,A
0085 120000    F     95              CALL    GOOD_COUNT
0088 22              96              RET
                     97      ;
                     98      GOOD_COUNT:
0089 C3              99              CLR     C
008A E9             100              MOV     A,R1            ;HIGH BYTE
008B 94FC           101              SUBB    A,#0FCH
008D 700C           102              JNZ     TIMER_COUNT_ERROR
008F E8             103              MOV     A,R0            ;LOW BYTE
0090 9430           104              SUBB    A,#30H
0092 B40A02         105              CJNE    A,#10,CHECK_ERROR       ;+-10MICRO SEC
0095 C3             106              CLR     C
0096 22             107              RET
                    108      CHECK_ERROR:
0097 5002           109              JNC     TIMER_COUNT_ERROR
0099 C3             110              CLR     C
009A 22             111              RET
                    112      TIMER_COUNT_ERROR:
009B D3             113              SETB    C
009C 22             114              RET
                    115      END
```

SYMBOL TABLE LISTING
------ ----- -------

```
N A M E            T Y P E   V A L U E      A T T R I B U T E S

CHECK_COUNT . . .  C ADDR    007EH   R      SEG=SELF_TEST
CHECK_ERROR . . .  C ADDR    0097H   R      SEG=SELF_TEST
CHK_ERROR . . . .  B ADDR    ----      EXT
CWT0. . . . . . .  D ADDR    ----      EXT
CWT1. . . . . . .  D ADDR    ----      EXT
CWT2. . . . . . .  D ADDR    ----      EXT
DELAY . . . . . .  C ADDR    ----      EXT
DPH . . . . . . .  D ADDR    0083H   A
ERROR_BYTE. . . .  D ADDR    ----      EXT
```

```
N A M E                T Y P E   V A L U E      A T T R I B U T E S

EXIT_ERROR. . . .  C ADDR    006FH   R       SEG=SELF_TEST
GOOD_COUNT. . . .  C ADDR    0089H   R       SEG=SELF_TEST
LOAD_TIMER. . . .  C ADDR    0075H   R       SEG=SELF_TEST
ONE_TWO . . . . .  C ADDR    007FH   R       SEG=SELF_TEST
P1. . . . . . . .  D ADDR    0090H   A
RAM_ERROR . . . .  B ADDR    ----      EXT
RANGE_ERROR . . .  B ADDR    ----      EXT
SELF_TEST . . . .  C SEG     009DH           REL=UNIT
TEST_TIMER. . . .  C ADDR    0000H   R PUB   SEG=SELF_TEST
TIME_OUT1 . . . .  D ADDR    ----      EXT
TIME_OUT2 . . . .  D ADDR    ----      EXT
TIMER_COUNT_ERROR  C ADDR    009BH   R       SEG=SELF_TEST
TIMER_ERROR . . .  B ADDR    ----      EXT

REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:TMEMOR.OBJ
ASSEMBLER INVOKED BY:  ASM51 :F1:TMEMOR.A51 DB PL(50)


LOC  OBJ            LINE     SOURCE

                      1      NAME TEST_MEMORY
                      2      ;ENTERS WITH R2 INDICATING WHICH VERSION OF THE TEST TO EXECUTE
                      3      ; IF R2=00 THE SELFTEST VERSION IS EXECUTED TESTING MESSAGE BUF MEM
                      4      ; IF R2=XX ANYTHING OTHER THAN 00 THE FULL RAM SPACE IS TESTED
                      5      ; BOTH EXIT WITH A RET.
                      6      ;USES A,R0,R1,R2,R3
                      7      ;
                      8      ; EXTRN MODULES USED- NONE
                      9      ; ENTERS FROM SLFTST.A51, BEGCOD.A51 MODULES
                     10      ;
                     11      PUBLIC MEM_TEST
                     12      EXTRN CODE(POWER_BACK)
                     13      EXTRN   DATA(RAM_GOOD,RAM_BAD,RAM_ADDRESS)
                     14      EXTRN   BIT(RAM_ERROR)
                     15      ;
                     16      TEST_MEMORY SEGMENT CODE
----                 17      RSEG    TEST_MEMORY
                     18      ;
                     19      MEM_TEST:
0000 7808            20              MOV     R0,#08H                 ;START FOR POWER UP
0002 7978            21              MOV     R1,#78H                 ;LENGTH
```

```
LOC  OBJ            LINE    SOURCE
0004 E9               22            MOV     A,R1                  ;SAVE CAPACITY
0005 FB               23            MOV     R3,A
0006 7455             24            MOV     A,#055H               ;FIRST VALUE TO FILL MEMORY
0008 F6               25    WAG55:  MOV     @R0,A                 ;STORE VALUE (R0)
0009 08               26            INC     R0                    ;INC POINTER
000A D9FC             27            DJNZ    R1,WAG55              ;DEC CAPACITY JMP NOT ZERO AGAIN
000C 18               28            DEC     R0
000D FC               29            MOV     R4,A
000E EB               30            MOV     A,R3
000F F9               31            MOV     R1,A                  ;RESTORE CAPACITY
0010 EC               32            MOV     A,R4                  ;RESTORE A
0011 B6552E           33    RAG55:  CJNE    @R0,#55H,RERR         ;COMPARE FOR 55H
0014 18               34            DEC     R0                    ;BACKWARDS NOW
0015 D9FA             35            DJNZ    R1,RAG55              ;DEC COUNT AND REPEAT
0017 08               36            INC     R0
0018 EB               37            MOV     A,R3
0019 F9               38            MOV     R1,A
001A 74AA             39            MOV     A,#0AAH               ;NEXT AAH
001C F6               40    WAGAA:  MOV     @R0,A                 ;STORE VALUE
001D 08               41            INC     R0                    ;FORWARDS
001E D9FC             42            DJNZ    R1,WAGAA              ;R1 TIMES
0020 18               43            DEC     R0
0021 FC               44            MOV     R4,A                  ;TEMP STORE A
0022 EB               45            MOV     A,R3
0023 F9               46            MOV     R1,A
0024 EC               47            MOV     A,R4
0025 B6AA1A           48    RAGAA:  CJNE    @R0,#0AAH,RERR
0028 18               49            DEC     R0
0029 D9FA             50            DJNZ    R1,RAGAA
002B 08               51            INC     R0
002C EB               52            MOV     A,R3
002D F9               53            MOV     R1,A
002E E4               54            CLR     A                     ;CLEAR A
002F F6               55    WAG00:  MOV     @R0,A                 ;WRITE 00
0030 08               56            INC     R0
0031 D9FC             57            DJNZ    R1,WAG00
0033 18               58            DEC     R0
0034 FC               59            MOV     R4,A
0035 EB               60            MOV     A,R3
0036 F9               61            MOV     R1,A
0037 EC               62            MOV     A,R4
0038 B60007           63    RAG00:  CJNE    @R0,#00,RERR
003B 18               64            DEC     R0
003C D9FA             65            DJNZ    R1,RAG00
003E C3               66            CLR     C
003F 020000     F     67    BACK:   JMP     POWER_BACK
0042 8800       F     68    RERR:   MOV     RAM_ADDRESS,R0        ;STORE BAD RAM ADDRESS
```

```
LOC  OBJ            LINE     SOURCE

0044 F500     F       69            MOV     RAM_GOOD,A              ;STORE GOOD VALUE
0046 E6               70            MOV     A,@R0                   ;GET BAD VALUE
0047 F500     F       71            MOV     RAM_BAD,A               ;AND STORE
0049 D200     F       72            SETB    RAM_ERROR               ;SET ERROR FLAG
004B D3               73            SETB    C
004C 80F1             74            SJMP    BACK                    ;AND EXIT
                      75     END
```

SYMBOL TABLE LISTING
------ ----- -------

| N A M E | T Y P E | V A L U E | | | A T T R I B U T E S |
|---|---|---|---|---|---|
| BACK. . . . | C ADDR | 003FH | R | | SEG=TEST_MEMORY |
| MEM_TEST. . | C ADDR | 0000H | R | PUB | SEG=TEST_MEMORY |
| POWER_BACK. | C ADDR | ---- | | EXT | |
| RAG00 . . . | C ADDR | 0038H | R | | SEG=TEST_MEMORY |
| RAG55 . . . | C ADDR | 0011H | R | | SEG=TEST_MEMORY |
| RAGAA . . . | C ADDR | 0025H | R | | SEG=TEST_MEMORY |
| RAM_ADDRESS | D ADDR | ---- | | EXT | |
| RAM_BAD . . | D ADDR | ---- | | EXT | |
| RAM_ERROR . | B ADDR | ---- | | EXT | |
| RAM_GOOD. . | D ADDR | ---- | | EXT | |
| RERR. . . . | C ADDR | 0042H | R | | SEG=TEST_MEMORY |
| TEST_MEMORY | C SEG | 004EH | | | REL=UNIT |
| WAG00 . . . | C ADDR | 002FH | R | | SEG=TEST_MEMORY |
| WAG55 . . . | C ADDR | 0008H | R | | SEG=TEST_MEMORY |
| WAGAA . . . | C ADDR | 001CH | R | | SEG=TEST_MEMORY |

REGISTER BANK(S) USED: 0, TARGET MACHINE(S): 8051

ASSEMBLY COMPLETE, NO ERRORS FOUND

ISIS-II MCS-51 MACRO ASSEMBLER V2.0
OBJECT MODULE PLACED IN :F1:TSKRAN.OBJ
ASSEMBLER INVOKED BY:  ASM51 :F1:TSKRAN.A51 DB PL(50)

```
LOC  OBJ            LINE     SOURCE

                       1     NAME RANGING_TASK_MANAGER
                       2     ;
                       3     ;  THIS IS THE MAIN RANGING MODULE TASK
                       4     ;
                       5     ; FOR TO VALUE  HIGH_VALUE= TEMP_VALUE+0 (LSB)
```

```
LOC  OBJ                LINE    SOURCE
                         6      ;                HIGH_VALUE= TEMP_VALUE+1 (MSB)
                         7      ;                LOW_VALUE = TEMP_VALUE+2 (LSB)
                         8      ;                LOW_VALUE = TEMP_VALUE+3 (MSB)
                         9      ;
                        10      ;  USES THE FOLLOW MEMORY LOCATION FOR OVERALL VALUES
                        11      ;
                        12      ; FOR T0_OVERALL     BUFF_VALUE+0,+1,+2
                        13      ;
                        14      RANGING_TASK_MANAGER SEGMENT CODE
----                    15      RSEG RANGING_TASK_MANAGER
                        16      ;
                        17      PUBLIC TASK_RANGING
                        18      EXTRN CODE(TASK_START,GET_MSG)
                        19      EXTRN CODE(UPDATE_VALUE)
                        20      EXTRN CODE(BUS_POWER,DIAGNO,TEST_TIMER)
                        21      EXTRN CODE(AVER_AGE,SEND_RESULTS)
                        22      EXTRN DATA(MSG_BUFFER,TIME_OUT1,TIME_OUT2)
                        23      EXTRN DATA(TEMP_VALUE,BUFF_VALUE)
                        24      EXTRN DATA(SIX_PULSES,NODE_ADDRESS)
                        25      EXTRN BIT(RANGE_ERROR,NO_POWER)
                        26      EXTRN BIT(TIMER_ERROR)
                        27      ;
                        28      ; ENTERS HERE FROM THE TASK_MANAGER WITH
                        29      ; THE ABOVE OPTION
                        30      ;
                        31      TASK_RANGING:
                        32      ;
0000 E500        F      33              MOV     A,SIX_PULSES
0002 B40003             34              CJNE    A,#00,FIRE_AGAIN
0005 020000      F      35              JMP     INIT
                        36      ;
                        37      FIRE_AGAIN:
0008 120000      F      38              CALL    UPDATE_VALUE
000B 7500FF      F      39              MOV     TIME_OUT1,#0FFH
000E 75003F      F      40              MOV     TIME_OUT2,#03FH
                        41      DELAY:
0011 D500FD      F      42              DJNZ    TIME_OUT1,$             ;WAIT A WHILE
0014 D500FA      F      43              DJNZ    TIME_OUT2,DELAY
0017 D50009      F      44              DJNZ    SIX_PULSES,FIRE_START   ;IF HERE FIRE SECOND START PULSE
001A 120000      F      45              CALL    AVER_AGE
001D 759030             46              MOV     P1,#00110000B
0020 020000      F      47              JMP     BUILD_MESSAGE
                        48      ;
                        49      FIRE_START:
                        50      ;
                        51      ; FIRE_START JUMPS TO TASK_START WHICH LOADS
                        52      ; PREDETERMINED VALUES FOR THE TIMERS IN A NORMAL PULSE
                        53      ;
```

```
LOC  OBJ            LINE     SOURCE

                     54      ; THIS INITS VALUES USED BY THE RANGING ROUTINES
0023 750000    F     55              MOV     MSG_BUFFER+5,#0
0026 750000    F     56              MOV     MSG_BUFFER+6,#0          ;INITIALIZE ALL VARIABLES
0029 020000    F     57              JMP     TASK_START
                     58      ;
                     59      ; THIS PART INITIALIZES ALL VARIABLES FOR SIX PULSES
                     60      ;
                     61      INIT:
                     62      ; INITIAIZE ALL MAX VALUES WITH 00
002C 120000    F     63              CALL    BUS_POWER                ;POWER UP MODULE
002F 5005            64              JNC     INIT_CONT
0031 D200      F     65              SETB    NO_POWER
0033 020000    F     66              JMP     DIAGNO                   ;NO BUS POWER
                     67      INIT_CONT:
0036 120000    F     68              CALL    TEST_TIMER
0039 5007            69              JNC     INIT_CONT1
003B D200      F     70              SETB    RANGE_ERROR              ;SET ERROR BIT
003D D200      F     71              SETB    TIMER_ERROR
003F 020000    F     72              JMP     DIAGNO
                     73      INIT_CONT1:
0042 750000    F     74              MOV     TEMP_VALUE,#0
0045 750000    F     75              MOV     TEMP_VALUE+1,#0
                     76      ; INITIALIZE ALL MIN VALUES WITH FFFFH
0048 7500FF    F     77              MOV     TEMP_VALUE+2,#0FFH
004B 7500FF    F     78              MOV     TEMP_VALUE+3,#0FFH
                     79      ; INIT ALL SIGNED VALUES WITH 7FH
004E 750000    F     80              MOV     BUFF_VALUE,#0
0051 750000    F     81              MOV     BUFF_VALUE+1,#00
0054 750000    F     82              MOV     BUFF_VALUE+2,#00
                     83      ;
                     84      ; INIT ALL OTHER VARIABLES
                     85      ;
0057 750006    F     86              MOV     SIX_PULSES,#06H          ;FOR SIX PULSES
005A 80C7            87              JMP     FIRE_START
                     88      ;
                     89      ;
                     90      BUILD_MESSAGE:
005C 850000    F     91              MOV     MSG_BUFFER+1,BUFF_VALUE
005F 850000    F     92              MOV     MSG_BUFFER+2,BUFF_VALUE+1
0062 850000    F     93              MOV     MSG_BUFFER,NODE_ADDRESS
0065 E500      F     94              MOV     A,MSG_BUFFER             ;ADDRESS OF NODE
0067 2500      F     95              ADD     A,MSG_BUFFER+1
0069 2500      F     96              ADD     A,MSG_BUFFER+2
006B F4              97              CPL     A
006C 04              98              INC     A
006D F500      F     99              MOV     MSG_BUFFER+3,A
006F 020000    F    100              JMP     SEND_RESULTS             ;WAIT TO RESPOND WITH RESULTS
                    101      END
```

```
SYMBOL TABLE LISTING
------ ----- -------

N A M E                T Y P E   V A L U E       A T T R I B U T E S

AVER_AGE . . . . . .   C ADDR    ----      EXT
BUFF_VALUE . . . . .   D ADDR    ----      EXT
BUILD_MESSAGE. . . .   C ADDR    005CH   R         SEG=RANGING_TASK_MANAGER
BUS_POWER. . . . . .   C ADDR    ----      EXT
DELAY. . . . . . . .   C ADDR    0011H   R         SEG=RANGING_TASK_MANAGER
DIAGNO . . . . . . .   C ADDR    ----      EXT
FIRE_AGAIN . . . . .   C ADDR    0008H   R         SEG=RANGING_TASK_MANAGER
FIRE_START . . . . .   C ADDR    0023H   R         SEG=RANGING_TASK_MANAGER
GET_MSG. . . . . . .   C ADDR    ----      EXT
INIT_CONT. . . . . .   C ADDR    0036H   R         SEG=RANGING_TASK_MANAGER
INIT_CONT1 . . . . .   C ADDR    0042H   R         SEG=RANGING_TASK_MANAGER
INIT . . . . . . . .   C ADDR    002CH   R         SEG=RANGING_TASK_MANAGER
MSG_BUFFER . . . . .   D ADDR    ----      EXT
NO_POWER . . . . . .   B ADDR    ----      EXT
NODE_ADDRESS . . . .   D ADDR    ----      EXT
P1 . . . . . . . . .   D ADDR    0090H   A
RANGE_ERROR. . . . .   B ADDR    ----      EXT
RANGING_TASK_MANAGER   C SEG     0072H             REL=UNIT
SEND_RESULTS . . . .   C ADDR    ----      EXT
SIX_PULSES . . . . .   D ADDR    ----      EXT
TASK_RANGING . . . .   C ADDR    0000H   R PUB     SEG=RANGING_TASK_MANAGER
TASK_START . . . . .   C ADDR    ----      EXT
TEMP_VALUE . . . . .   D ADDR    ----      EXT
TEST_TIMER . . . . .   C ADDR    ----      EXT
TIME_OUT1. . . . . .   D ADDR    ----      EXT
TIME_OUT2. . . . . .   D ADDR    ----      EXT
TIMER_ERROR. . . . .   B ADDR    ----      EXT
UPDATE_VALUE . . . .   C ADDR    ----      EXT

REGISTER BANK(S) USED: 0, TARGET MACHINE(S): 8051

ASSEMBLY COMPLETE, NO ERRORS FOUND


ISIS-II MCS-51 MACRO ASSEMBLER V2.0
OBJECT MODULE PLACED IN :F1:UPDATE.OBJ
ASSEMBLER INVOKED BY:  ASM51 :F1:UPDATE.A51 DB PL(50)


LOC  OBJ            LINE     SOURCE

                       1     NAME UPDATE_VARIABLES
                       2     ;
                       3     ; THIS ROUTINE ADDS THE VARIOUS VALUE
```

```
LOC  OBJ                LINE     SOURCE

                          4      ; TO KEEP A RUNNING TOTAL OF THE SIX PULSES
                          5      ;
                          6      UPDATE_VARIABLES SEGMENT CODE
----                      7      RSEG UPDATE_VARIABLES
                          8      ;
                          9      PUBLIC UPDATE_VALUE
                         10      EXTRN DATA(MSG_BUFFER,BUFF_VALUE,TEMP_VALUE)
                         11      ;
                         12      UPDATE_VALUE:
                         13      ; THIS PART ADDS IN THE NEXT VALUE FOR OVERALL COUNT TO
                         14      ; THE OIL
0000 E500       F        15              MOV     A,MSG_BUFFER+5          ;LOW BYTE
0002 2500       F        16              ADD     A,BUFF_VALUE            ;ADD LOW BYTE
0004 F500       F        17              MOV     BUFF_VALUE,A
0006 E500       F        18              MOV     A,MSG_BUFFER+6
0008 3500       F        19              ADDC    A,BUFF_VALUE+1          ;ADDD MSB
000A F500       F        20              MOV     BUFF_VALUE+1,A
000C E4                  21              CLR     A
000D 3500       F        22              ADDC    A,BUFF_VALUE+2
000F F500       F        23              MOV     BUFF_VALUE+2,A          ;IF CARRY OUT OF MSB
                         24      UP_VAL1:
0011 E500       F        25              MOV     A,TEMP_VALUE+3
0013 B50010     F        26              CJNE    A,MSG_BUFFER+6,UP_VAL2  ;HIGH BYTE OF MIN
0016 E500       F        27              MOV     A,TEMP_VALUE+2          ;LOW BYTE OF MIN
0018 B50015     F        28              CJNE    A,MSG_BUFFER+5,UP_VAL3
                         29      UP_VAL6:
001B E500       F        30              MOV     A,TEMP_VALUE+1          ;HIGH BYTE OF MAX
001D B5001A     F        31              CJNE    A,MSG_BUFFER+6,UP_VAL4
0020 E500       F        32              MOV     A,TEMP_VALUE
0022 B5001E     F        33              CJNE    A,MSG_BUFFER+5,UP_VAL5
                         34      UP_VAL7:
0025 22                  35              RET
                         36      UP_VAL2:
                         37      ; IF TEMP_VALUE+3 < MSG_BUFFER+6  C=1
0026 40F3                38              JC      UP_VAL6
0028 850000     F        39              MOV     TEMP_VALUE+3,MSG_BUFFER+6
002B 850000     F        40              MOV     TEMP_VALUE+2,MSG_BUFFER+5
002E 80EB                41              SJMP    UP_VAL6                 ;STORE NEW MIN VALUE
                         42      UP_VAL3:
                         43      ; IF TEMP_VALUE+2 < MSG_BUFFER+5 C=1
0030 40E9                44              JC      UP_VAL6
0032 850000     F        45              MOV     TEMP_VALUE+3,MSG_BUFFER+6
0035 850000     F        46              MOV     TEMP_VALUE+2,MSG_BUFFER+5
0038 80E1                47              SJMP    UP_VAL6
                         48      UP_VAL4:
                         49      ; IF TEMP_VALUE+1 < MSG_BUFFER+6  C=1
003A 50E9                50              JNC     UP_VAL7
```

```
LOC  OBJ            LINE     SOURCE

003C 850000   F       51              MOV     TEMP_VALUE+1,MSG_BUFFER+6
003F 850000   F       52              MOV     TEMP_VALUE,MSG_BUFFER+5
0042 22               53              RET
                      54     UP_VAL5:
                      55     ; IF TEMP_VALUE < MSG_BUFFER+5   C=1
0043 50E0             56              JNC     UP_VAL7
0045 850000   F       57              MOV     TEMP_VALUE+1,MSG_BUFFER+6
0048 850000   F       58              MOV     TEMP_VALUE,MSG_BUFFER+5          ;STORE NEW MAX VALUE
004B 22               59              RET
                      60     END
```

```
SYMBOL TABLE LISTING
------ ----- -------

N A M E            T Y P E   V A L U E       A T T R I B U T E S

BUFF_VALUE . . .   D ADDR    ----       EXT
MSG_BUFFER . . .   D ADDR    ----       EXT
TEMP_VALUE . . .   D ADDR    ----       EXT
UP_VAL1. . . . .   C ADDR    0011H   R        SEG=UPDATE_VARIABLES
UP_VAL2. . . . .   C ADDR    0026H   R        SEG=UPDATE_VARIABLES
UP_VAL3. . . . .   C ADDR    0030H   R        SEG=UPDATE_VARIABLES
UP_VAL4. . . . .   C ADDR    003AH   R        SEG=UPDATE_VARIABLES
UP_VAL5. . . . .   C ADDR    0043H   R        SEG=UPDATE_VARIABLES
UP_VAL6. . . . .   C ADDR    001BH   R        SEG=UPDATE_VARIABLES
UP_VAL7. . . . .   C ADDR    0025H   R        SEG=UPDATE_VARIABLES
UPDATE_VALUE . .   C ADDR    0000H   R PUB    SEG=UPDATE_VARIABLES
UPDATE_VARIABLES   C SEG     004CH            REL=UNIT

REGISTER BANK(S) USED: 0, TARGET MACHINE(S): 8051

ASSEMBLY COMPLETE, NO ERRORS FOUND
```

```
ISIS-II MCS-51 MACRO ASSEMBLER V2.0
OBJECT MODULE PLACED IN :F1:WAIT.OBJ
ASSEMBLER INVOKED BY:  ASM51 :F1:WAIT.A51 DB PL(50)

LOC  OBJ            LINE     SOURCE

                       1     NAME DELAY_WAIT
                       2     ;
                       3     ; ENTERS WITH VALUES TO DECREMENT IN
                       4     ; TIME_OUT1 AND TIME_OUT2
                       5     ;
                       6     DELAY_WAIT SEGMENT CODE
----                   7     RSEG DELAY_WAIT
                       8     ;
                       9     PUBLIC DELAY
                      10     ;
                      11     EXTRN DATA(TIME_OUT1,TIME_OUT2)
                      12     ;
                      13     DELAY:
0000 D500FD    F      14             DJNZ    TIME_OUT1,$
0003 D500FA    F      15             DJNZ    TIME_OUT2,DELAY
0006 22               16             RET
                      17     END


SYMBOL TABLE LISTING
------ ----- -------

N A M E     T Y P E   V A L U E      A T T R I B U T E S

DELAY_WAIT  C SEG     0007H          REL=UNIT
DELAY. . .  C ADDR    0000H   R PUB  SEG=DELAY_WAIT
TIME_OUT1.  D ADDR    ----      EXT
TIME_OUT2.  D ADDR    ----      EXT

REGISTER BANK(S) USED: 0, TARGET MACHINE(S): 8051

ASSEMBLY COMPLETE, NO ERRORS FOUND
```

We claim:

1. A portable oilfield fluid management system movable from one oilfield location to another for measuring the levels of a plurality of different fluids stored in a plurality of storage tanks located at each oilfield location, said storage tanks being either of the same or different sizes, shapes, and capacities, each of said storage tanks having means for gaining access to the interior of the tank and having a strapping table showing volume at different heights within the tank, said system including a plurality of local sensing units and a central monitor with an input device and a display, said central monitor being capable of being interconnected with each of said local sensing units, each of said local sensing units being further connected by means of a sensor cable through said access means to a level sensor attached to an upper inside surface of said storage tank, each said local sensing unit with its connected level sensor being capable of measuring the level of fluid in said storage tank, said system comprising:

means containing each of said local sensing units for attaching each said local sensing unit to an exterior surface of one of said storage tanks in any order of attachment, a plurality of cable segment means for interconnecting electrically each attached local sensing unit to the adjacent local sensing unit so that all local sensing units are connected in series, means connected to said central monitor for electrically connecting said central monitor to the first interconnected local sensing unit, said central monitor being capable of autoconfiguring said attached and interconnected local sensing units in each different oilfield by delivering a first address over said connecting means to said first interconnected local sensing unit, said first local sensing unit being capable of storing said first address as its identity code, said first local sensing unit being further capable of connecting an upstream path in response to said storing so that the adjacent and interconnected local sensing unit is capable of receiving the next address from said central monitor, each of said interconnected local sensing units receiving a unique address from said central monitor and once received connecting an upstream path as aforesaid for said first interconnected local sensing unit, and means in said central monitor for manually receiving tank information from a user for each said tank, said tank information at least including said strapping table volume information for each said tank and the identity of the fluid in each said tank, said central monitor in response to said received information being capable of continually determining for display in said display the current level of fluid in each of said tanks, the identity of the fluid in each of said tanks, and the flow rate of fluid flowing out of each said tank through communication with each of said local sensing units over said connecting means and said interconnecting cable segment means.

2. The system of claim 1 in which said central monitor is further capable of issuing an alarm signal when the level of fluid in any one of said tanks drops below a predetermined level.

3. The system of claim 1 in which said attaching means comprises:

a substantially rectangular modular container for holding each said local sensor unit, said modular container having connectors on opposing elongated ends for connecting to said cable segment means, supports attached on the top of said container, an elongated handle mounted on top of said supports, said supports being of sufficient height to allow said sensor cable to be wrapped about said supports to allow said level sensor to be stored under said handle when said level sensor is not attached to said tank, and means on the bottom of said container for holding said container to said tank.

4. The system of claim 1 in which each of said cable segment means are of equal predetermined length.

5. A portable oilfield fluid management system moveable from one oilfield location to another for measuring the levels of a plurality of different fluids stored in a plurality of storage tanks located at each oilfield location, said storage tanks being either of the same or different sizes, shapes, and capacities, each of said storage tanks having means for gaining access to the interior of the tank and having a strapping table showing volume at different heights within the tank, said system including a plurality of local sensing units and a central monitor capable of being interconnected with each of said local sensing units, each of said local sensing units being further connected by means of a sensor cable through said access means to a level sensor attached to an upper inside surface of said storage tank, each said local sensing unit with its connected level sensor being capable of measuring the level of fluid in said storage tank said improved system comprising:

means containing each of said local sensing units for attaching each said local sensing unit in any order to a exterior surface of said storage tanks, means for interconnecting electrically each attached local sensing unit to the adjacent local sensing unit so that all local sensing units are connected in series, and means connected to said central monitor for electrically connecting said central monitor to the first interconnected local sensing unit, said central monitor being capable of autoconfiguring said attached and interconnected local sensing units in each different oilfield by delivering a first binary address over said connecting means to said first interconnected local sensing unit, said first local sensing unit being capable of storing said first binary address as its identity code, said first local sensing unit being further capable of transmitting over said connecting means said first binary address back to said central monitor, said central monitor being further capable of receiving said transmitted first binary address from said first interconnected local sensing unit, said central monitor being capable of comparing said received first binary address to said delivered first binary address and when said comparison is the same said central monitor (a) redelivering said first binary address back to said first local sensing unit and (b) incrementing said first binary address to the next binary address, said first local sensing unit being further capable of receiving the redelivered first binary address from said central monitor and comparing it to said stored first binary address and when said comparison is the same said first local sensing unit connecting an upstream path so that said adjacent local sensing unit is capable of receiving said next incremented binary address from said central monitor, each of said interconnected local sensing units receiving its unique binary address from said central monitor in the same sequence as did said first interconnected local sensing unit.

6. The system of claim 5 further comprising:

means in said central monitor for manually receiving the following information from a user: (a) said volume levels from said strapping table, (b) the identity of the fluids in each of said tanks, (c) a predetermined minimum level of fluid for each tank and (d) the current level of said fluid in each of said tanks, said central monitor in response to said received information being capable of monitoring for display the current level of fluid in each of said tanks, the identity of the fluid in each of said tanks, and the flow rate of fluid flowing out of each said tank through communication with each of said local sensing units, said central monitor being further capable of issuing an alarm signal when the level of fluid in any of said tanks drops below a predetermined level.

7. The system of claim 5 in which said attaching means comprises:

a substantially rectangular modular container for holding each said local sensor unit, said modular container having connectors on opposing elongated ends for connecting to said cable segment means, supports attached on the top of said container, an elongated handle mounted on top of said supports, said supports being of sufficient height to allow said sensor cable to be wrapped about said supports to allow said level sensor to be stored under said handle when said level sensor is not attached to said tank, and means on the bottom of said container for holding said container to said tank.

8. A portable oilfield fluid management system moveable from one oilfield location to another system moveable from one oilfield location to another for measuring the levels of a plurality of different fluids stored in a plurality of storage tanks located at each oilfield location, said storage tanks being either of the same or different sizes, shapes, and capacities, each of said storage tanks having means for gaining access to the interior of the tank and having a strapping table showing volume at different heights within the tank, said system including a plurality of local sensing units and a central monitor capable of being interconnected with each of said local sensing units, each of said local sensing units being further connected by means of a sensor cable through said access means to a level sensor attached to an upper inside surface of said storage tank, each said local sensing unit with its connected level sensor being capable of measuring the level of fluid in said storage tank said system comprising:

means containing each of said local sensing units for attaching each said local sensing unit to an exterior surface of said storage tanks in any order of attachment, a plurality of cable segment means for interconnecting electrically each attached local sensing unit to the adjacent local sensing unit so that all local sensing units are connected in series, each of said cable segments being of predetermined equal length, means connected to said central monitor for electrically connecting said central monitor to the first interconnected local sensing unit, said central monitor being capable of autoconfiguring said attached and interconnected local sensing units in each different oilfield by delivering a first binary address over said connecting means to said first interconnected local sensing unit, said first local sensing unit being capable of storing said first binary address as its identity code, said first local sensing unit being further capable of transmitting over said connecting means (a) an acknowledgement signal and (b) said first binary address back to said central monitor, said central monitor being further capable of receiving (a) said transmitted first binary address and (b) said acknowledgement signal from said first interconnected local sensing unit, said central monitor being capable of comparing said received first binary address to said delivered first binary address and when said comparison is the same said central monitor being capable of (a) redelivering said first binary address back to said first local sensing unit and (b) incrementing said first binary address to the next binary address and when said comparison is not the same said central monitor designating said first interconnected local sensing unit as defective, said first local sensing unit being further capable of receiving said redelivered first binary address from said central monitor and comparing it to said stored first binary address and when said comparison is the same said first local sensing unit connecting an upstream transmitter path so that said adjacent local sensing unit is capable of receiving said next incremented binary address from said central monitor, each of said interconnected local sensing units receiving its unique binary address from said central monitor in the same sequence as aforesaid for said first interconnected local sensing unit, and means in said central monitor for manually receiving the following information from a user: (a) said volume levels from said strapping table, (b) the identity of the fluids in each of said tanks, (c) a predetermined minimum level of fluid for each tank and (d) the current level of said fluid in each of said tanks, said central monitor in response to said received information being capable of continually determining for display the current level of fluid in each of said tanks, the identity of the fluid in each of said tanks, and the flow rate of fluid flowing out of each said tank through communication with each of said local sensing units, said central monitor being further capable of issuing an alarm signal when the level of fluid in any of said tanks drops below a predetermined level.

9. The system of claim 8 in which said attaching means comprises:

a substantially rectangular modular container for holding each said local sensor unit, said modular container having (1) connectors on opposing elongated ends for connecting to said cable segment means and (2) outwardly protruding lips on either side of said connectors to protect said connectors from damage, supports attached on the top of said container, an elongated handle mounted on top of said supports, said supports being of sufficient height to allow said sensor cable to be wrapped about said supports to allow said level sensor to be stored under said handle when said level sensor is not attached to said tank, and means on the bottom of said container for holding said container to said tank.

10. A portable oilfield fluid management system for measuring in different oilfields the levels of different fluids stored in a plurality of different and the same sized tanks, the type of fluids and the configuration and number of tanks capable of varying from oilfield to oilfield, said system having a central monitor for displaying fluid information for each of said tanks, said portable oilfield fluid management system comprising:

a plurality of local sensing unit means removably attachable in any order to said tanks, one of said local sensing unit means being attached to one of said second plurality of tanks for measuring the level of fluid stored in the aforesaid tank, at least one container for transporting said plurality of local sensing unit means when said local sensing unit means are removed from said tanks, a plurality of cable segment means having connectors on opposing ends for releasably and electrically interconnecting each attached local sensing unit means to the adjacent local sensing unit attached to the next tank, an elongated cable means for releasably interconnecting said central monitor to the first interconnected local sensing unit means, at least one moveable reel means for reeling said cable segment means when said cable segment means are disconnected from said plurality of local sensing unit means, said cable segment means being further releasably interconnected with each other's connectors, said at least one moveable reel means being further capable of reeling said elongated cable when released from said central monitor and said first interconnected local sensing unit means, said central monitor being capable of autoconfiguring said attached local sensing unit means in each oilfield location by delivering a unique identity address to each attached local sensing unit means over said interconnected elongated cable and said interconnected cable segment means, each said local sensing unit means being capable of storing its unique address delivered by said central monitor, and means in said central monitor for determining for display the current level of fluid in each of said tanks, the identity of fluid in each of said tanks, and the flow rate of fluid flowing out of each said tank, said central monitor being further capabe of issuing an alarm signal when the level of fluid in any of said tanks below a predetermined level.

11. A portable oilfield fluid management system for measuring in different oilfields the levels of different fluids stored in a plurality of different and the same sized tanks, the type of fluids and the configuration and number of tanks capable of varying from oilfield to oilfield, said system having a central monitor for displaying fluid information for each of said tanks, said portable oilfield fluid management system further comprising:

a plurality of local sensing unit means removably attachable in any order to said tanks, one of said local sensing unit means being attached to one of said second plurality of tanks for measuring the level of fluid stored in the aforesaid tank, at least one container for transporting said plurality of local sensing unit means when said local sensing unit means are removed from said tanks, a plurality of cable segment means having connectors on opposing ends for releasably and electrically interconnecting each attached local sensing unit means to the next adjacent local sensing unit attached to the next tank, each of said cable segments means being of equal predetermined length, an elongated cable for releasably interconnecting said central monitor to the first interconnected local sensing unit means, at least one moveable reel means for reeling said cable segment means when said cable segment means are disconnected from said plurality of local sensing unit means, said cable segment means being further releasably interconnected with each other's connectors, said at least one moveable reel means being further capable of reeling said elongated cable when released from said central monitor and said first interconnected local sensing unit means, said central monitor being capable of autoconfiguring said attached local sensing unit means in each oilfield location by delivering a unique identity address to each attached local sensing unit means over said interconnected elongated cable and said cable segment means, each said local sensing unit means being capable of storing its unique address delivered by said central monitor, and means in said central monitor for manually receiving at least the following information from a user in said oilfield: (a) volume level data for each said tank, (b) the identity of the fluids in each of said tanks, (c) a predetermined minimum level of fluid for each tank and (d) the current level of said fluid in each of said tanks, said central monitor in response to said received information being capable of continually determining for display the current level of fluid in each of said tanks, the identity of the fluid in each of said tanks, and the flow rate of fluid flowing out of each said tank through communication with each of said local sensing units, said central monitor being further capable of issuing an alarm signal when the level of fluid in any of said tanks drops below its said predetermined level.

12. A portable oilfield treatment fluid management system for measuring in different oilfields the levels of a first plurality of different treatment fluids stored in a second plurality of different and the same sized tanks, the type of fluids and the configuration and number of tanks capable of varying from oilfield to oilfield, said system having a central monitor for displaying fluid information for each of said tanks, said portable oilfield treatment fluid management system comprising:

a plurality of local sensing unit means removably attachable in any order to said tanks, one of said local sensing unit means being attached to one of said second plurality of tanks for measuring the level of fluid stored in the aforesaid tank, each of said local sensing unit means having a male and a female electrical connector, each said local sensing unit means further comprising:

(a) a fluid level sensor connected to each said local sensing unit means for determining said level, and (b) a sensor cable connected at one end to said fluid level sensor and at the opposing end to said local sensing unit means, at least one container for transporting said plurality of local sensing unit means when said local sensing unit means are removed from said tanks, a plurality of cable segment means having male and female connectors on opposing ends for releasably and electrically interconnecting the male and female connectors of each attached local sensing unit means to said male and female connectors on the adjacent local sensing unit attached to the next tank, each of said cable segments means being of equal predetermined length, an elongated cable for releasably interconnecting said central monitor to the first interconnected local sensing unit means, at least one moveable reel means for reeling said cable segment means when said cable segment means are disconnected from said plurality of local sensing unit means, said cable segment means being further releasably interconnected with each other's male and female connectors, said at least one moveable reel means being further capable of reeling said elongated cable when released from said central monitor and said first interconnected local sensing unit means, means connected to said central monitor for electrically connecting said central monitor to the first interconnected local sensing unit, said central monitor being capable of autoconfiguring said attached and interconnected local sensing units in each different oilfield by delivering a first binary address over said connecting means to said first interconnected local sensing unit, said first local sensing unit being capable of storing said first binary address as its identity code, said first local sensing unit being further capable of connecting an upstream path in response to said storing so that said adjacent and interconnected local sensing unit is capable of receiving said next incremented binary address from said central monitor, each of said interconnected local sensing units receiving its unique binary address from said central monitor connecting an upstream path as aforesaid for said first interconnected local sensing unit, and means in said central monitor for manually receiving tank information form a user said tank information at least including volume information for each said tank and the identity of the fluid in each said tank, said central monitor in response to said received tank information being capable of continually determining for display the current level of fluid in each of said tanks, the identity of the fluid in each of said tanks, and the flow rate of fluid flowing out of each said tank.

13. The system of claim 12 wherein said central monitor is further capable of issuing an alarm signal when the level of fluid in any of said tanks drops below a predetermined level.

14. The system of claim 12 in which each said local sensing means further comprises:

a substantially rectangular modular container for holding each said local sensor unit, said modular container having male and female connectors on opposing elongated ends for connecting to said cable segment means, supports attached on the top of said container, an elongated handle mounted on top of said supports, said supports being of sufficient height to allow said sensor cable to be wrapped about said supports to allow said level sensor to be stored under said handle when said fluid level sensor is not attached to said tank, and means on the bottom of said container for holding said container to said tank.

15. A portable oilfield management system for measuring parameters for pieces of equipment in different oilfields, said system having a central monitor for displaying information concerning said parameters, said portable oilfield management system further comprising:

a plurality of local sensing unit means removably attachable in any order of attachment to said pieces of equipment, one of said local sensing unit means being attached to one of said pieces of equipment for measuring said parameter, at least one container for transporting said plurality of local sensing unit means when said local sensing unit means are removed from said equipment, a plurality of cable segment means having male and female connectors on opposing ends for releasable and electrically interconnecting the male and female connectors of each attached local sensing unit means to the male and female connectors on the adjacent local sensing unit attached to the next piece of equipment, each of said cable segments being of equal predetermined length, an elongated cable means for releasably connecting said central monitor to the first interconnected local sensing unit means, at least one moveable reel means for reeling said cable segment means when said cable segment means are disconnected from said plurality of local sensing unit means, said cable segment means being further releasably interconnected with each other's connectors, said at least one moveable reel means being further capable of reeling said elongated cable when released from said central monitor and said first interconnected local sensing unit means, said central monitor being capable of autoconfiguring said attached local sensing unit means in each oilfield location by delivering a unique identity address to each attached local sensing unit means over said interconnected elongated cable and said cable segment means, each said local sensing unit means being capable of storing its unique address delivered by said central monitor, and means in said central monitor for determining for display said information, through communication with each of said local sensing units over said interconnecting cable means and over said connecting elongated cable means, said central monitor being further capable of issuing an alarm signal when the parameter for any piece of said equipment exceeds a ppredetermined level.

16. An oilfield fluid management method for a portable system adaptable for use in one oilfield location and then to another, said method being capable of determining the levels of a plurality of different fluids stored in a plurality of storage tanks located at each oilfield location, said storage tanks being either of the same or different sizes, shapes, and capacities, each of said storage tanks having a strapping table showing volume at different heights within the tank, said system including a plurality of local sensing units and a central monitor with an input device and a display, said central monitor being capable of being interconnected with each of said local sensing units, each of said local sensing units being capable of measuring the level of fluid in a tank, said method comprising the steps of:

attaching in any order each local sensing unit to one of the storage tanks so that the levels of fluid can be monitored in said tanks, interconnecting each attached local sensing unit to each adjacent attached local sensing unit with one or a plurality of equal predetermined lengths of cable, connecting the first interconnected local sensing unit to the central monitor with an elongated cable, manually keying into said input device of the central monitor input information in order to initialize said portable system, said input information at least including the volume information from said strapping table, the identity of fluids in each of said tanks, and a predetermined minimum level of fluid for each tank, periodically measuring the level of fluid in each of said tanks through selective addressing of the stored address in each interconnected local sensing unit, delivering signals conveying the measured level of fluid in each said tank from the attached local sensing unit to the central monitor in response to said measurement, and determining for display in said display the current level of fluid in each of said tanks and the flow rate of fluid out of each said tank in response to said delivered signals and the identity of fluid in each of said tanks in response to said input information.

17. The method of claim 16 further comprising the step of:

autoconfiguring each attached local sensing unit with a unique address by performing the steps of:

(a) delivering a first address from said central monitor to said first interconnected local sensing unit, over said elongated cable, (b) storing said delivered first address in said first interconnected local sensing unit in response to said delivery from said central monitor, (c) transmitting said stored first address from said first interconnected local sensing unit back to said central monitor in response to said storage of said first address by said first interconnected local sensing unit, (d) comparing said delivered first address with said transmitted first address in said central monitor in response to said transmitted first address from said first interconnected local sensing unit, (e) redelivering said compared first address from said central monitor to said first interconnected local sensing unit in response to said comparison being the same address by said central monitor, (f) comparing said redelivered first address with said stored address in said local sensing unit and when the same enabling an upstream data path to connect said central monitor with the next interconnected local sensing unit, (g) incrementing the first address in response to said comparison being the same addresses in aforesaid step (f) by said central monitor, (h) repeating steps (a) through (g) for all adjacent interconnected local sensing units.

18. The method of claim 16 further comprising the steps of:

displaying a graph having a vertical bar showing the fluid on a relative percent full scale contained in each tank in response to a user request, and indicating on each vertical bar displayed the type of fluid stored in the tank represented by the bar.

19. The method of claim 17 further comprising the steps of:

continually determining in said central monitor the minutes until empty for each attached tank, and displaying in said display of said control monitor the minutes until empty for each tank in response to a user request.

20. The method of claim 16 further comprising the steps of:

continually determining in said central monitor the total barrels pumped for each type of fluid and the number of tanks containing each type of fluid, and displaying in said display of said central monitor the total barrels pumped for each type of fluid and the number of tanks containing each type of fluid in response to a user request.

21. The method of claim 16 further comprising the steps of:

continually determining in said central monitor the total barrels pumped out of each tank, the total barrels remaining in each tank, the flow rate in each tank and the level of fluid in each tank, and displaying in said display of said central monitor for each tank the total barrels pumped out, the total barrel remaining, the flow rate, and the level of fluid in response to a user request.

22. An oilfield fluid management method for a portable system adaptable for use in one oilfield location and then to another, said method being capable of determining the levels of a plurality of different fluids stored in a plurality of storage tanks located at each oilfield location, said storage tanks being either of the same or different sizes, shapes, and capacities, each of said storage tanks having a strapping table showing volume at different heights within the tank, said system including a plurality of local sensing units and a central monitor with an input device and a display, said central monitor being capable of being interconnected with each of said local sensing units, each of said local sensing units being capable of measuring the level of fluid in a tank, said method comprising the steps of:

attaching in any order each local sensing unit to one of the storage tanks so that the levels of fluid can be monitored in said tanks, interconnecting each attached local sensing unit to each adjacent attached local sensing unit with one or a plurality of equal predetermined lengths of cable, connecting the first interconnected local sensing unit to the central monitor with an elongated cable, assigning each attached local sensing unit a unique address, delivering the aforesaid unique address from the central monitor to each attached local sensing unit over the elongated cable and said predetermined lengths of cable, manually keying into said input device of the central monitor input information in order to initialize said portable system, said input information at least including the volume information from said strapping table, the identity of fluids in each of said tanks, and a predetermined minimum level of fluid for each tank, periodically measuring the level of fluid in each of said tanks through selective addressing of the stored address in each interconnected local sensing unit, delivering signals conveying the measured level of fluid in each said tank from the attached local sensing unit to the central monitor in response to said measurement, and determining for display in said display the current level of fluid in each of said tanks and the flow rate of fluid out of each said tank in response to said delivered signals and the identity of fluid in each of said tanks in response to said input information.

23. The method of claim 22 further comprising the steps of:

displaying a graph having a vertical bar showing the fluid on a relative percent full scale contained in each tank in response to a user request, and indicating on each vertical bar displayed the type of fluid stored in the tank represented by the bar.

24. The method of claim 23 further comprising the steps of:

continually determining in said central monitor the minutes until empty for each attached tank, and displaying in said display of said central monitor the minutes until empty for each tank in response to a user request.

25. The method of claim 22 further comprising the steps of:

continually determining in said central monitor the total barrels pumped for each type of fluid and the number of tanks containing each type of fluid, and displaying in said display of said central monitor the total barrels pumped for each type of fluid and the number of tanks containing each type of fluid in response to a user request.

26. The method of claim 22 further comprising the steps of:

continually determining in said central monitor the total barrels pumped out of each tank, the total barrels remaining in each tank, the flow rat4rate in each tank and the level of fluid in each tank, and displaying in said display of said central monitor for each tank the total barrels pumped out, the total barrel remaining, the flow rate, and the level of fluid in response to a user request.

* * * * *